US007493237B2

(12) United States Patent
Weinberg et al.

(10) Patent No.: US 7,493,237 B2
(45) **Date of Patent: *Feb. 17, 2009**

(54) ENVIRONMENTAL MONITORING AND REPORTING SYSTEM

(75) Inventors: Marla K Weinberg, Milford, OH (US); Clifford S Whitam, Mason, OH (US); Richard M Smith, Cincinnati, OH (US); Sarah Francis Watson Williams, Loveland, OH (US); Suzanne Rice Hamilton, Germantown, TN (US); David Keith Brillhart, Mobile, AL (US); Marceia Louise Cox, Bartlett, TN (US); Karen Beth Risse, Memphis, TN (US); Daniel Joseph Trate, Loveland, OH (US)

(73) Assignee: International Paper Company, Memphis, TN (US)

( * ) Notice: Subject to any disclaimer, the term of this patent is extended or adjusted under 35 U.S.C. 154(b) by 52 days.

This patent is subject to a terminal disclaimer.

(21) Appl. No.: 11/207,407

(22) Filed: Aug. 19, 2005

(65) Prior Publication Data

US 2006/0161388 A1 Jul. 20, 2006

(51) Int. Cl.
*G08B 21/00* (2006.01)

(52) U.S. Cl. ..... 702/188; 702/30; 702/35; 702/182; 702/183; 702/184; 702/185

(58) Field of Classification Search ..... 702/19, 702/22, 23, 27, 28, 30–36, 39, 40, 54, 56, 702/103, 113, 114, 121, 122, 123, 182–185; 700/266; 60/274, 276, 277, 284, 286, 784; 73/23.2, 23.35, 23.22, 23.36, 31.05, 861.04, 73/152.42, 118.1, 587; 123/3, 672, 674, 123/676, 677, 690, 703

See application file for complete search history.

(56) References Cited

U.S. PATENT DOCUMENTS

| | | | | |
|---|---|---|---|---|
| 4,901,245 | A * | 2/1990 | Olson et al. | 702/54 |
| 5,257,530 | A * | 11/1993 | Beattie et al. | 73/61.75 |
| 5,564,283 | A * | 10/1996 | Yano et al. | 60/274 |
| 5,930,993 | A * | 8/1999 | Kammann et al. | 60/274 |
| 6,385,558 | B1 * | 5/2002 | Schlemm | 702/182 |
| 6,701,255 | B2 * | 3/2004 | Batug et al. | 702/24 |
| 2002/0152037 | A1 * | 10/2002 | Sunshine et al. | 702/23 |

* cited by examiner

*Primary Examiner*—Carol S Tsai
(74) *Attorney, Agent, or Firm*—Matthew M. Eslami

(57) ABSTRACT

A system and method are provided for tracking and documenting environmental compliance in a pulp mill, related primarily to the bypassing of liquid hazardous pollutants from a capture and treatment system. The method and system provide continuous information regarding the input materials, the output products, and the operations of equipment in the pulping process. The continuous information is provided to a central processor for determination of emission levels that exceed certain predetermined levels. The method and system permit personnel to verify compliance with environmental regulations, verify the reliability of pollutant collection and treatment equipment and record the actions taken to correct an inappropriate emission or equipment failure.

22 Claims, 26 Drawing Sheets

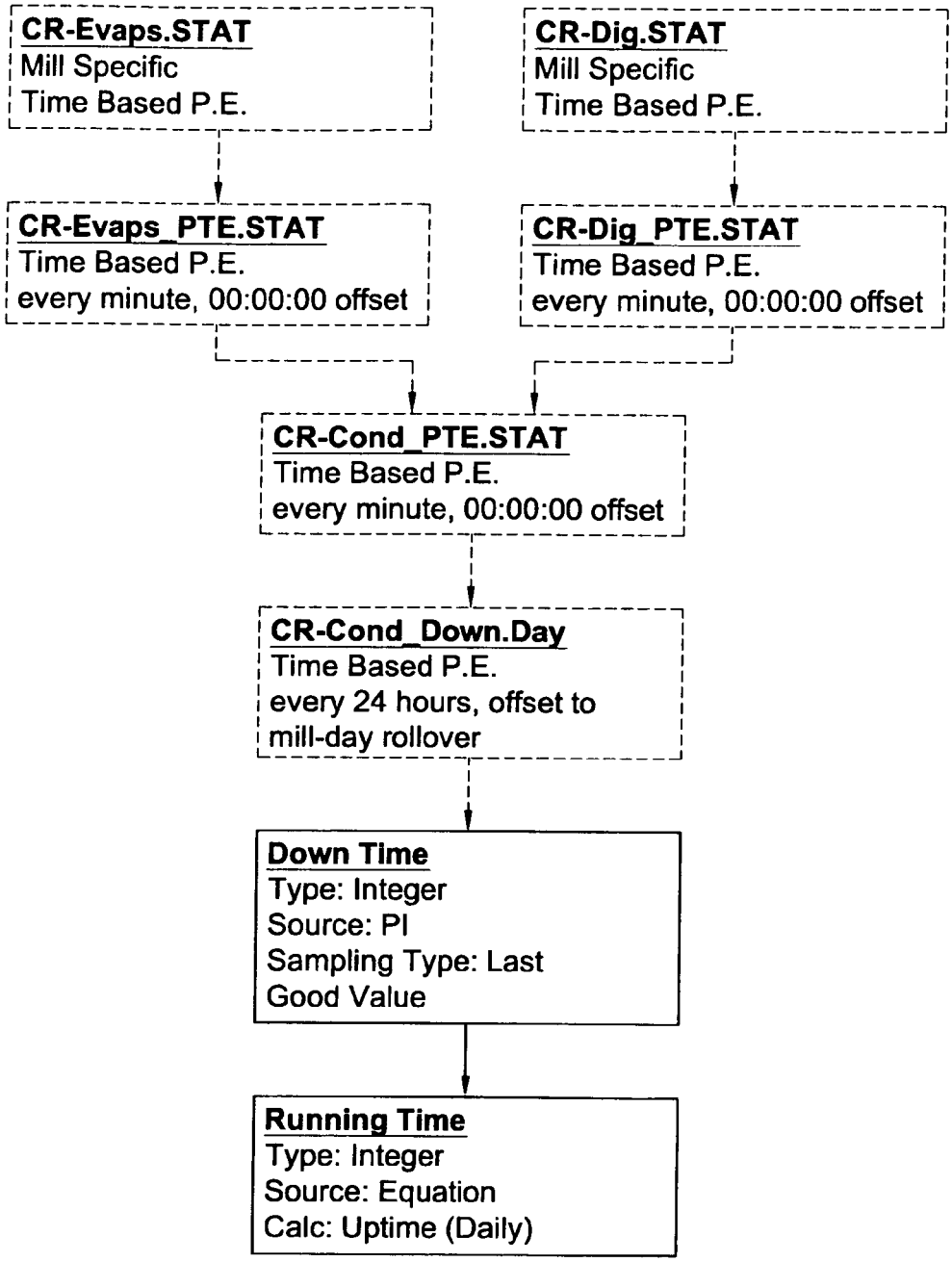
Fig. 1A
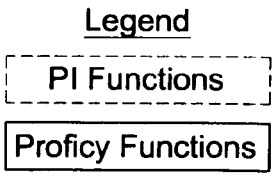

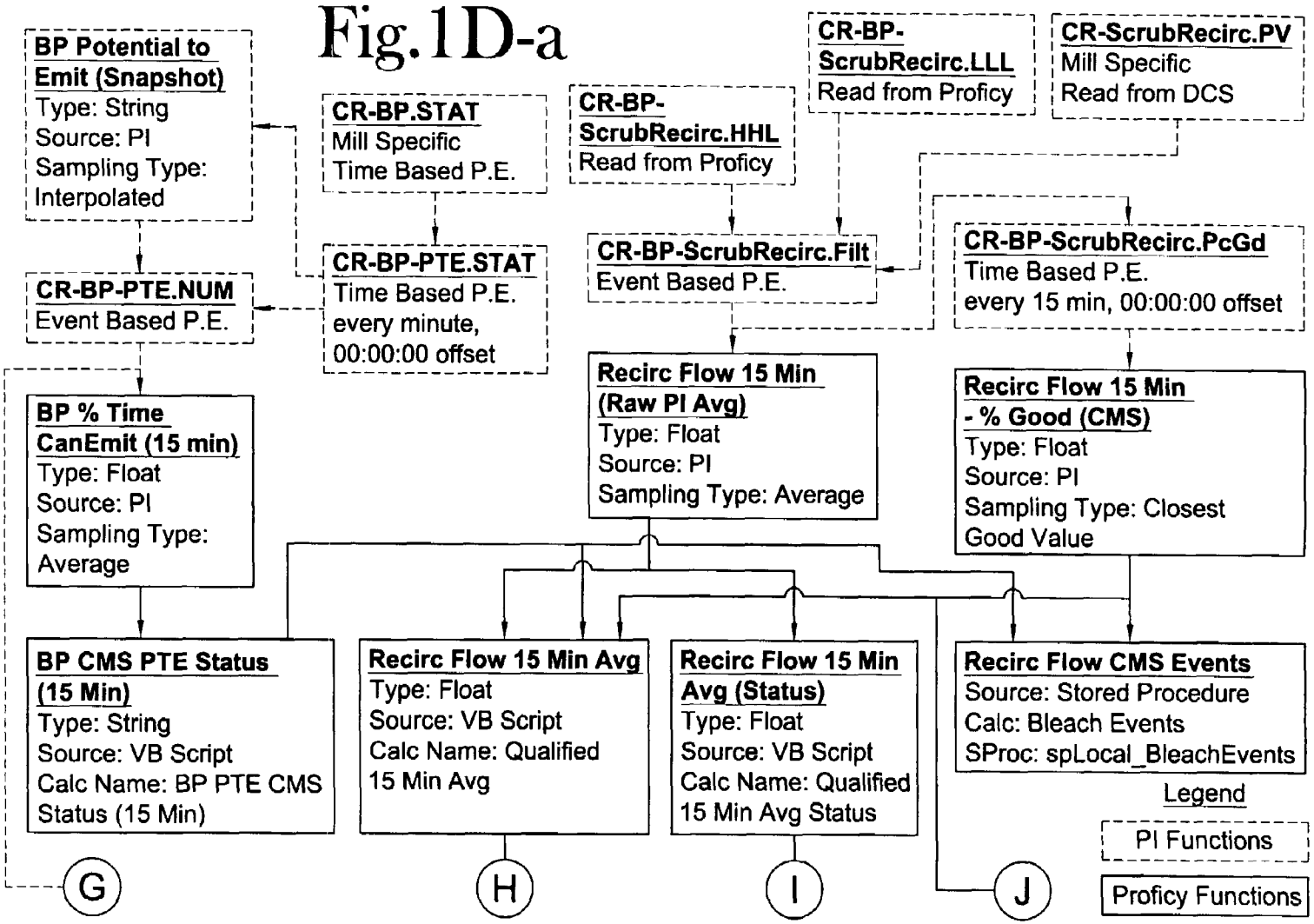
Fig. 1D-a

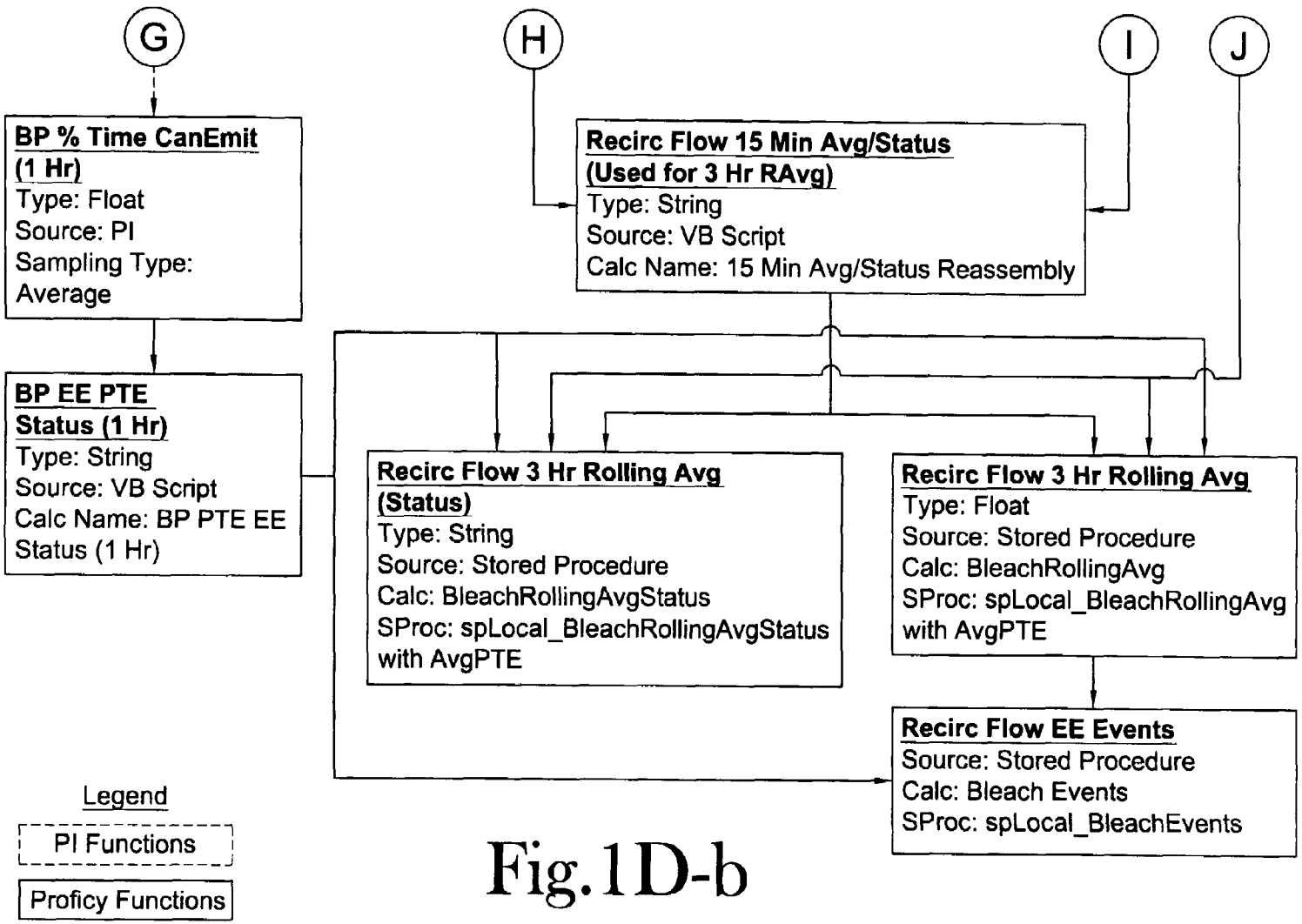
Fig. 1D-b

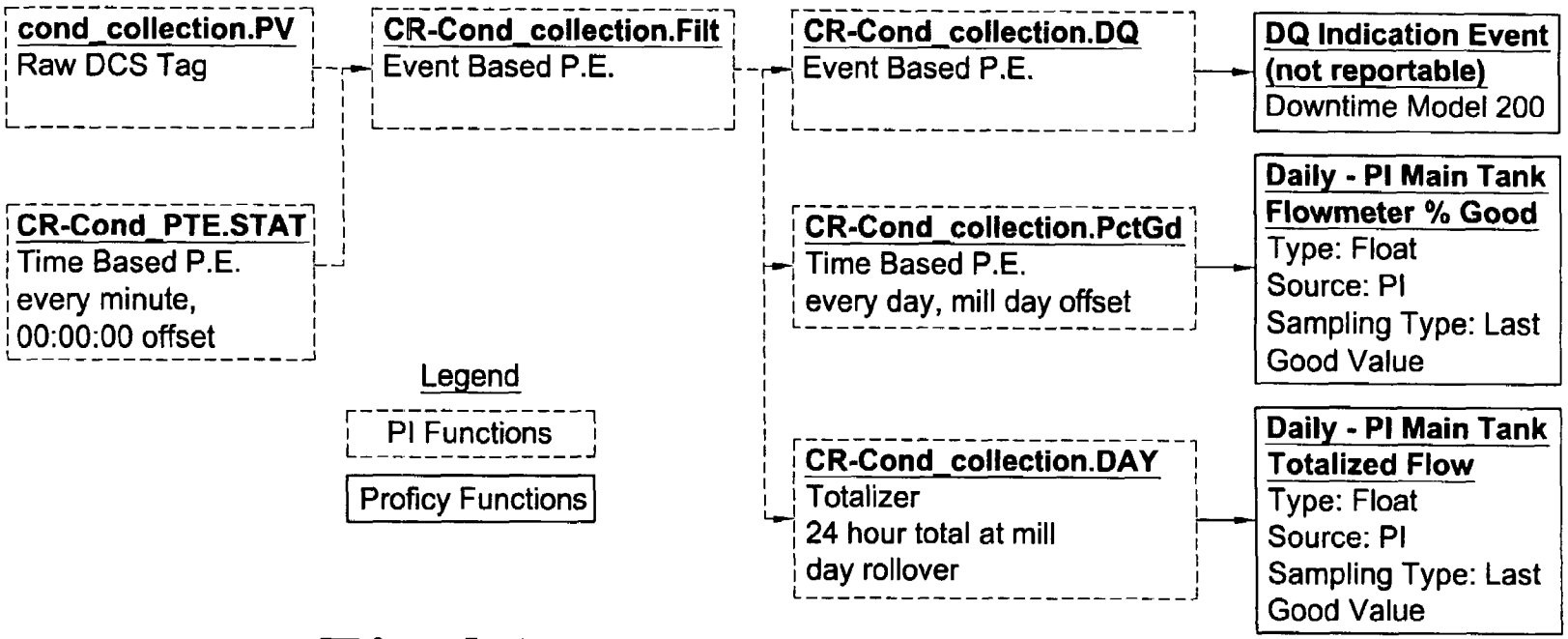
Fig. 2A-a

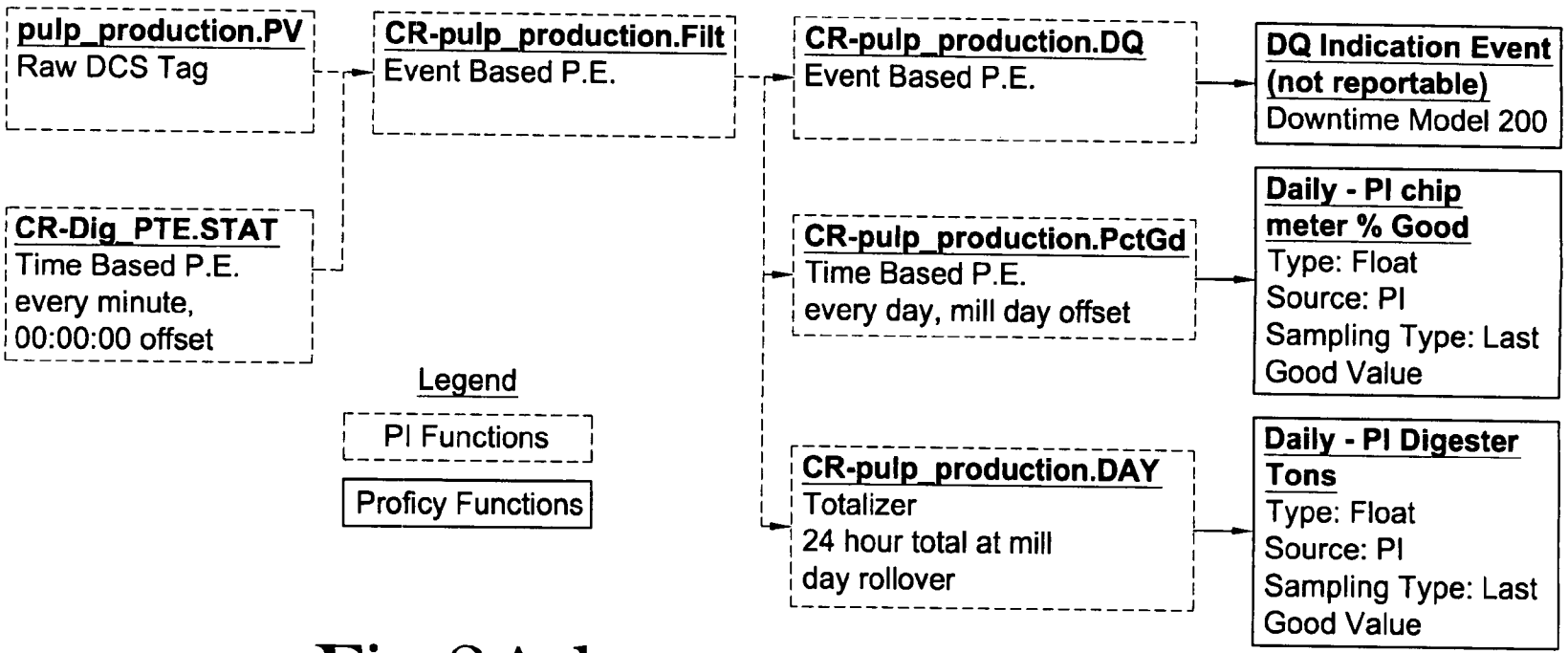
Fig.2A-b

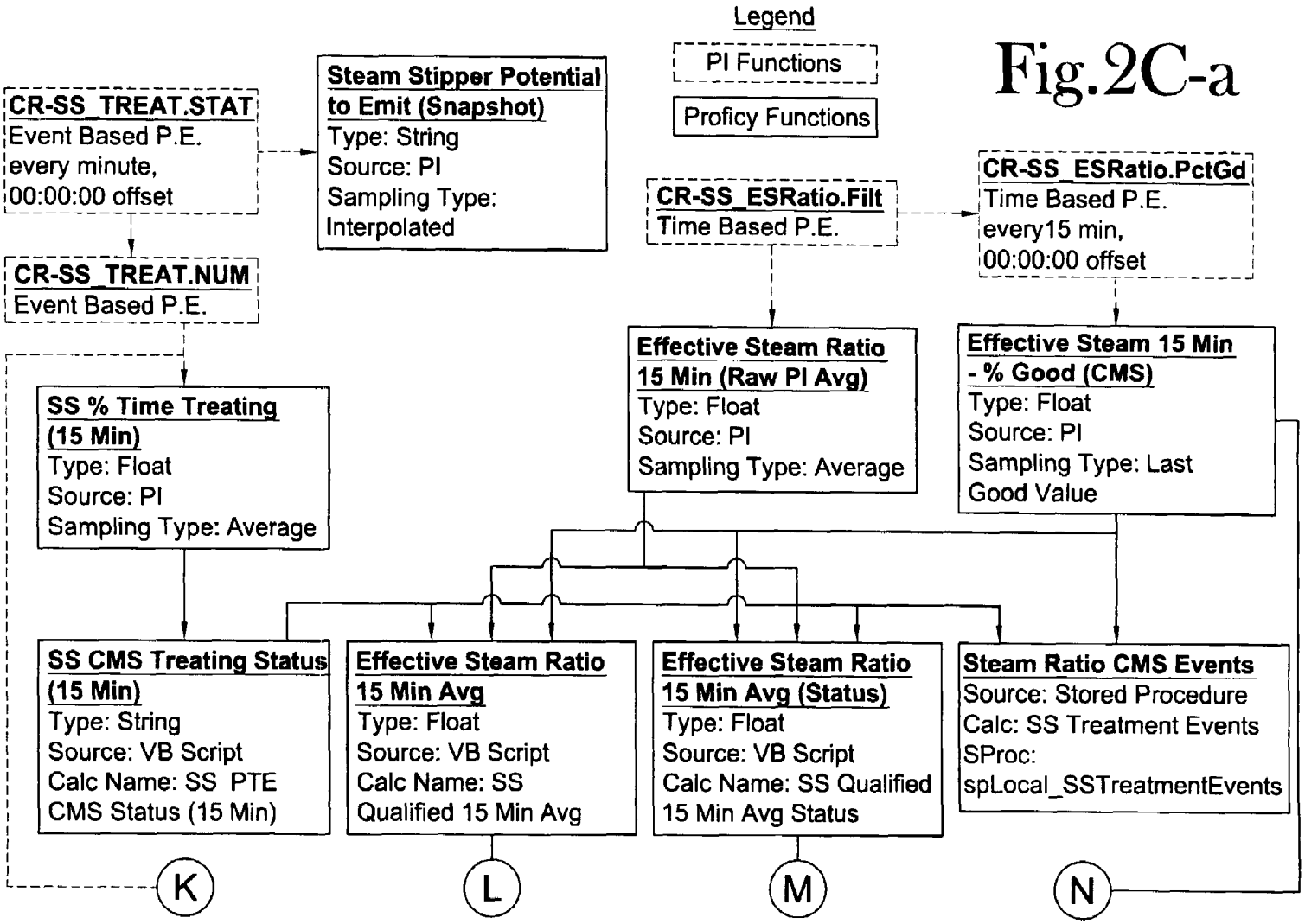
Fig.2C-a

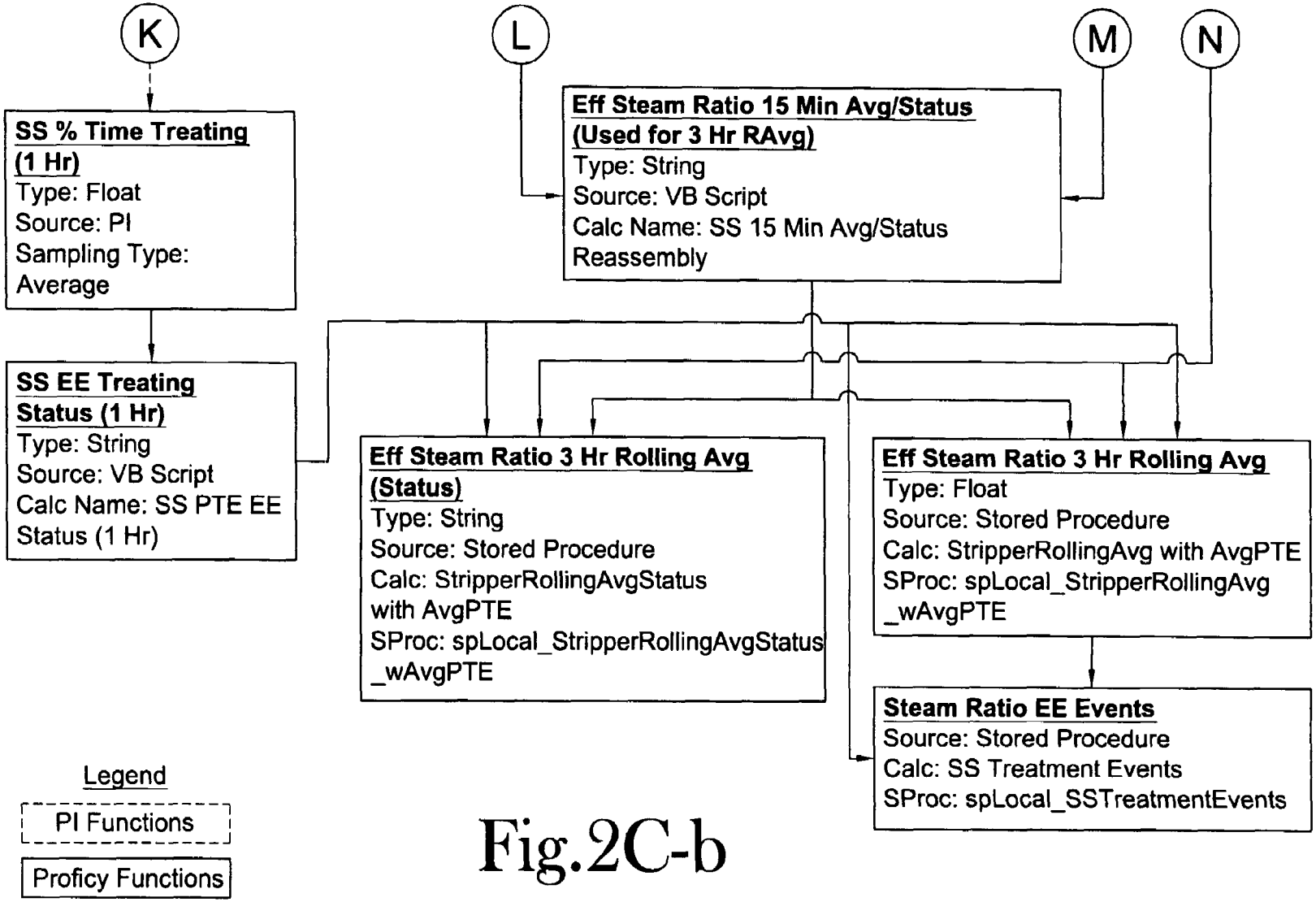
Fig.2C-b

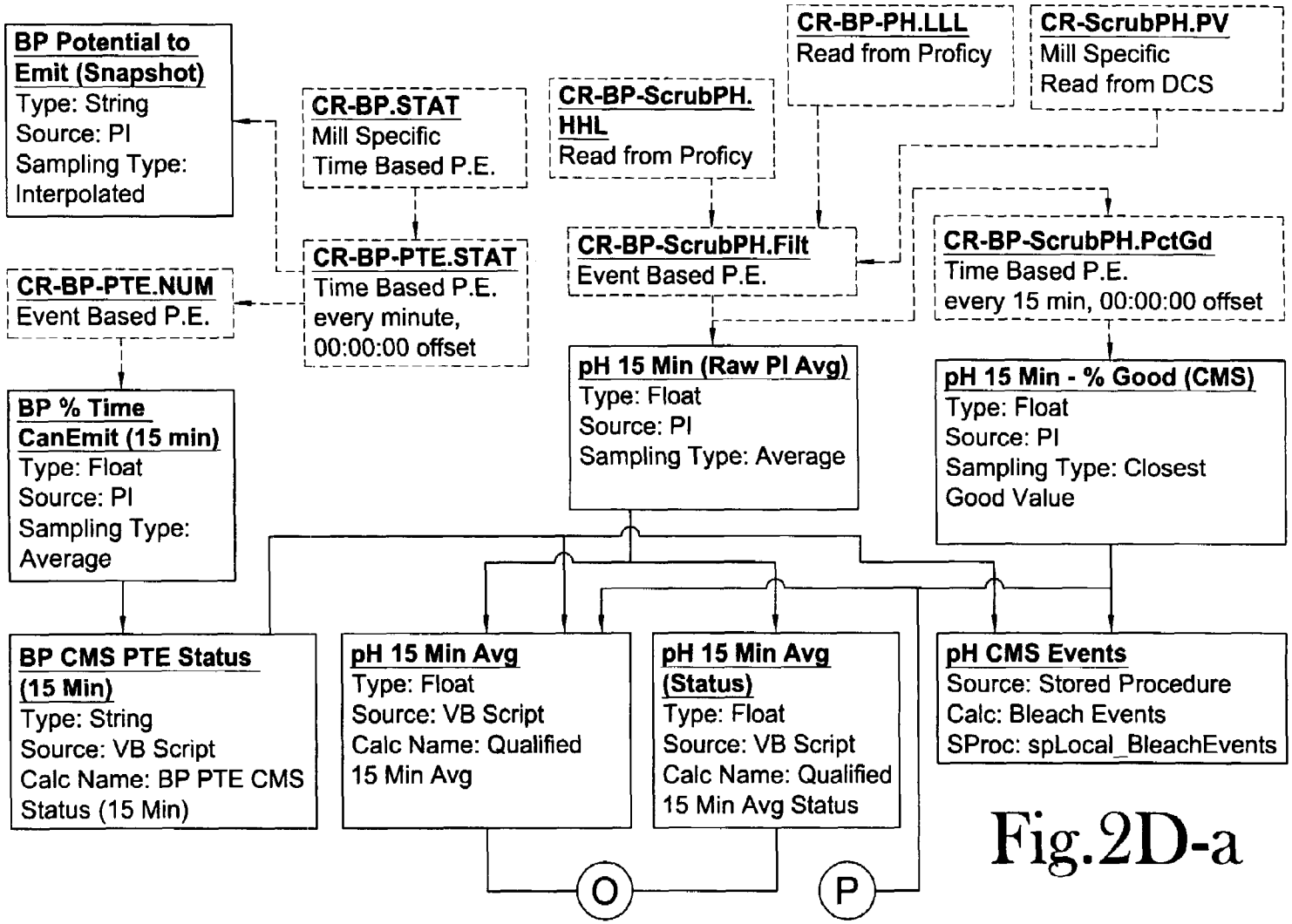
Fig.2D-a

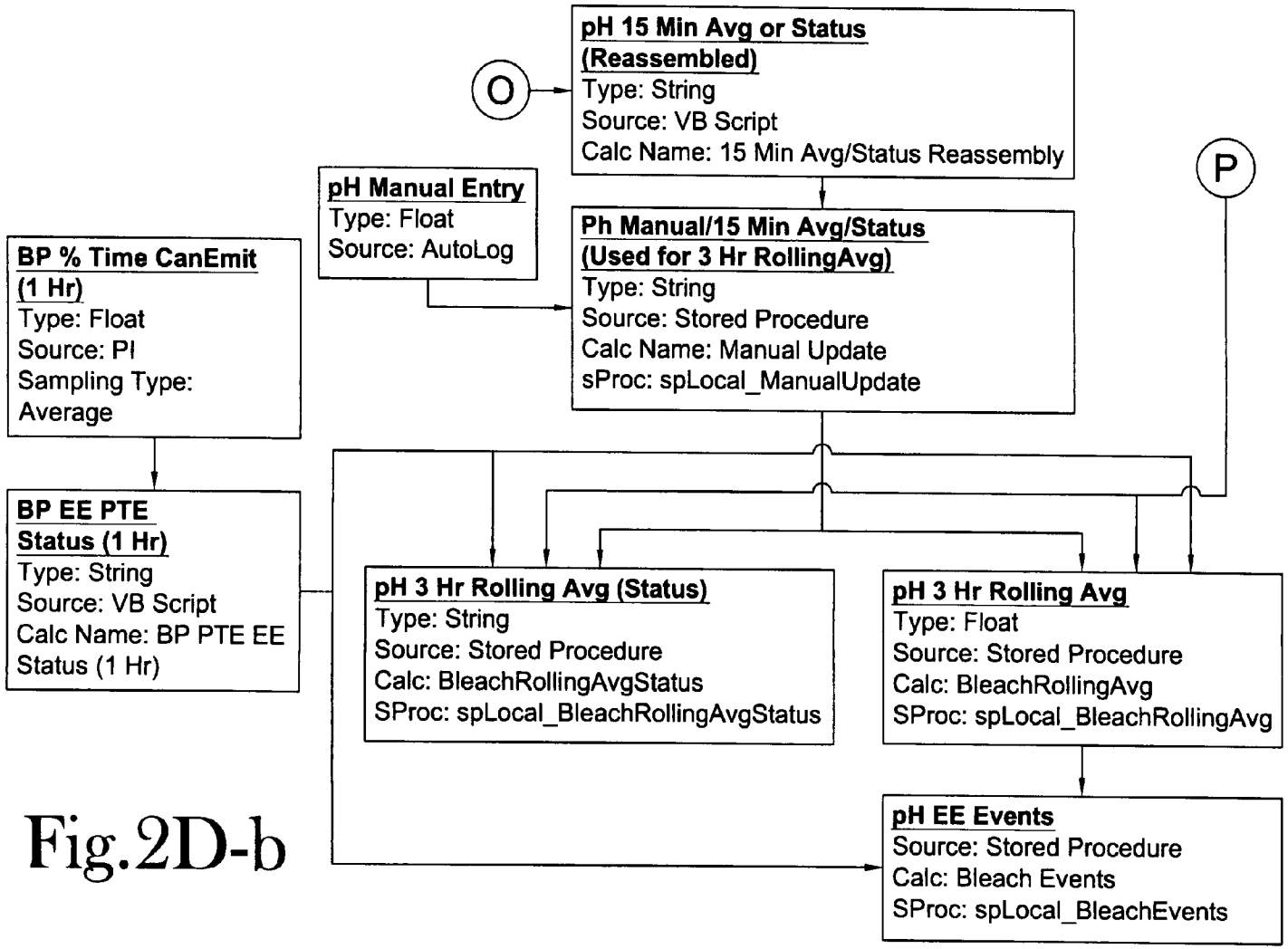
Fig.2D-b

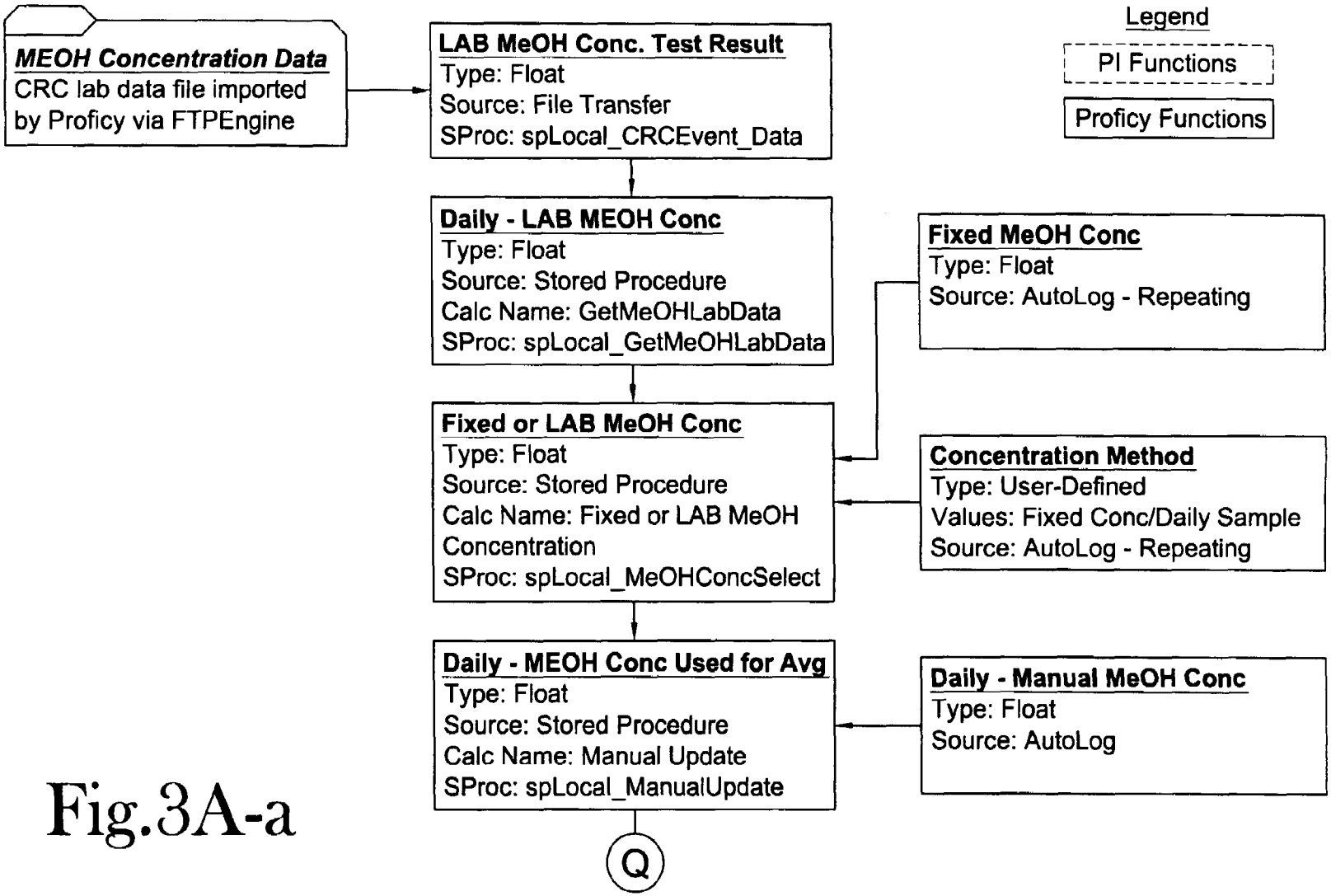
Fig.3A-a

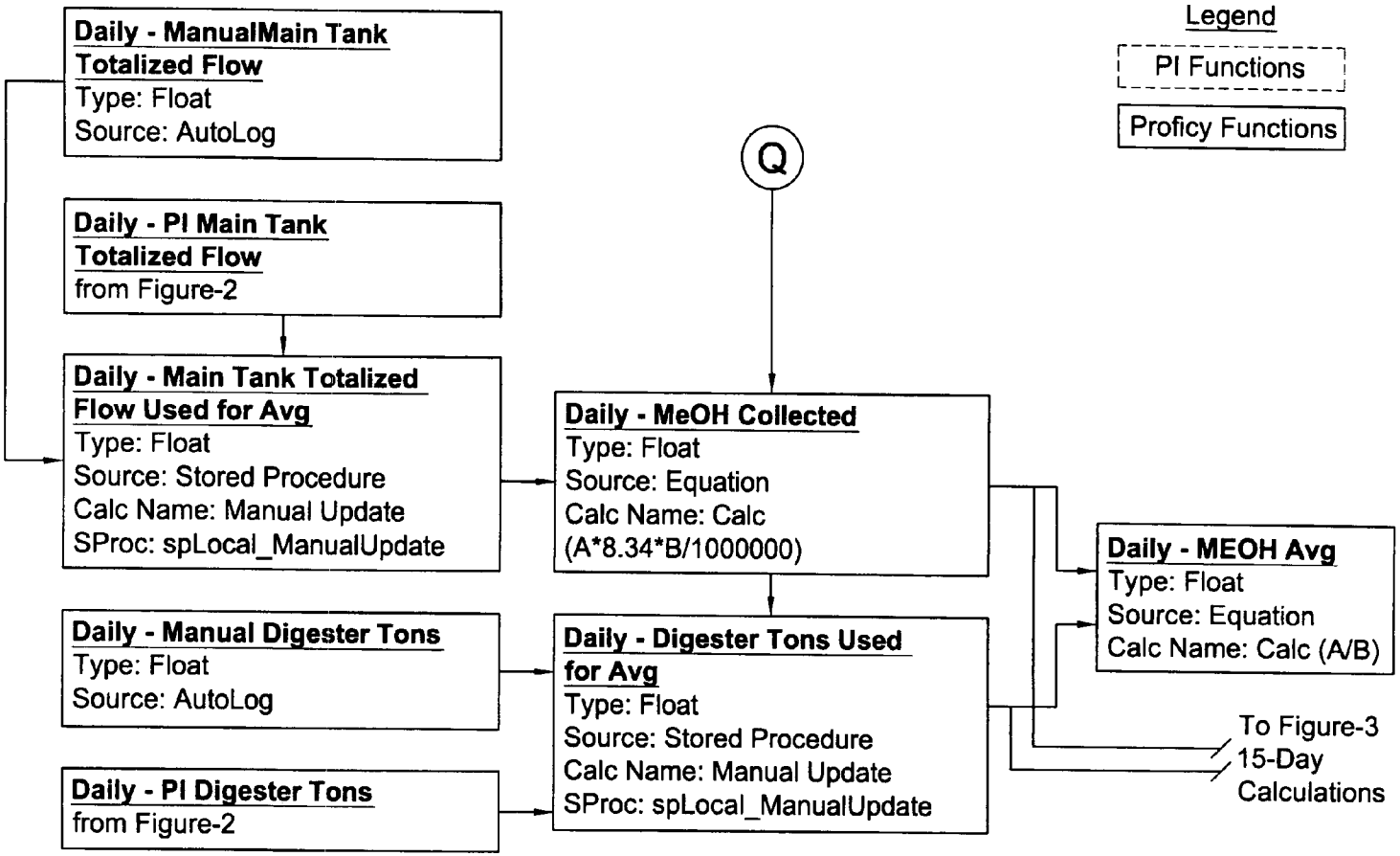
Fig.3A-b

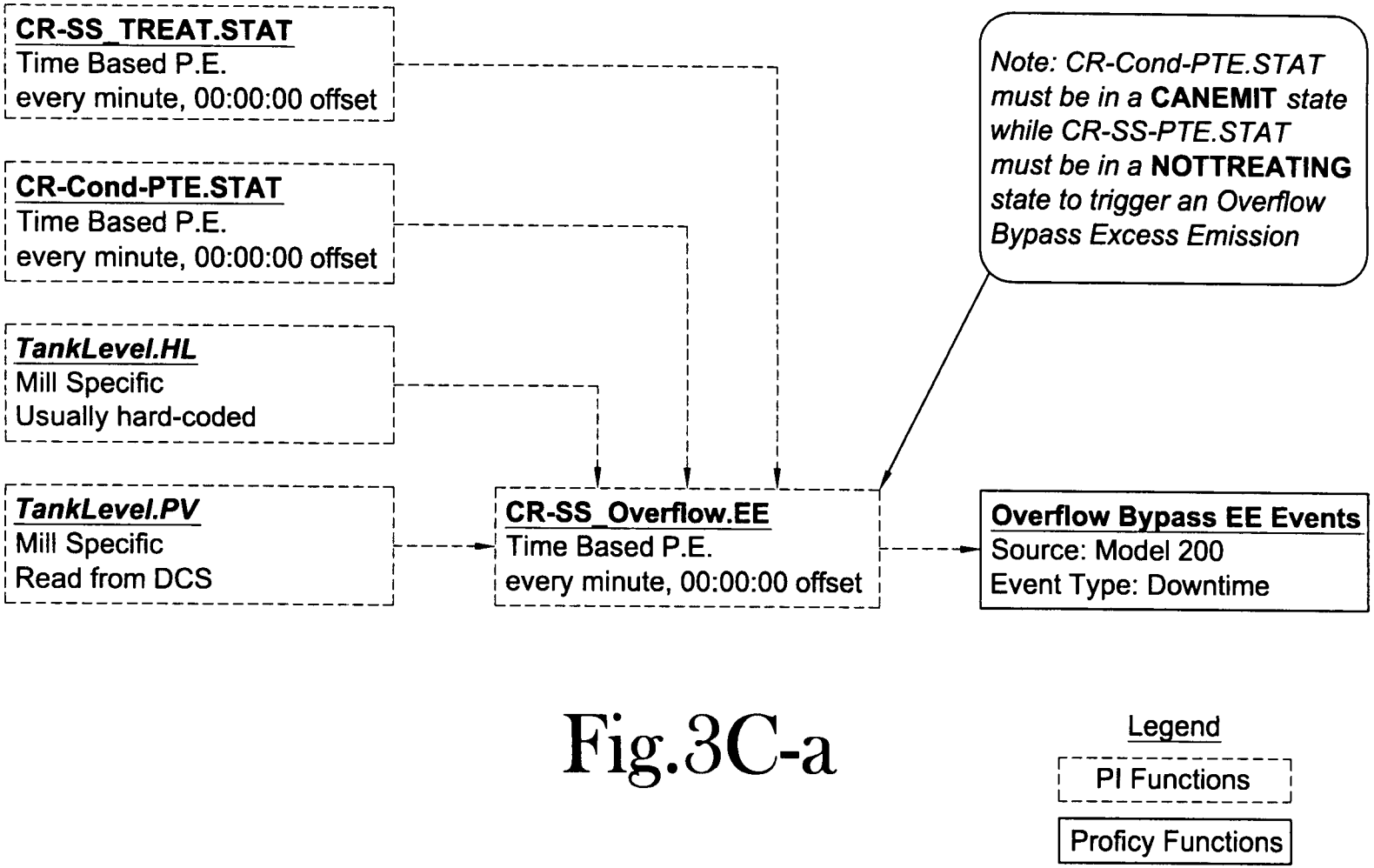
Fig.3C-a

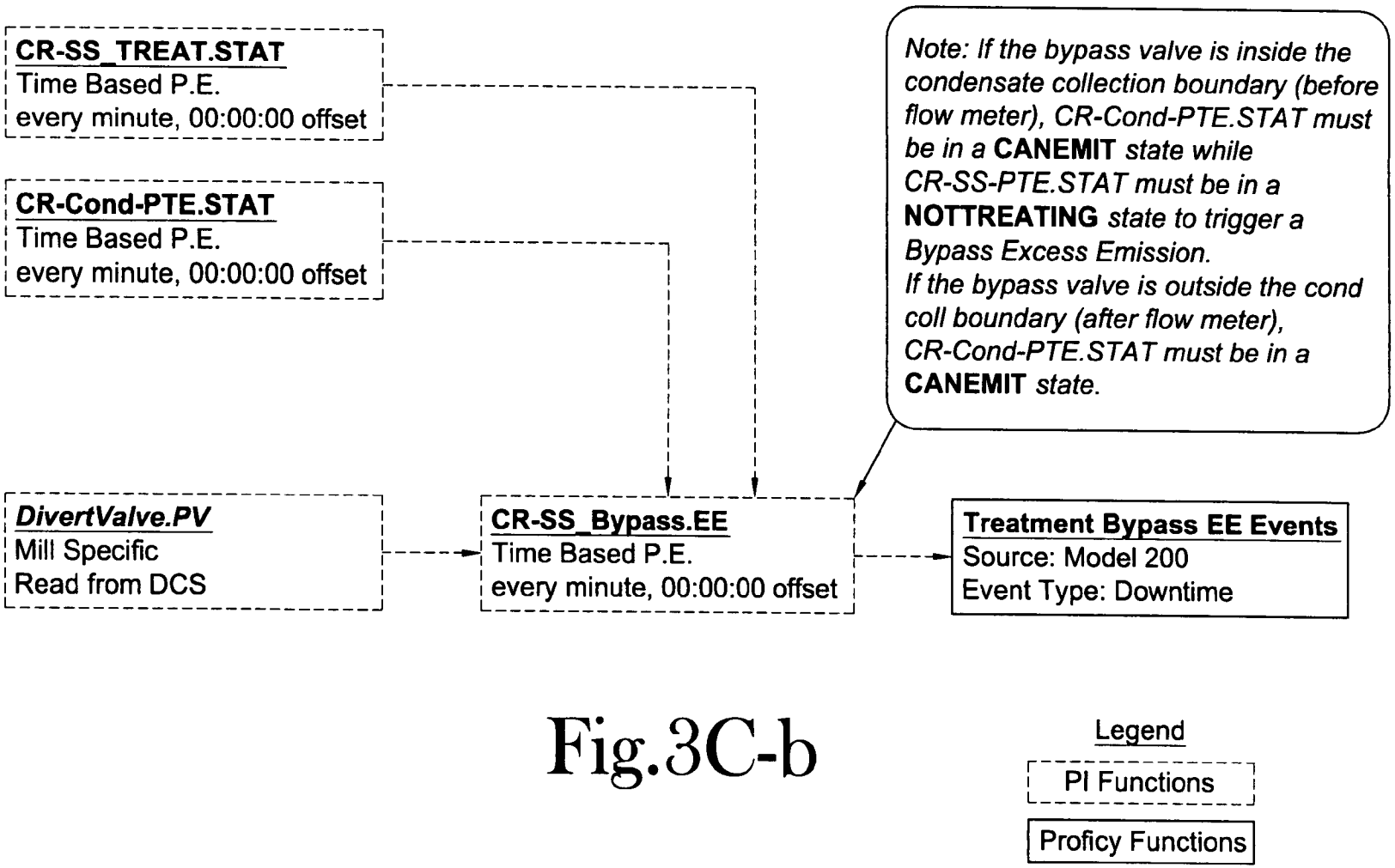
Fig.3C-b

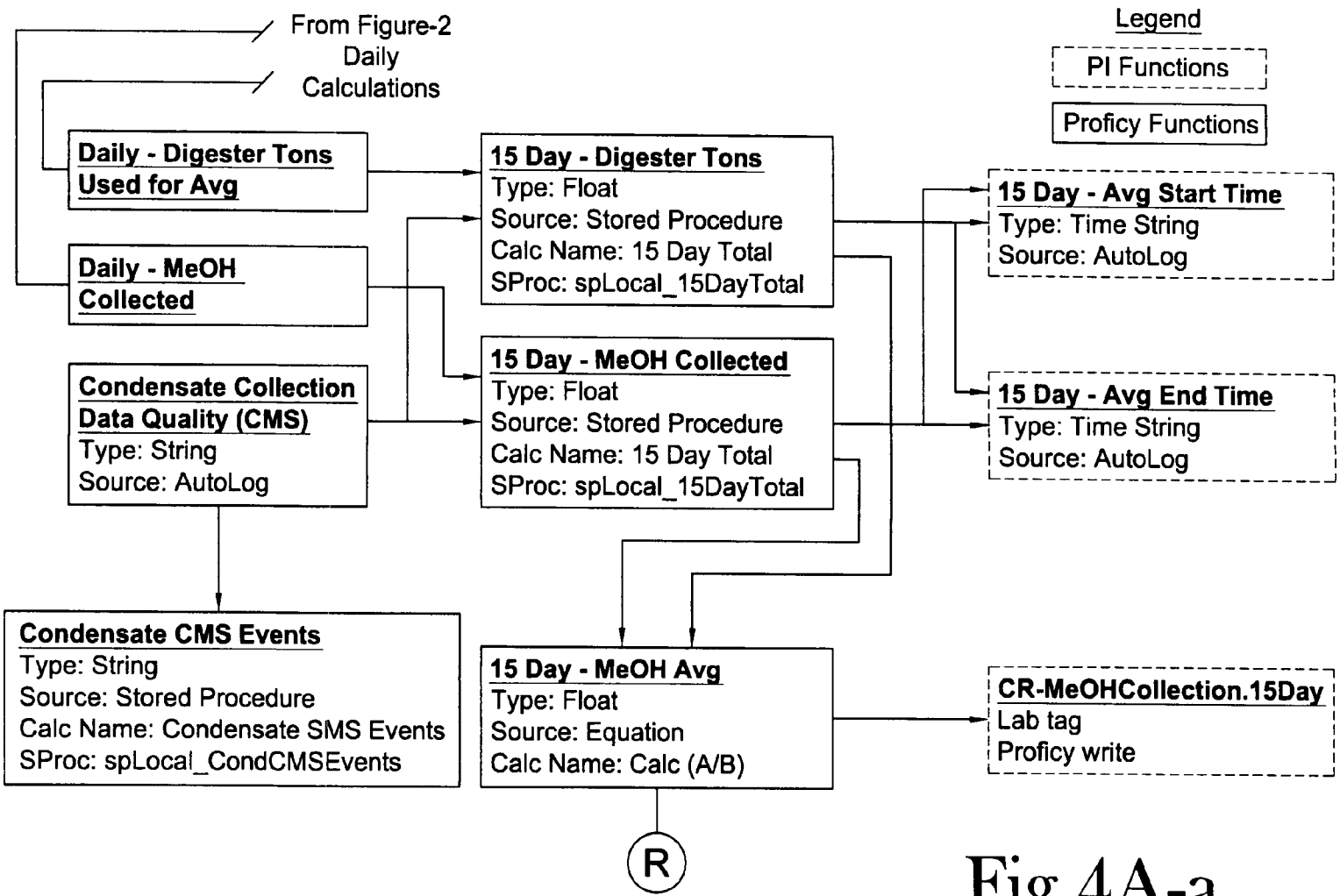
Fig. 4A-a

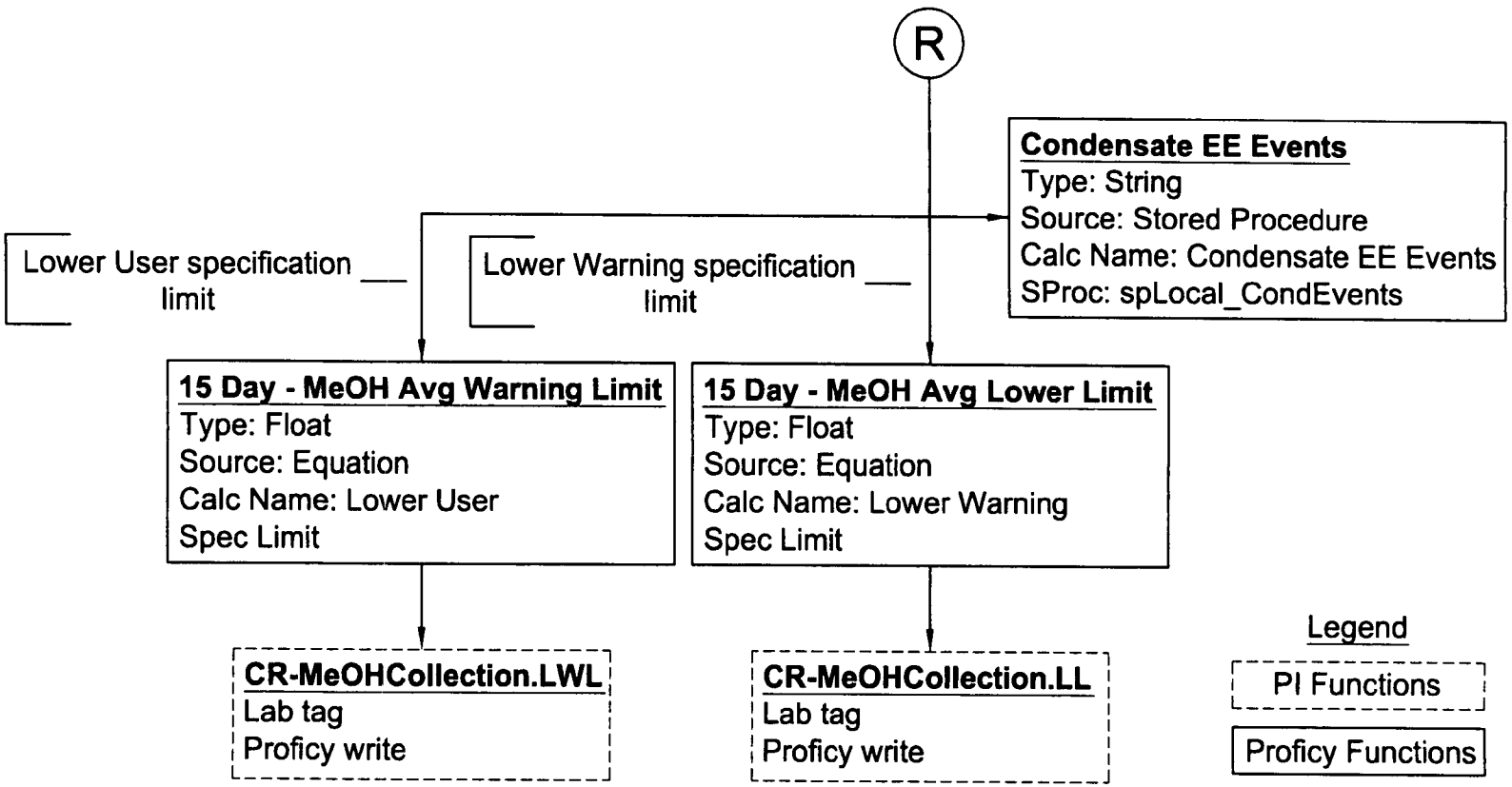
Fig. 4A-b

ENVIRONMENTAL MONITORING AND REPORTING SYSTEM

CROSS-REFERENCE TO RELATED APPLICATIONS

This application is a Non-provisional application of Provisional Application Ser. No. 60/344,216 filed Dec. 21, 2001. Priority is claimed based on the aforesaid Provisional application Ser. No. 60/344,216 and based on Ser. No. 10/324,680, filed Dec. 20, 2002.

STATEMENT REGARDING FEDERALLY SPONSORED RESEARCH OR DEVELOPMENT

Not Applicable

FIELD OF INVENTION

This invention relates to monitoring of emissions and/or waste streams from a production facility.

BACKGROUND OF INVENTION

The United States Environmental Protection Agency (EPA), prior to the present invention, has required monitoring and reporting on individual sources of actual or potential undesirable emissions of gaseous matter or liquid matter. These requirements have heretofore been satisfied by "end of the line" monitoring techniques. Heretofore, there has been no known method or system for the environmental monitoring and reporting of a combination of gaseous and liquid emissions from a production facility.

Of recent, the EPA combined air and water regulation applying to the pulp and paper industry, known as the Cluster Rule. This Cluster Rule was developed to minimize and control Hazardous Air Pollutant (HAP) emissions via direct air vents from non-condensable type gas systems (NCG) (referred to in the Rule as Low Volume High Concentration (LVHC) and High Volume Low concentration (HVLC systems), and from volatilization fro HAP bearing liquid streams originating in the pulping and evaporation processes. These liquid streams are produced from the condensation of relief or evaporation vapors in various direct and indirect condensing systems in the aforementioned areas. The Cluster Rule refers to these HAP bearing condensates as "named streams".

The Cluster Rule is unique in the history of the industry as It is the first Rule to require monitoring of significant process parameters in the mill proper, and the first Rule to require the daily/continuous inventory of HAP9 produced in the mill proper. Most regulations look at final emissions on end-of-pipe treatment systems and their respective treatment efficiencies (eq. wastewater treatment basins, steam strippers, recovery boiler electrostatic precipitators etc). The industry was faced for the first time with monitoring AND reporting in-process activity as relates to HAP evolution, in addition to treatment. Many of these process areas were never monitored to this extent in the past and in many cases, no instrumentation was even present to track required parameters. Many new condensate collections systems had to be built with new piping to transport condensates from evaporator and pulping condensers to a main collection tank prior to delivery to one or more treatment devices. Operation parameters in the evaporators such as liquor flow, liquor solids, conductivity, condensate flow, temperature and valve positions along the delivery piping (to confirm actual collection) had to be installed and connected to the mill distributed control system (DCS) and process information (PI) systems. Digester systems required monitoring of chip meter rotation as an Indicator of pulp production, conductivity, condensate flow, temperature and valve position. Many of the Cluster Rule requirements did not provide instruction on the development of the monitoring and tracking systems, only the final goals.

On Apr. 15, 1998 the Environmental Protection Agency (EPA) promulgated the Cluster Rule for the pulp and paper industry. These rules establish the effluent guidelines and standards under the Clean Water Act and the national emission standards for EPA's designated hazardous air pollutants under the Clean Air Act and have a mill-wide effect on the affected International Paper mills.

The Clean Air Act Amendments of 1990 designated certain substances as hazardous air pollutants (HAPs) and required the industry to reduce HAPs using Maximum Achievable Control Technology (MACT) control measures. MACT means the best demonstrated control technology or practices used by similar sources of air toxics, defined by law as the average pollutant reduction achieved by the best-performing 12 percent of mills. The MACT regulation for the pulp and paper mills is codified in 40 CFR Part 63 Subpart S.

The regulation requires pulp and paper mills to control HAPs, using methanol and chlorine as surrogates in the mills' condensate, LVHC/HVLC and bleach plant systems, respectively.

SUMMARY OF THE INVENTION

This invention is directed to a method for the combined monitoring and reporting of actual and potential emissions of multiple phases of matter from a production facility which utilizes and/or generates such multiple phases of matter comprising the steps of:

a. identifying each of the potential sources of emission events of gaseous matter generated within the production facility and desired to be monitored and reported,
b. identifying each of the potential sources of emission events of liquid matter generated within the production facility and desired to be monitored and reported,
c. at each identified potential source of gaseous or liquid emission event, providing means for detecting an emission event occurring at said source and generating an event signal which is representative of a detected emission event of a respective one of gaseous or liquid emission events at said source, said signal being representative of at least the occasion of the emission event, the volumetric extent of the event, the timing of the event, and the location of the event with the production facility,
d. transmitting said event signal from its identified source thereof to at least one central location,
e. generating a further signal representative of an operational phase of the production facility which is associated with each identified potential source of an emission event,
f. transmitting said signal representative of an operational phase of the production facility to said at least one central location,
g. at said central location, monitoring said incoming signals from said sources of emission events and said signals representative of respective associated operational phases of operation of the production facility associated with said sources of emission events, comparing each of said signals from respective ones of said sources of emission events with said signals representative of a respective one or more operational phase of the production facility associated with said source of said emission event to determine the status of the operation of the production facility at the time of said emission event, h. reporting as actual emission events only those emission events which positively correlate with an associated ongoing production phase of the production facility at the time of the reported emission event.

BRIEF DESCRIPTION OF THE DRAWINGS

FIG. 1A is a flow diagram of Condensate PTE and Daily Uptime Data Flow.

FIG. 1D-*a* is a flow diagram of Scrubber Recirculation Data Flow.

FIG. 1D-*b* is a flow diagram of Scrubber Recirculation Data Flow.

FIG. 2A-*a* is a flow diagram of Daily Condensate Collection & Pulp Production Data Flow.

FIGS. 2A-*b* is Data Flow is a flow diagram of Daily Condensate Collection & Pulp Production.

FIG. 2B is a flow diagram of Destruction Device Treatment Status Data Flow.

FIG. 2C-*a* is a flow diagram of Steam Stripper 92% 3 Hour Avg Excess Emission Event Data Flow.

FIGS. 2C-*b* is a flow diagram of Steam Stripper 92% 3 Hour Avg Excess Emission Event Data Flow.

FIG. 2D-*a* is a flow diagram of Scrubber Fan Data Flow.

FIGS. 2D-*b* is a flow diagram of Scrubber Fan Data Flow.

FIG. 3A-*a* is a flow diagram of Daily Methanol Collection and Pulp Production Data Flow.

FIGS. 3A-*b* is a flow diagram of Daily Methanol Collection and Pulp Production Data Flow.

FIG. 3B is a flow diagram of Vent Data Flow.

FIG. 3C-*a* is a flow diagram of Steam Stripper 92% Overall Bypass EE Events.

FIGS. 3C-*b* is a flow diagram of Steam Stripper 92% Overall Bypass EE Events.

FIG. 4A-*a* is a flow diagram of Daily Condensate Collection & Pulp Production Data Flow.

FIGS. 4A-*b* is a flow diagram of Daily Condensate Collection & Pulp Production Data Flow.

FIG. 4B is a flow diagram of Vent Data Flow with Optional Main Vent Filtering.

DETAILED DESCRIPTION OF THE INVENTION

Figure 1:
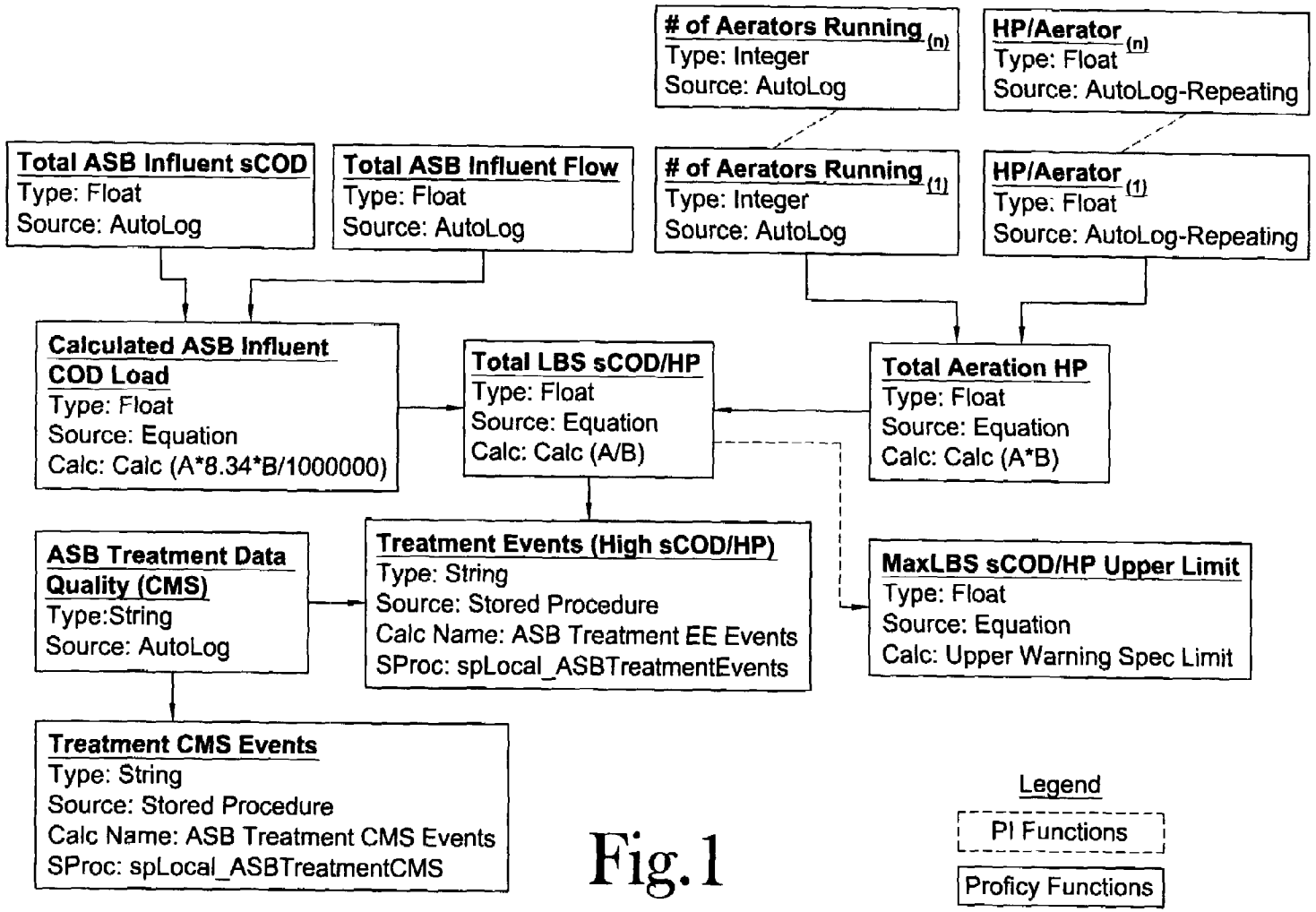
FIG. 1 is a flow diagram of ASB Treatment Data Flow.

This invention relates to an automated monitoring, record keeping and reporting system to comply with the regulation. The project objective is to comply with the requirements of these Cluster Rule components. This document was developed to establish the design specifications and programming methodology for this data collection system.

The purpose of this document is to describe the design of the record keeping and reporting system for condensate treatment using an aerated stabilization basin (ASB). The software is comprised of PI Data Archive software (which is used for automatic data collection from various process instrumentation and control systems) and Proficy software (which monitors and reports compliance based on the PI data and operator inputs). This documentation is directed toward system administrator level personnel but can be used for a basic understanding of how the system works.

The following sections describe the general configuration of the standard biological condensate treatment monitoring system. Deviations from the standard model, configuration listings for specific lines, and mill-specific details are contained within the appendices.

Foul condensate is collected in a central collection tank (Main Tank) from sources such as digesters, evaporators, and turpentine systems. For treatment in a biological system, the condensate is pumped through a hardpipe delivery system discharging below the surface of an aerated stabilization basin (ASB) (or some other device such as a UNOX system). In most cases, the flow from the Main Tank mixes with the remaining whole mill influent to create the total ASB influent flow. In a few cases, the total ASB Influent flow is equal to the hardpipe flow if the ASB is a dedicated condensate treatment system that receives no other wastewater. The metric used to determine ASB compliance is the Total ASB Influent soluble Chemical Oxygen Demand (sCOD) load relative to the basin processing capacity based on aeration horsepower (with the units of sCOD lbs/HP). sCOD is defined as the amount of oxygen required to oxidize all soluble compounds, both organic and inorganic, in water. sCOD is expressed in units of mg/l (ppm). Compliance is demonstrated by operating below the limit of sCOD lbs/HP determined in a Performance Test. Other measurements of ASB Influent Load such as to Total Organic Carbon (TOC) can be used in place of sCOD. (Specified as the alternative method in §63.463(j)2)

When the ASB treatment performance metric falls below the limit set in the performance test, the mill will respond in accordance with the SSM Plan and may retest to show compliance at this new parameter range with the result that no excess emission event occurred. (§63.453(p)) The monitoring system logs the potential Excess Emission (EE) event and corresponding operator responses to the event. The responses record the operator determined Trouble, Cause, Correction (response), and Report Code (report categorization) for the event. The report categorization specifies if the event is considered an allowable excess emission if the emission is due to a Startup, Shutdown, or Malfunction (SSM). The events are compiled by the system and reported to the state regulatory agency on a semi-annual basis or more frequently as required (§63.10).

For mills following this ASB Treatment methodology, a warning limit is attached to the 15 Day—MeOH Avg variable to warn the operator that MeOH collection is close to falling below the excess emission limit for condensate collection. If the methanol load remains lower than that collected and treated during the initial performance test, the facility may be required to raise the ASB efficiency (by lowering the sCOD lbs/HP target) following a required quarterly retest unless the methanol collection can be restored to original collection levels. The warning limit is specific to the mill based upon the biological treatment efficiency of the ASB at the sCOD lbs/HP upper limit for the ASB system. The value of the warning limit is calculated from the minimum $f_{bio}$ (fraction bio-degraded) that correlates to the sCOD lbs/HP upper limit, determined during a performance test; the limit is set to $11.1/f_{bio}$ for bleached mills and $7.2/f_{bio}$ for non-bleached mills. This warning notifies the operator to inspect and troubleshoot the condensate closed collection and treatment systems to insure compliance during the next quarterly performance test. Therefore the lower warning flag on collection may not result in an immediate excess emission for collection or treatment as long as the ASB continues to meet its initial performance test sCOD lbs/HP target. However if methanol collection levels are not restored by the quarterly test, excess emissions could be recorded indefinitely (on a daily basis) until the ASB efficiency is increased or collection restored. (§63.446(e) & (p))

In addition to capturing and categorizing EE events, the monitoring system also captures and records failures (downtime) of the Continuous Monitoring System (CMS). All Condensate Treatment ASB CMS events are manually triggered and are 24 hours in duration. This event is summarized and reported to the state in a semi-annual CMS performance report or more frequently as required. The report categorization specifies if the event is considered allowable based on the specific regulations. (§63.8(c)2, §63.8(c)8 and §63.10)

In addition to monitoring and recording the above, the monitoring system records and displays operating parameters (on the ASB Treatment Autolog) to insure that the ASB is running under normal operating conditions. These operating parameters are used with specification limits applied to notify the operator (through color coding) to take whatever action is necessary to restore the ASB to normal operating conditions. The parameters are used for display only and do not create any events. The sample location for the operating parameters will vary by mill, but the standard operating parameters for all ASB's are; sCOD, dissolved oxygen (DO), dissolved oxygen uptake rate (DOUR), mixed liquor suspended solids (MLVSS), and specific oxygen uptake rate (SOUR).

The Total Influent Load to the ASB is monitored in three ways:

1) A sCOD lbs/day alarm (upper user specification limit displayed on the autolog), when the maximum sCOD lbs/day design capacity of the ASB system is exceeded, indicating a possible process malfunction.
2) A sCOD lbs/HP alarm (upper user specification limit displayed on the autolog), when the ratio of the total sCOD pounds per day to total aeration horsepower per day (sCOD lbs/HP) is 90% of the limit, indicating the operator should increase aeration horsepower or decrease influent load.
3) A sCOD lbs/HP event (upper warning specification limit displayed on the autolog and the event is created on the downtime display), when the sCOD lbs/HP exceeds the limit established in a performance test, indicating a potential Excess Emission (EE) event.

The sCOD load is calculated by multiplying the total daily ASB influent (Gals) by the sCOD (ppm) with appropriate factors to convert the result into lbs/day delivered to the ASB. Aerator horsepower is the product of an aerator horsepower factor (a mill may have several different factors if they maintain different types of aerators) and the number of aerators of each type in service. Both Total ASB Influent flow and sCOD may require multiple calculations to first determine the contribution of the hardpipe and whole mill influent. The total sCOD (lbs/day) inlet load is divided by the total aerator horsepower (HP/day) to determine the sCOD lbs/HP for the day, or:

$$sCOD(\text{lbs}/HP) = \frac{ASB\ \text{Influent Flow}\ (gpm) * sCOD(ppm) * 8.35(\text{lbs/gal}) * 1440(\text{min/day})}{((HP_1 * \#Aerators_1) + (HP_2 * \#Aerators_2) + \ldots + (HP_n * \#Aerators_n)) * 1{,}000{,}000}.$$

Proficy calculates the total sCOD lbs/day, the total aerator HP/day, and the sCOD lbs/HP ratio once an operator manually enters the type and number of aerators (and/or blower systems) running, a daily sCOD test(s), and the Total ASB Influent Flow (note: at certain mills Total ASB Influent flow may be automatically entered from PI as the sum of the whole mill influent and hard pipe flows). The parameters required to calculate sCOD lbs/day are the Continuous Monitoring System (CMS) parameters for ASB treatment.

Proficy compares the sCOD lbs/HP against a upper specification warning limit established during a Performance Test to determine if a potential EE event has occurred. The duration of a potential EE event is 24 hours. Performance Tests, conducted quarterly, relate the sCOD lbs/HP ratio to a minimum required ASB MeOH removal efficiency ($f_{bio}$). A sCOD lbs/HP value greater than the warning limit indicates the ASB is outside of the operating range established during the Performance Test. This indicates that the ASB is potentially overloaded and the ASB removal efficiency may be less than required for compliance.

When the potential EE event is created, the mill must respond in accordance with the SSM Plan and may retest to show compliance at this new parameter range with the result that no excess emission event occurred. The Proficy software logs the potential EE event and corresponding operator responses to the event. The responses record the operator determined Trouble, Cause, Correction (response), and Report Code (report categorization) for the event. The report categorization specifies if the event is considered an allowable excess emission if the emission is due to a Startup, Shutdown, or Malfunction (SSM). A comment is required to be entered in Proficy whenever a potential EE event occurs.[1] The events are compiled by the system and reported to the state regulatory agency on a semi-annual basis or more frequently as required.

[1] This is accomplished by forcing an operator to enter comment on the Trouble reason code in the Proficy downtime event.

For mills following this ASB Treatment methodology, a warning limit (the Proficy lower user specification limit) is attached to the 15 Day—MeOH Avg variable to warn the operator that MeOH collection is close to falling below the excess emission limit (the Proficy lower warning specification limit) for condensate collection. If the methanol load remains lower than that collected and treated during the initial performance test, the facility may be required to raise the ASB efficiency (by lowering the sCOD lbs/HP target) following a required quarterly retest unless the methanol collection can be restored to original collection levels. The Proficy lower user specification limit is specific to the mill based upon the biological treatment efficiency of the ASB at the sCOD lbs/HP upper limit in Proficy for the ASB system. The value of the warning limit (Proficy lower user specification limit) is calculated from the minimum $f_{bio}$ (fraction bio-degraded) that correlates to the sCOD lbs/HP upper limit, determined during a performance test; the limit is set to $11.1/f_{bio}$ for bleached mills and $7.2/f_{bio}$ for non-bleached mills. This warning notifies the operator to inspect and troubleshoot the condensate closed collection and treatment systems to insure compliance during the next quarterly performance test. Therefore the lower warning flag on collection may not result in an immediate excess emission for collection or treatment as long as the ASB continues to meet its initial performance test sCOD lbs/HP target. However if methanol collection levels are not restored by the quarterly test, excess emissions could be recorded indefinitely (on a daily basis) until the ASB efficiency is increased or collection restored.

In addition to capturing and categorizing events, the Proficy system also captures and records failures (downtime) of the Continuous Monitoring System (CMS). All Condensate Treatment ASB CMS events are manually triggered and are 24 hours in duration. This event is summarized and reported to the state in a semi-annual CMS performance report or more frequently as required. The report categorization specifies if the event is considered allowable based on the specific regulations.

In addition to monitoring and recording the above, Proficy records and displays operating parameters (on the ASB Treatment Autolog) to insure that the ASB is running under normal operating conditions. These operating parameters are used with specification limits applied to notify the operator (through color coding) to take whatever action is necessary to restore the ASB to normal operating conditions. The parameters are used for display only and do not create any events. The sample location for the operating parameters will vary by mill, but the standard operating parameters for all ASB's are; sCOD, dissolved oxygen (DO), dissolved oxygen uptake rate (DOUR), mixed liquor suspended solids (MLVSS), and specific oxygen uptake rate (SOUR).

Table-1 gives the process inputs typically required for ASB systems, their engineering units, data source, and corresponding Proficy variable names.

TABLE 1

Input Variables

| Production Unit/Group | Proficy Variable | Eng Units | Data Source | Description |
|---|---|---|---|---|
| Treatment Variables | Total ASB Influent sCOD | ppm | Manual entry | Daily COD influent from lab analysis. More than one input may be required. |
| Treatment Variables | Total ASB Influent Flow | Gals/day | Manual entry or PI | Influent flow daily total. More than one input may be required. |
| Treatment Variables | # Of Aerators Running | | Manual entry | Number of aerators in operation (for each aerator type). |
| Treatment Variables | HP/Aerator | HP | Manual entry | Factor for power delivered per aerator (for each aerator type). |
| Treatment CMS | ASB Treatment Data Quality (CMS) | | Manual entry | Manual treatment CMS event trigger. A menu choice allows the selection of a 24 hour CMS event or to indicate that the condensate system was Shutdown. |
| Operating Parameters | Basin Temperature | Deg F. | Manual entry or PI | Basin temperature |
| Operating Parameters | Minimum % Treatment | % | Manual entry | Minimum required treatment percentage ($f_{bio}$) - Correlates to sCOD/HP maximum established during a performance test |
| Operating Parameters | ASB sCOD | ppm | Manual entry | sCOD in the ASB |
| Operating Parameters | ASB DO | % | Manual entry | Dissolved O2 (DO) in the ASB |
| Operating Parameters | ASB DOUR | mg/l/hr | Manual entry | Dissolved O2 Uptake (DOUR) Rate in the ASB |
| Operating Parameters | ASB MLVSS | mg/l | Manual entry | Mixed Liquor Volatile Suspended Solids (MLVSS) in the ASB |

The percent treatment minimum limit (Minimum % Treatment) reflects the $f_{bio}$ (fraction bio-degraded) that correlates to the maximum sCOD lbs/HP ratio (Total LB COD/HP) that was measured during any performance test (initial or quarterly). This maximum ratio (displayed on the Max sCOD lbs/HP Upper Limit Autolog variable) is the Proficy upper warning specification limit attached to the variable Total sCOD lbs/HP (see table 2 below).

Additionally each mill may define mill specific operating variables to be monitored in addition to those specified above. User Specification limits for the operating parameters are listed in the specification limits table in Section V. Table-2 lists typical calculated variables for the system and a brief description of each.

TABLE 2

| Calculated Variables | | | |
|---|---|---|---|
| Production Unit | Proficy Variable | Eng Units | Description |
| Treatment Variables | Calculated ASB Influent sCOD Load | sCOD lbs/day | Daily calculated sCOD load. |
| Treatment Variables | Total Aeration HP | HP/day | Total aeration horsepower per day. |
| Treatment Variables | Total sCOD lbs/HP | sCOD lbs/HP | Total sCOD per aeration horsepower. The value changes color when it exceeds a warning level (Proficy upper user limit) and a potential EE event level (Proficy upper warning limit) |
| Treatment Variables | Max LBS sCOD lbs/HP Upper Limit (Display Only) | sCOD lbs/HP | Upper warning limit that triggers a potential EE event for the High sCOD/HP load. This variable is for display only and the value is updated via the Proficy administrator specification entry tool on the variable Total sCOD lbs/HP. |
| High sCOD/HP Potential EE | Treatment Events (High sCOD/HP) | Status | Displays a potential EE event (24-hr) whenever the Total sCOD lbs/HP exceeds its upper warning specification limit, representing the maximum sCOD lbs/HP load. |
| Treatment CMS | Treatment CMS Events | Status | Displays a CMS 24-hr CMS downtime event whenever the ASB Treatment Data Quality (CMS) variable selection is used to create the manual CMS event. |
| Operating Parameters | ASB SOUR | mg/ gVSS/hr | Specific O2 Uptake Rate (SOUR). Triggers a visible warning when the calculation falls below the configured lower user limit attached to it. |
| Reporting Unit | Run Time | Min | The daily running minutes of the Condensate Collection system. |

The ASB Treatment Data Flow is depicted in FIG. 1. A detailed description of the flow is as follows:

1) ASB Run State and PTE

The ASB basin is considered to be running anytime that the Condensate Collection system is operating. Consequently the ASB potential to emit status (PTE status) is equivalent to the Condensate Collection potential to emit. Whenever the Condensate Collection system is shutdown for a majority of the day (>80% of the potential runtime or 4.8 hours in a 24 hour period) the ASB is also considered shutdown. See the section below (Condensate System Shutdown) for a detailed explanation of how this is indicated within the system.

The total reporting minutes of ASB operation, reported to the appropriate regulatory authority on a semi-annual or more frequent basis as required, correspond to the total source operating minutes of the Condensate Collection system.

2) sCOD Load

The whole mill influent flow and hard pipe flow (if separate streams exist) going into the ASB are sampled and analyzed daily for sCOD. The sCOD load (Calculated ASB Influent sCOD Load) is the sum of the two streams' sCODs (Total ASB Influent sCOD) multiplied by their daily total flows (Total ASB Influent Flow). Some mills have two sCOD loading (one from condensate sources and one from mill influent sources) implying that the Calculated ASB Influent sCOD Load will be the sum of the products of the sCOD and flows from each source for the day.

3) Total Aeration Horsepower

A separate mill-specific Autolog will be designed to calculate the total aeration horsepower, Total Aeration HP.[2] For each type of aerator, the number of aerators in operation will be multiplied by their respective horsepower to calculate the total horsepower for that specific aerator type. The total horsepower's for all types of aerators in operation are then summed to calculate the total aeration horsepower (Total Aeration HP).

[2] At some mills this will be directly incorporated into the main ASB autolog sheet.

4) COD Load per Aerator Horsepower

This value (Total sCOD lbs/HP) is an estimate of the sCOD load relative to the processing capacity of the basin and is calculated by dividing the ASB influent sCOD load (Calculated ASB Influent sCOD Load) by the total aeration horsepower (Total Aeration HP).

5) ASB Treatment EE Events

An excess emission event is generated under the following conditions:

- the value of Total sCOD lbs/HP is greater than its configured upper warning specification limit (i.e., a high value), and
- the value of the ASB Treatment Data Quality (CMS) is not "Bad Data—24-Hr CMS" and not "Shutdown."

If an event is created and the ASB Treatment Data Quality (CMS) variable is subsequently changed (to either "Bad Data—24-Hr CMS" or "Shutdown") the recorded event remains in the system and must be answered appropriately.

If the mill SSM plan allows for retesting of the ASB at the higher sCOD lbs/HP ratio and the testing of the ASB determines that the sCOD lbs/HP ratio resulted in maintaining the removal efficiency, the mill may report the event as No Excess Emission.

If the parameter value is exceeded and the SSM plan allows for it, the mill may chose to run a performance test to show compliance at this new parameter range. If the removal efficiency was maintained the event may be reported as No Excess Emission. A comment in Proficy is required whenever this condition occurs. All ASB Treatment EE events are 24-hours in duration.

6) ASB Treatment CMS Events

A reportable 24-hour CMS downtime event is created whenever the operator or environmental contact chooses the "Bad Data—24-Hr CMS" selection on the pull-down menu of the ASB Treatment Data Quality (CMS) variable. Manually selecting this option results in the creation of a 24-hour CMS event. A 24-hour CMS event results whenever one of the following parameters (required to determine sCOD lbs/HP) cannot be determined for the day:

Total ASB Influent Flow (gals),

Total ASB Influent sCOD (ppm),

Number and Type of Aerators Running.

All ASB Treatment CMS events are 24-hours in duration.

7) Condensate System Shutdown

Whenever the condensate system has been shutdown for greater than 80% of the day the operator or environmental contact should indicate the shutdown by selecting the "Shutdown" selection from the ASB Treatment Data Quality (CMS) variable.

Guidelines for Use of Manual Pull-Down Selections

| Running Condition | Appropriate Action |
|---|---|
| >20% of daily runtime | Enter manual values and the calculations will complete. |
| <20% runtime (4.8 hours or 288 min.) over the production day | Select "Shutdown" |
| No method to determine aerators running, Bad or missing flows with no approved alternate method of manually entering the values | Select "Bad Data - 24 Hrs CMS" |

8) Specific O2 Uptake Rate

The Specific Oxygen Uptake Rate (SOUR), also known as the oxygen consumption or respiration rate, is defined as the milligram of oxygen consumed per gram of volatile suspended solids per hour. The value is computed by dividing the Dissolved Oxygen Uptake Rate ([mg/l]/hr) by the Mixed Liquor Volatile Suspended Solids (mg/l) and then multiplied by 1000 (1000 mg/1 g) yielding the units of [mg/g]/hr.

Standard PI Model

Typically, all inputs to the standard ASB treatment model are manual entries (with the possible exception of the ASB inlet flow); therefore PI tags are not required.

Standard Proficy Model

The Proficy model consists of input variables, calculated variables, stored procedures, and Visual Basic scripts (VB scripts). Variables and associated parameters for a typical ASB treatment plant and descriptions of the stored procedures and the VB scripts are included below. Complete listings of the Stored Procedures can be found in following Table 3 herein below.

TABLE 3

Proficy Input Variables

| Variable Description | Data Source | Eng Units | Event Type | Data Type | Sampling Interval | Sampling Offset[3] | Precision |
|---|---|---|---|---|---|---|---|
| Total ASB Influent COD | AutoLog | ppm | Time | Float | 1440 | 330 | 0 |
| Total ASB Influent Flow | AutoLog | Gals | Time | Float | 1440 | 330 | 0 |
| # of Aerators Running | AutoLog | | Time | Integer | 1440 | 330 | |
| HP/Aerator | AutoLog | HP | Time | Float | 1440 | 330 | 1 |
| ASB Treatment Data Quality (CMS) | AutoLog | | Time | Data Quality | 1440 | 330 | |
| Basin Temperature (F.) | AutoLog | Deg F | Time | Float | 1440 | 330 | 1 |
| Minimum %-Treatment | AutoLog | % | Time | Float | 1440 | 330 | 1 |
| Minimum Dissolved O2 | AutoLog | % | Time | Float | 1440 | 330 | 1 |
| Dissolved O2 Uptake Rate | AutoLog | [mg/g]/hr | Time | Float | 1440 | 330 | 1 |
| Mixed Liquor Volatile Suspended Solids | AutoLog | mg/l | Time | Float | 1440 | 330 | 1 |

[3]The sampling offset is determined by the mill-specific start of day time. The offset value is the number of minutes from midnight to the mill start of day.

Specification Limits

Proficy has upper and lower specification limits that can be defined for every variable: entry limits, user limits, warning limits, and reject limits. The following descriptions define how Proficy uses these limits to trigger events and inform operators of impending events:

TABLE 4

Proficy Input Variables

| Variable Description | Eng Units | Event Type | Data Type | Sampling Interval | Sampling Offset[4] | Precision | Calc Type | Calc Name |
|---|---|---|---|---|---|---|---|---|
| Calculated ASB Influent COD Load | lbs COD | Time | Float | 1440 | 330 | 0 | Equation | Calc (A * 8.34 * B/1000000) |
| Total Aeration HP | HP | Time | Float | 1440 | 330 | 0 | Equation | Calc (A * B) |
| Total LBS COD/HP | lbs COD/HP | Time | Float | 1440 | 330 | 1 | Equation | Calc (A/B) |
| Max LBS COD/HP Upper Limit | lbs COD/HP | Time | Float | 1440 | 330 | 1 | Equation | Upper Warning Spec Limit |
| Treatment Events (High-High COD/HP) | Status | Time | String | 1440 | 330 | 1 | Stored Procedure | ASB Treatment EE Events |
| Treatment CMS Events | Status | Time | String | 1440 | 330 | | Stored Procedure | ASB Treatment CMS Events |
| Specific O2 Uptake Rate | [Mg/hr] | Time | Float | 1440 | 330 | 1 | Equation | ASB Treatment |

[4]The sampling offset is determined by the mill-specific start of day time. The offset value is the number of minutes from midnight to the mill start of day.

User Limits

Provides a visible warning that event trigger points are being approached by changing the font color of the variable on an Autolog sheet Warning Limits Trigger level for EE events Reject Limits Trigger level for CMS events or data quality limits Entry Limits Restricts the range of valid numerical entries used for a manual entry variable.

9) Proficy Variables and Specification Limits

All manually entered operating parameters have Upper and Lower Entry specification limits.

Calculations

ASB Treatment EE Events

Type: Stored Procedure—spLocal_ASBTreatmentEvents

This procedure reads the value of the dependent variable (Total LBS COD/HP) and compares it to the variable's upper warning specification limit, as specified in the calculation inputs. If this value is outside of the upper warning specification limit, then a 24-hr downtime event is created (appended if a contiguous event exists) on the variable's unit. Some mill systems may elect to specify warning limits (Lower Warning-LW and/or Upper Warning-UW) to provide operators with a visual indication on the Autolog sheet that the upper limit is being approached.

ASB Treatment CMS Events

Type: Stored Procedure—spLocal_ASBTreatmentCMS

This stored procedure creates a 24-hour downtime event that is triggered by a manual input from the operator (via ASB Treatment Data Quality (CMS)) which is configured as the dependent variable).

Calc (A*8.34*B/1000000)

TABLE 5

| Variable Name | Specification Limit | Use |
|---|---|---|
| Total sCOD lbs/HP | Upper User | Color coded Autolog warning that the Max COD/HP load is being approached |
| | Upper Warning | Maximum COD/HP ratio determined during a performance test. Triggers a 24 hour potential EE event |
| ASB sCOD | Upper User | Color coded Autolog warning that sCOD is above normal conditions |
| ASB DO | Lower User | Color coded Autolog warning that DO is below normal conditions |
| ASB DOUR | Lower User | Color coded Autolog warning that DOUR is below normal conditions |
| ASB MLVSS | Lower User | Color coded Autolog warning that MLVSS is below normal conditions |
| ASB SOUR (Specific O2 Uptake Rate) | Lower User | Color coded Autolog warning that the SOUR is dropping below normal operating conditions |

Type: Equation
Calculates the value of Calculated ASB Influent COD Load from Total ASB Influent COD (input-A in ppm) and the Total ASB Influent Flow (input-B in Gals).
Upper Warning Spec Limit Type: Equation
Returns the upper warning specification limit for a designated variable. This calculation is used to display the limit for Total LBS COD/HP.
Calc (A/B)

Type: Equation
Returns the quotient of the two inputs, A and B.
Calc (A*B)

Type: Equation
Returns the product of the two inputs, A and B.

Calc (A/B*1000)

Type: Equation
Calculates the value of the Specific O2 Uptake Rate (SOUR) by dividing the Dissolved Oxygen Uptake Rate (input-A in mg/l/hr) by the Mixed Liquor Volatile Suspended Solids (input-B in mg/l) and then multiplies by 1000 (1000 mg/g) to compute the SOUR in [mg/g]/hr.

Stored Procedure Listings spLocal_ASBTreatmentEvents

/*

Procedure Name: spLocal_ASBTreatmentEvents
Copyright (C) 2001, International Paper Company
Process Management Application Group General Description:
This procedure reads the value of the dependent variable and compares it to the variable's designated specification limit (LR,LW,UW,UR). If this value is outside the limit and the data quality flag < > 'Shutdown' and < > 'Bad Data 24 Hr CMS, then a 24-hr downtime event is created (or appended if a contiguous event exists) on this variables PU.

Triggers:
1. Calculation Manager: Time (based on sample interval for variable).
2. Dependent variable value changes.

Inputs and Depedencies:
1. Inputs described in body of code.
2. Dependent variable—Value to be tested (e.g., 15-day MeOH Lb/ODTP)

Outputs:
Type: Status message (string)

| Value | Occures when . . . |
|---|---|
| "Later Event" | An event exists with a later timestamp |
| "No Dep Var" | The dependant variable is not configured. |
| "No Reject" | The Reject_Limit input constant is not configured ("LR","LW","UW" or "UR"). |
| "Incorrect Reject" | The Reject_Limit input constant is configured but is incorrect (not "LR","LW","UW" or "UR"). |
| "Bad Limit" | The retrieved specification limit is NULL. |
| "No Value" | The dependant variable value is NULL. |
| "Event Created" | The test failed and a downtime event was created. |
| "Shutdown" | The data quality flag is set to 'Shutdown' |
| "Bad Data" | The data quality flag is set to 'Bad Data - 24Hr CMS' |

Variables:
1. Described in body of code.

Tables Modified:
1. Timed_Event_Details

```
*/
CREATE PROCEDURE dbo.spLocal_ASBTreatmentEvents
@OutputValue varchar(50) OUTPUT,        --Ouput (not used).
@Var_Id int,                            --This variables Var_Id.
@PU_Id int,                             --This variables Unit Id.
@Timestamp datetime,                    --Timestamp for this variable's data
value.
@Reject_Limit varchar(2),               --Specification limit applied in test
        --(valid values: "LR","LW","UW" or "UR")
@Data_Quality varchar(50)               --Value of data quality flag
AS
Declare
```

-continued

```
@DepVar__Id int,                        --Variable Id of the dependent variable (the value to be
                                        tested).
@Applied__Prod__Id int,                 --Product Id from which spec limits are retrieved.
@Prod__Id int,                          --Product Id from which spec limits are retrieved.
@RejectVal varchar(30),                 --Lower warning spec limit value for the dependent
                                        variable.
@Value varchar(30),                     --Value to be tested against LW spec limit.
@StatusId int,                          --Not used
@FaultId int,                           --Not used
@Reason1 int,                           --Used to retain reason if event is appended.
@Reason2 int,                           --Used to retain reason if event is appended.
@Reason3 int,                           --Used to retain reason if event is appended.
@Reason4 int,                           --Used to retain reason if event is appended.
@ProductionRate float,                  --Must be specified for event creation (= 0.0 in this
                                        procedure).
@Duration float,                        --Must be specified for event creation (= 0.0 in this
procedure).
@Transaction__Type int,                 --(1=Add, 2=Update, 3=Delete, 4=Close).
@EventStartTime datetime,               --Start time for new downtime event.
@TEDet__Id int,                         --Downtime event Id for existing event.
@@Start__Time datetime,                 --Start time for the downtime event if appended.
@@End__Time datetime,                   --End time for an event for the previous interval if it
                                        exists.
@TEFault__Id int,                       --Fault Id from fault translation table.
@Outside__Limit int,                    --Indicates that the dependant variable value is outside of
                                        --the specification limits
@Count int,                             --Number of events with timestamps later than the --
                                        timestamp for
                                        --this interval.
@CurrentValue Varchar(50)               --Value of this variable at this time.
                                        --Get the current value of this variable (i.e., the message)
Select @CurrentValue=Result from Tests
    where Var__Id=@Var__Id and Result On=@Timestamp
Set @OutputValue=@CurrentValue
                                        --Initialize variables
Select @ProductionRate = 0.0
Select @Duration = 0.0
                                        --Get variable ID of the dependent variable (this is the
                                        value to be tested).
Select @DepVar__Id = Var__Id
    From Calculation__Instance__Dependencies
    Where Result__Var__Id = @Var__Id
                                        --If the dependent variable is not configured, then return
If(@DepVar__Id is Null)
    Begin
        Set @OutputValue='No Dep Var'
        Return
    End
                                        --Validate Configured Reject Limit Constant
if @Reject__Limit = NULL or @Reject__Limit = ''
    begin
        Set @OutputValue = 'No Reject'
        Return
    end
                                        --Get the product id in order to retrieve the specification
                                        values.
Select @Applied__Prod__Id = Applied__Product
    From events where pu__id = @PU__Id and timestamp = @Timestamp
if @Applied__Prod__Id is NULL
    Begin
        select @Prod__Id = Prod__Id
        from production__starts
        where pu__id = @pu__id and
        Start__Time <= @Timestamp and ((End__Time > @Timestamp) or (End__Time Is Null))
    End
Else
    Begin
        select @Prod__Id = @Applied__Prod__Id
    End
Set @RejectVal = NULL
if @Reject__Limit ='LR'
            Select @RejectVal = L__Reject
                from var__specs
                where var__id = @DepVar__Id and
        prod__id = @prod__id and
        Effective__Date <= @Timestamp and
        ((Expiration__Date > @Timestamp) or (Expiration__Date Is Null))
Else
if @Reject__Limit = 'LW'
```

-continued

```
                Select @RejectVal = L__Warning
                    from var__specs
                    where var__id = @DepVar__Id and
            prod__id = @prod__id and
            Effective__Date <= @Timestamp and
            ((Expiration__Date > @Timestamp) or (Expiration__Date Is Null))
Else
if @Reject__Limit = 'UW'
                Select @RejectVal =U__Warning
                    from var__specs
                    where var__id = @DepVar__Id and
            prod__id = @prod__id and
            Effective__Date <= @Timestamp and
            ((Expiration__Date > @Timestamp) or (Expiration__Date Is Null))
Else
if @Reject__Limit = 'UR'
                Select @RejectVal = U__Reject
                    from var__specs
                    where var__id = @DepVar__Id and
            prod__id = @prod__id and
            Effective__Date <= @Timestamp and
            ((Expiration__Date > @Timestamp) or (Expiration__Date Is Null))
Else
    begin
        Set @OutputValue = 'Incorrect Reject'
        Return
    end
                                        --Validate specification limit value
If @RejectVal is NULL or @RejectVal=''
    Begin
        Set @OutputValue='Bad Limit'
        Return
    End
                                        --Get the value of the dependent variable at this
                                        timestamp
Select @Value = Result
    From Tests Where Var__Id = @DepVar__Id and Result__On = @Timestamp
                                        --If the dependent variable value is NULL then return
If @Value is Null
    Begin
        Set @OutputValue='No Value'
        Return
    End
                                        --Set the start time of the event to be created to 24-hrs
                                        ago.
Select @EventStartTime = DateAdd(dd,-1,@Timestamp)
                                        --Check the data quality flag. Return if'Shutdown' or
                                        'Bad Data - 24Hr CMS'
If @Data__Quality = 'Shutdown'
    Begin
        Set @OutputValue='Shutdown'
        Return
    End
If @Data__Quality = 'Bad Data - 24Hr CMS'
    Begin
        Set @OutputValue='Bad Data'
        Return
    End
Set @Outside__Limit = 0
                                        --Compare the value of the dependant variable to the
                                        specification limit and set flag
                                        --"@Outside__Limit" if the value is out of limit
If @Reject__Limit = 'LR' or @Reject__Limit='LW'
begin
                if Convert(float,@Value) <= Convert(float,@RejectVal)
                    Set @Outside__Limit = 1
end
If @Reject__Limit = 'UW' or @Reject__Limit='UR'
begin
                if Convert(float,@Value) >= Convert(float,@RejectVal)
                    Set @Outside__Limit = 1
end
                                        --If the value of the dependent variable is outside the
                                        limit and
                                        --an event does not exist for the previous interval, then
                                        create a new one or
                                        --append to the event for the previous interval. The value
                                        of the Data Quality
                                        --variable must also be NULL.
```

-continued

```
If @Outside__Limit = 1 AND @Data__Quality IS NULL
    Begin
                                        --Find all events for this PU that begin or end later than
                                        the timestamp for this variable
        Select @Count = Count(*)
            From Timed__Event__Details
            Where pu__id = @pu__id and ((Start__Time >= @Timestamp) or (End__Time >= @Timestamp))
                                        --Return if there exists an event later than the timestamp
                                        of this variable
        If Convert(float,@Count) > 0.0
            Begin
                If @CurrentValue <> 'Event Created'
                    Set @OutputValue='Later Event'
            Return
        End
    Select @TEDet__Id = TEDet__Id,@@Start__Time = Start__Time,@@End__Time =
End__Time,@Reason1=Reason__Level1,@Reason2=Reason__Level2,@Reason3=Reason__Level3,@Reason
4=Reason__Level4,@TEFault__Id=TEFault__Id
    From timed__event__details
    Where pu__id = @Pu__Id and Start__time <= @EventStartTime and ((End__Time >= @EventStartTime)
or (End__Time is Null))
    If @TEDet__Id is NULL
        Begin
            Select 5, @PU__Id
@PU__Id,NULL,NULL,NULL,NULL,NULL,NULL,@ProductionRate,@Duration,1,@EventStartTime,N
ULL,0
            Select 5, @PU__Id,
@PU__Id,NULL,NULL,NULL,NULL,NULL,NULL,@ProductionRate,@Duration,4,NULL,@Timestamp
,0
        End
    Else
        Begin
            Select 5, @PU__Id,
@PU__Id,NULL,@TEFault__Id,@Reason1,@Reason2,@Reason3,@Reason4,NULL,NULL,2,@@Start__T
ime,@Timestamp,@TEDet__Id
            End
        Set @OutputValue='Event Created'
    End
Else
    Set @OutputValue='No Event'
TEDet__Id
*/
```

spLocal_ASBTreatmentCMS

/*

Procedure Name: spLocal_ASBTreatmentCMS

Copyright (C) 2001, International Paper Company

Process Management Application Group

Revision History:

General Description:

This stored procedure creates a 24-hour downtime event triggered by a manual input from the operator.

Triggers:

1. Calculation Manager: Time (based on sample interval for variable).
2. Dependent variable value changes.

Inputs and Depedencies:

1. Inputs described in body of code.
2. Dependent variable—Manual treatment CMS event trigger Outputs:

Type: Status message (string)

| Value | Occures when . . . |
|---|---|
| "Later Event" | An event exists with a later timestamp |
| "No Dep Var" | The dependant variable is not configured. |
| "Event Created" | A downtime event was created or Appended. |
| "No Event" | An event was not created. |

Variables:

1. Described in body of code.

Tables Modified:

1. Timed_Event_Details

```
*/
CREATE PROCEDURE dbo.spLocal__ASBTreatmentCMS
@OutputValue varchar(50) OUTPUT,        --Ouput (not used).
@Var__Id int,                           --This variables Var__Id.
@PU__Id int,                            --This variables Unit Id.
@Timestamp datetime                     --Timestamp for this variable's data value.
AS
```

-continued

```
Declare
@DepVar__Id int,                        --Variable Id of the dependent variable (the
                                        event trigger).
@Value varchar(30),                     --Value of the dependent variable.
@StatusId int,                          --Not used
@FaultId int,                           --Not used
@Reason1 int,                           --Used to retain reason if event is appended.
@Reason2 int,                           --Used to retain reason if event is appended.
@Reason3 int,                           --Used to retain reason if event is appended.
@Reason4 int,                           --Used to retain reason if event is appended.
@ProductionRate float,                  --Must be specified for event creation (= 0.0 in
this procedure).
@Duration float,                        --Must be specified for event creation (= 0.0 in
                                        this procedure).
@Transaction__Type int,                 --(1=Add, 2=Update, 3=Delete, 4=Close).
@EventStartTime datetime,               --Start time for new downtime event.
@TEDet__Id int,                         --Downtime event Id for existing event.
@@Start__Time datetime,                 --Start time for the downtime event if appended.
@@End__Time datetime,                   --End time for an event for the previous interval
                                        if it exists.
@TEFault__Id int,                       --Fault Id from fault translation table.
@Count int                              --Number of events with timestamps later than
                                        the timestamp for
                                        --this interval.
@CurrentValue varchar(50)               --Value of this variable at this time.
                                        --Get the current value of this variable (i.e., the
                                        message)
Select @CurrentValue=Result from Tests
    where Var__Id=@Var__Id and Result__On=@Timestamp
Set @OutputValue = @CurrentValue
                                        --initialize variables
Select @ProductionRate = 0.0
Select @Duration = 0.0
                                        --Find Var__Id of the dependent variable. This
                                        variable triggers a 24-hr CMS event
Select @DepVarid =Var__Id
    From Calculation__Instance__Dependencies
    Where Result__Var__Id = @Var__Id
                                        --Verify that dependent variable is configured.
                                        Return if it is not.
If (@Dep Var__Id is Null)
    Begin
        Set @OutputValue='No Dep Var'
        Return
    End
                                        --Get the corresponding value of the dependent
                                        variable
Select @Value = Result
    From Tests Where Var__Id = @DepVar__Id and Result__On = @Tirnestamp
                                        --If the value of the dependent variable is NULL
                                        then return.
If @Value is Null
    Begin
        Set @OutputValue='No Event'
        Return
    End
                                        --Set the start time of the new event to 24-Hrs
                                        ago.
Select @EventStartTime = DateAdd(dd,-1,@Timestamp)
                                        --If the trigger variable value ='Treatment
                                        CMS', then append an existing or open event if
                                        this event overlaps
                                        --with the existing/open event. Otherwise, create
                                        a new event.
If @Value ='Bad Data - 24Hr CMS'
    Begin
        --Find all events for this PU that begin or end later than the timestamp for this variable
        Select @Count = Count(*)
        From Timed__Event__Details
        Where pu__id = @pu__id and ((Start__Time >= @Timestamp) or (End__Time >= @Timestamp))
                                        --Return if there exists an event later than the
                                        timestamp of this variable
        If Convert(float,@Count) > 0.0
            Begin
                If @CurrentValue <> 'Event Created'
                Set @OutputValue='Later Event'
            Return
        End
    Select @TEDet__Id = TEDet__Id,@@Start__Time = Start__Time,@@End__Time =
```

-continued

```
End_Time,@Reason1=Reason_Level1,@Reason2=Reason_Level2,@Reason3=Reason_Level3,@Reason
4=Reason_Level4,@TEFault_Id=TEFault_Id
    From timed_event_details
    Where pu_id = @Pu_Id and Start_time <= @EventStartTime and ((End_Time >= @EventStartTime)
or (End_Time is Null))
    If @TEDet_Id is NULL
        Begin
            Select 5, @PU_Id,
@PU_Id,NULL,NULL,NULL,NULL,NULL,NULL,@ProductionRate,@Duration,1,@EventStartTime,N
ULL,0
            Select 5, @PU_Id,
@PU_Id,NULL,NULL,NULL,NULL,NULL,NULL,@ProductionRate,@Duration,4,NULL,@Timestamp
,0
        End
    Else
        Begin
            Select 5, @PU_Id,
@PU_Id,NULL,@TEFault_Id,@Reason1,@Reason2,@Reason3,@Reason4,NULL,NULL,2,@@Start_T
ime,@Timestamp,@TEDet_Id
            End
        Set @OutputValue='Event Created'
    End
*/
```

The purpose of this document is to describe the design of the record-keeping and reporting system for the Condensate Collection system. The software is comprised of PI Data Archive software (which is used for automatic data collection from various process instrumentation and control systems) and Proficy software (which monitors and reports compliance based on the PI data and operator inputs). This documentation is directed toward system administrator level personnel but is useful for gaining a basic understanding of how the system works.

The following sections describe the general configuration of the standard condensate collection monitoring system. Deviations from the standard model, configuration listings for specific lines, and mill-specific details are contained within the appendices.

Cluster Rule regulations require that affected sites maintain continuous compliance with one of the following options for condensate collection:

- Named Stream, which is the collection of all named streams listed in the regulation (§63.446(c)1); or
- 65%, which is collection of all HVLC and LVHC condensate and condensates that contain at least 65% of the total HAP mass from the remaining named condensate streams using methanol (MeOH) as a surrogate (§63.446(c)2); or
- lb/ton, which is the collection of at least 11.1/7.2 lb HAP/ton of oven dried pulp at the digester (bleached/unbleached respectively) from the named streams using methanol as a surrogate (§63.446(c)3).

Sites must obtain regulatory agency approval for their proposed method of continuous compliance and the continuous monitoring system (CMS). This document details IP's primary approach for continuous compliance using the lb/ton method referenced herein as the "Main Tank" or "Main Tank Collection" method.

The continuous monitoring system (CMS) is operated to measure the quantity of methanol (MeOH) collected in the main condensate collection tank relative to pulp production. The regulatory requirement (§63.446(c)3) for compliance is to collect a minimum quantity of methanol per oven dried ton of pulp produced at the digester (7.2 lbs/ODTP for a non-bleached mill and 11.1 lbs/ODTP for a bleached mill). The lbs/ODTP collected in the main tank is calculated over an averaging period (e.g. fifteen-days). The collection quantity is derived from three primary process variables:

- Pulp Production (Oven Dried Tons Pulp per Day (ODTP/Day), determined from chip meter or blow rate;
- Condensate Flow (gpm), determined from a flow meter on main tank outlet;
- Condensate MeOH Concentration (ppm), determined from a lab test.

The data for pulp production, condensate flow and MeOH concentration are collected on a daily basis. Regulatory requirements for reduction of monitoring data are defined in §63.8(g), which requires four or more data points equally spaced over each 1-hour period. We are using daily totals of pulp production and condensate flow to match the collection period of the daily composite sample, which is used to determine the average daily MeOH concentration. Because there are rather large variances in these process values on a day to day basis, a 15-day rolling average is used to determine the lbs/ODTP value for excess emission reporting.

The monitoring system logs all Excess Emission (EE) events and operator responses to those events, on a daily basis. The responses recorded by the operator determined Trouble, Cause, Correction (response), and Report Code (report categorization) for the event. The report categorization specifies if the event is considered an allowable excess emission due to Startup, Shutdown, and Malfunction (SSM) provisions, as required in §63.6(e)3(iii). The events are compiled by the system and reported to the state regulatory agency on a semi-annual basis or more frequently as required (§63.10).

In addition to capturing and categorizing EE and bypass events, the monitoring system also captures and records failures (downtime) of Continuous Monitoring System (CMS) devices, referred to as CMS events. CMS out of control conditions are defined in §63.8(c)7. Condensate collection CMS parameters include the MeOH Concentration, pulp production measurement (ODTP) and the daily total condensate flow. The monitoring system records these CMS events on a daily basis, along with the operator determined Trouble, Cause, Correction (response), and Report Code (report categorization) for the event, as required by §63.8(c)8. These events are summarized and reported to the state in a semi-annual CMS performance report or more frequently as required (§63.10).

Program Design

The data for pulp production and condensate flow is collected and archived by the PI system and made available to the Proficy system as daily totals. MeOH concentration data is received automatically, through a file transfer from the testing lab, or manually entered (as a fixed value or manual override) into Proficy. If the MeOH concentration is relatively stable, a fixed (factor) value for the concentration may be used in place of the lab daily analysis when approved by the appropriate regulatory authority.

At the beginning of each mill day, Proficy computes the relative MeOH collection rate (lbs MeOH/ODTP) over a 15-day window by dividing the 15-day collected MeOH total by the 15-day pulp production total (using only days and values exhibiting good data quality). This 15-day average lbs/ODTP collected is compared against the lbs per ODTP required for compliance to determine if an Excess Emission (EE) event has occurred. EE events are captured and recorded by the system whenever the calculated 15 Day lbs/ODTP of MeOH falls below the required minimum. Since this is a daily calculation, when this occurs the system records 24-hours of EE.

The Proficy software logs all EE events and operator responses to those events. The operator responses determine the Trouble, Cause, Correction (response), and Report Code (report categorization) for the event. The report categorization specifies if the event is considered an allowable excess emission due to Startup, Shutdown, and Malfunction (SSM) provisions. The events are compiled by the system and reported to the state regulatory agency on a semi-annual basis or more frequently as required.

Proficy also monitors for "bypass events" from the condensate closed collection system. A bypass event occurs when a portion of the condensate flow is diverted away from the collection system while the area is in a running state (i.e., the potential to emit HAPS [PTE] existed). Diverts are typically a result of flow diversion to sewer due to high conductivity or vessel overflow due to a malfunction—although other reasons for diverts exist. Proficy records the duration of the bypass events along with the operator responses to those events. The operator responses determine the Trouble, Cause, Correction (response), and Report Code. Bypass event reports are maintained by the mill to help categorize excess emission events (and as supporting documentation for Leak Detection and Repair (LDR) record keeping).

In addition to capturing and categorizing EE and bypass events, the Proficy system also captures and records failures (downtime) of Continuous Monitoring System (CMS) devices, referred to as CMS events. Condensate collection CMS parameters include the MeOH Concentration, pulp production measurement (ODTP determined from a chip meter or digester blows) and the daily total condensate flow. Whenever data for any of the parameters fails to meet preset criteria (out of range, poor instrument signal quality, flatline signal, or missing MeOH lab test results) the system suspends all calculations until intervention by an operator or the environmental contact. Intervention is made by either entering manual data or by selecting from a pull-down menu indicating that the system received Bad Data (creating a 24-hour CMS event and removing the day from the 15-day MeOH average calculation) or was Shutdown for greater than 80% of the production day (removing the day from the calculation but not creating a CMS event). Fields exist in the system to accommodate the manual data entry of the CMS parameters (using methods allowed by the state regulatory agency as a back up for instrumentation failures), resulting in no CMS event even when failures in automatic data collection occur.

CMS events are created manually when an operator or environmental contact determines that one or more of the CMS parameters have failed to obtain sufficient data to compute Daily MeOH collection for a 24-hour period. The individual creates the 24-hour CMS event by selecting "Bad Data" from the pull down menu on the Main Tank Proficy Autolog sheet. The system records the operator determined Trouble, Cause, Correction (response), and Report Code (report categorization) for the event. These events are summarized and reported to the state in a semi-annual CMS performance report or more frequently as required. Again, the report categorization specifies if the event is considered allowable based on the specific regulations.

Additionally Proficy provides a selection on the pull-down menu to indicate that the condensate sources were shutdown for more than 80% of the production day (i.e., operational for <4.8 hours). As with the CMS "Bad Data" selection, this has the effect of removing the day from the 15 day MeOH average calculation. Details of this process and guidelines on utilizing the menu selections are explained in detail below.

Table-6 provides the minimum required process inputs, their engineering units, associated PI tags (typical), and corresponding Proficy variable names. Italicized text represents mill-specific information.

TABLE 6

Input Variables

| Input | Eng Units | PI Tagname | Proficy Variable |
|---|---|---|---|
| Daily pulp production | ODTP | CR-pulp_production.Day | Daily - PI Digester Tons |
| Daily condensate collection | Gals | CR-cond_collection.Day | Daily - PI Main Tank Totalized Flow |
| Condensate MeOH concentration | ppm | N/A | LAB MeOH Conc Test Result |
| Pulp production data quality flag | | CR-pulp_production.DQ | N/A (Used in event detection model) |
| Condensate flow measurement data quality | | CR-cond_collection.DQ | N/A (Used in event detection model) |
| Pulp production percent good | % | CR-pulp_production.PctGd | Daily - PI chip meter % Good |
| Condensate flow percent good | % | CR-cond_collection.PctGd | Daily - PI Main Tank Flow Meter % Good |
| Condensate bypass or divert event indicator | | CR-*devicename*.Divert | N/A (Used in event detection model) |

TABLE 6-continued

| Input Variables | | | |
|---|---|---|---|
| Input | Eng Units | PI Tagname | Proficy Variable |
| Process downtime (both digester and evaporator area are down) | Mins/Day | CR-COND_Down.DAY | Down Time |

Proficy also calculates, and periodically writes to PI, the data shown in Table-7 or 8:

TABLE 7

| Proficy Data Written to PI | | | |
|---|---|---|---|
| Proficy Variable | Eng Units | PI Tagname | Description |
| 15 Day - MeOH Avg | Lbs/ODTP | CR-MeOHCollection.15Day | 15-Day average MeOH collection |
| 15 Day - MeOH Avg Lower Limit | Lbs/ODTP | CR-MeOHCollection.LL | 15-Day average MeOH collection lower specification limit from Proficy |

TABLE 8

| Proficy Data Written to PI For Mills following ASB Only Treatment Methods | | | |
|---|---|---|---|
| Proficy Variable | Eng Units | PI Tagname | Description |
| 15 Day - MeOH Avg (Lb/ODTP) | Lbs/ODTP | CR-MeOHCollection.15Day | 15-Day average MeOH collection |
| 15 Day - MeOH Avg Lower Limit | Lbs/ODTP | CR-MeOHCollection.LL | 15-Day average MeOH collection Lower Warning specification limit from Proficy |
| 15 Day - MeOH Avg Warning Limit | Lbs/ODTP | CR-MeOHCollection.LWL | 15-Day average MeOH collection Lower User specification limit from Proficy |

Table-9 lists typical Proficy variables for the system and a brief description of each.

TABLE 9

| Proficy Variables | | | |
|---|---|---|---|
| Production Unit | Variable | Data Source | Description |
| Production Line: Condensate Event (CMS) | | | |
| Condensate Event (CMS) | Condensate CMS Events | Calculation | Calculation that generates the 24-hour CMS downtime event. |
| Condensate Event (CMS) | Condensate Collection Data Quality (CMS) | AutoLog | Manual trigger for the 24-hour CMS downtime event. |
| Production Line: (mill specific) | | | |
| (mill specific) | Daily - PI Chip Meter % Good | PI | Pulp production data quality indicator (event for each digester). |
| (mill specific) | Daily - PI Main Tank Flow Meter % Good | PI | Condensate flow data quality indicator. |
| Production Line: Main Tank Compliance | | | |
| Main Tank Compliance | 15 Day - Avg End Time | AutoLog | Displays the timestamp for the last data point used in the 15 Day MeOH Avg calculation. |

TABLE 9-continued

| Production Unit | Variable | Data Source | Description |
|---|---|---|---|
| | | Proficy Variables | |
| Main Tank Compliance | 15 Day - Avg Start Time | AutoLog | Displays the timestamp for the first data point used in the 15 Day MeOH Avg calculation. |
| Main Tank Compliance | 15 Day - Digester Tons | Calculation | Total pulp production over the last 15-days where the corresponding data quality is good. |
| Main Tank Compliance | 15 Day - MeOH Collected | Calculation | Total lbs MeOH collected over the last 15-days where the corresponding data quality is good. |
| Main Tank Compliance | 15 Day - MeOH Avg | Calculation | Average MeOH collection over the last 15-days where the data quality is good. |
| Main Tank Compliance | 15 Day - MeOH Avg Warning Limit | Calculation | Lower limit to alert the operator or EHS that the EE trigger point is being approached for MeOH collection (Lower User Specification Limit) |
| Main Tank Compliance | 15 Day - MeOH Avg Lower Limit | Calculation | Trigger limit for MeOH Collection Excess Emissions. Equals 11.1 (non-bleached) or 13.2 (bleached). (Lower Warning Specification Limit). |
| Main Tank Compliance | Condensate EE Events | Calculation | Compares 15 Day - MeOH Avg (Lb/ODTP) to the Lower Warning specification limit. An 24-hour EE event is generated if the Avg is less than the limit. |
| Main Tank Compliance | Daily - LAB MeOH Conc | Calculation | Daily Lab MeOH Concentration test result. If multiple samples are coded for a given day, equal to the last value received. |
| Main Tank Compliance | Fixed MeOH Conc | AutoLog | Manually entered Fixed MeOH Concentration. |
| Main Tank Compliance | Concentration Method | AutoLog | Operator selectable as "Daily Sample" or "Fixed Conc". This determines whether the Daily - LAB MeOH Conc or Fixed MeOH Conc is used in subsequent calculations |
| Main Tank Compliance | Fixed or LAB MeOH Conc | Calculation | MeOH concentration value used (LAB or FIXED from above) |
| Main Tank Compliance | Daily - Manual MeOH Conc | AutoLog | Manually entered MeOH concentration which overrides the calculated value. |
| Main Tank Compliance | Daily - MeOH Conc Used for Avg | Calculation | Selected MeOH concentration (Fixed or LAB MeOH Conc or Daily - Manual MeOH Conc) used in the calculation of Daily - MeOH Collected. |
| Main Tank Compliance | Daily - PI Main Tank Totalized Flow | PI | Totalized flow from the condensate tank. This may come directly from a single PI tag or is derived from multiple flow totals. |
| Main Tank Compliance | Daily - Manual Main Tank Totalized Flow | AutoLog | Manually entered daily flow value. If entered, the value will override the PI value. |
| Main Tank Compliance | Daily - Main Tank Totalized Flow Used for Avg | Calculation | The selected value used in subsequent calculations. |
| Main Tank Compliance | Daily - MeOH Collected | Calculation | Calculated lbs MeOH collected. Inputs are Daily - MeOH Conc Used for Avg and Daily - Main Tank Totalized Flow Used for Avg. |
| Main Tank Compliance | Daily - PI Digester Tons | PI | Daily pulp production from PI (ODTP/day) |
| Main Tank Compliance | Daily - Manual Digester Tons | AutoLog | Manually entered daily pulp production value. If entered, the value will override the PI value. |
| Main Tank Compliance | Daily - Digester Tons Used for Avg | Calculation | Daily pulp production used in the calculation of 15 Day - Digester Tons (ODTP). |
| Main Tank Compliance | Daily - MeOH Avg | Calculation | Calculated daily MeOH collection (Daily - MeOH Collected)/(Daily - Digester Tons Used for Avg) |
| | | Production Line: Main Tank LAB MeOH Test Data | |
| Main Tank LAB MeOH Test Data | LAB MeOH Conc Test Result | File Transfer | Condensate sample test results. |
| | | Production Line: Reporting Unit | |
| Reporting Unit | Condensate Daily Downtime | PI | Process downtime (mins) |
| Reporting Unit | Running Time | Calculation | Calculated process uptime (1440- Down Time) |

The following paragraphs describe the interrelationship between the PI and Proficy variables and how they work together to complete the calculation of the 15 day MeOH collection average.

Digesters and Evaporators PTE State

A performance equation calculates an individual area's potential to emit (PTE) status each minute in PI. The performance equation logic returns a state of "CanEmit" when condensate is present in the area's condensate collection system. This is normally during the period from startup of the area (digester or evaporator) until a mill specific period after the area stops operating and methanol has been cleared from the system. The digester area PTE-state (CR-Dig_PTE.STAT) is calculated each minute based upon mill specific criteria (such as chip meter feed or extraction flows for a continuous digester). Similarly, the evaporator area PTE-state (CR-Evap_PTE.STAT) is calculated each minute and is based upon mill specific criteria (typically steam or liquor flow).

Condensate System PTE State

The Condensate system's potential to emit (PTE) is determined in PI using a performance equation, CR-Cond_PTE.STAT which is calculated every minute. The equation logic returns a state of "CanEmit" when either the digester area or evaporator area has a potential to emit status of "CanEmit". When both areas have a PTE status of "CanNotEmit" the condensate PTE tag returns a state of "CanNotEmit".

Condensate Daily Downtime Counter

At the start of each mill day, a PI performance equation, CR-Cond_Down.Day, totals the "CanNotEmit" time for the condensate system (CR-Cond_PTE.Stat) over the previous 24-hour period. This value is read by Proficy and is used for both the daily display and daily calculation of condensate runtime ("CanEmit" for the daily period). The daily runtime minutes are kept in Proficy and are used to compute the total runtime minutes for the reporting period.

The Evaporator Area PTE, Digester Area PTE, overall Condensate System PTE and Daily Downtime data flow is depicted in FIG. I-A.

Pulp Production Filtered Tag and Percent Good

For every new snapshot value for the raw DCS PI tag, a PI performance equation, CR-pulp_production.Filt, filters the raw DCS tag for bad data quality or non-running status (PTE status of "CanNotEmit"). The check for a flat-lined signal is not required since most pulp production totals are calculated from the chip meter speed or the blow counter which are generally static values. If the PTE status is in a "CanEmit" state the value of the tag is compared against upper and lower reject limits (maintained in Proficy and written periodically to PI). If the tag is within the limits the raw value is archived; if the tag is outside the limits the text string "BAD" is archived instead. When the PTE status is "CanNotEmit" a value of 0 is archived representing no additional pulp production for the minute.

At the millday rollover, a PI performance equation CR-pulp_production.PctGd, calculates the percentage of time that the CR-pulp_production.Filt tag had a valid numerical value over the previous mill day (1440 minutes). The CR-pulp_production.PctGd tag is read by Proficy and displayed on an Autolog sheet to help explain missing data and for monitoring by operators and the environmental contact.

Figure 1B:
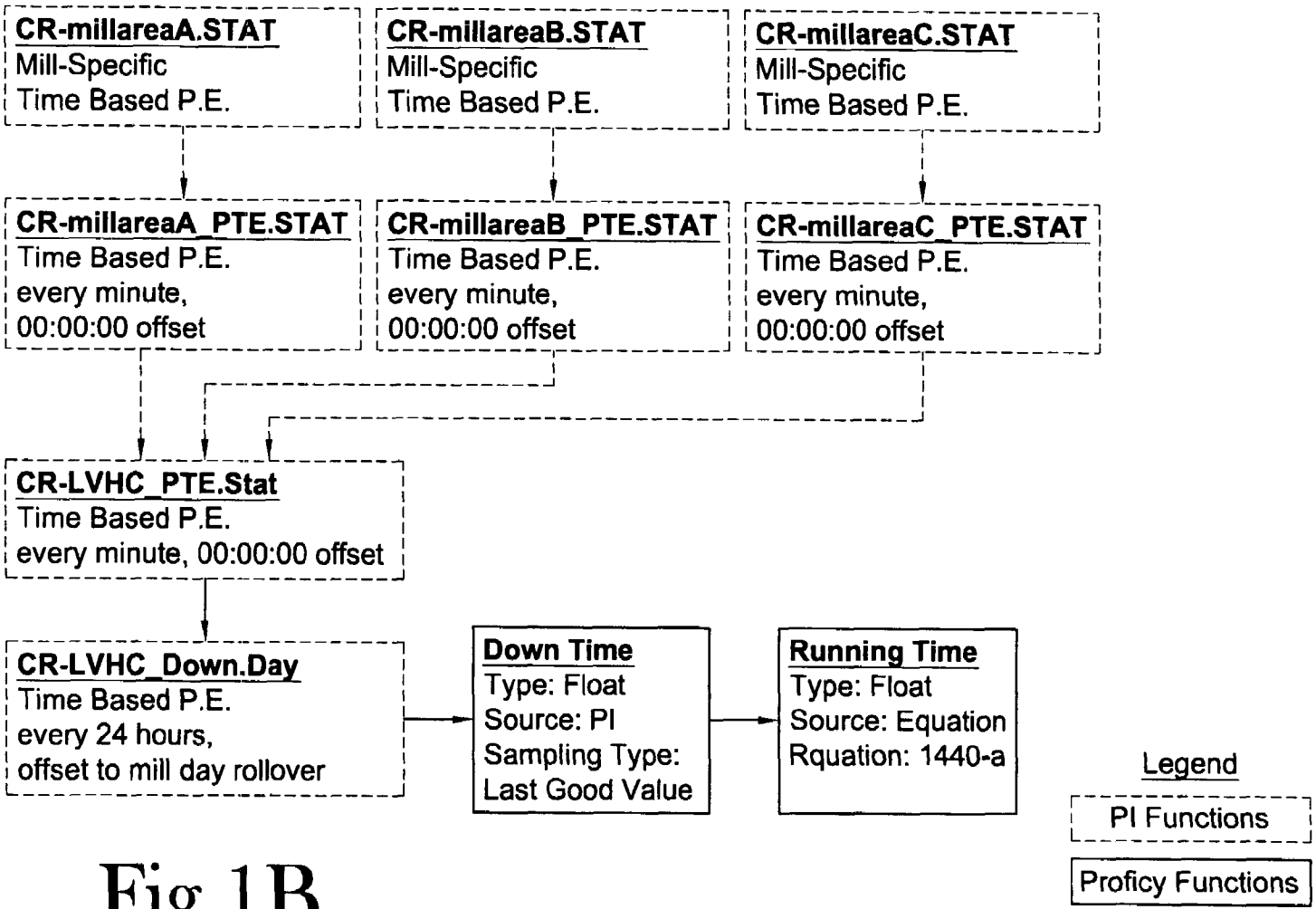
FIG. 1B is a flow diagram of LVHC PTE and Daily Downtime Data Flow.

Daily pulp production data flow is depicted in FIG. 1B.

Daily Pulp Production

At the start of each mill day a PI totalizer tag, CR-pulp_production.DAY, performs a time-weighted total of the digester pulp production rate filtered tag (CR-pulp_production.Filt, ODTP/min) over the previous 24-hour period. Only production rate values while the digester area's PTE status is "CanEmit" are included in the total.

Proficy reads the pulp production daily total and stores the value in the variable Daily—PI Digester Tons. As long as 80% of the daily runtime minutes[5] for pulp production experienced good data quality, the PI system will extrapolate a production total based upon 100% of the runtime minutes. The operator can also manually enter a pulp production value (Daily—Manual Digester Tons) to override an incorrect or missing PI value in the calculation of the daily and 15 Day—Digester Tons.

[5] The current implementation uses a totalizer period which is 24-hrs for the daily runtime.

Daily pulp production data flow is depicted in FIG. 1B.

Condensate Collection Filtered Tag and Percent Good

For every new snapshot value for the raw DCS PI tag, a PI performance equation, CR-cond_collection.Filt, examines the raw DCS tag for bad data quality, a flat-lined signal, or non-running status (PTE status of "CanNotEmit"). If (1) the PTE status is in a "CanEmit" state, (2) the difference between the maximum value of the raw tag for the past three hours and the minimum value of the raw tag for the past three hours is greater than zero, and (3) the raw value is within upper and lower data quality limits the raw value is archived by the filter tag; if the value of the tag is outside the limits or the maximum value minus the minimum value over the three hour period is zero a value of "BAD" is archived by the tag instead. If the PTE status is "CanNotEmit" a value of 0 is archived representing no flow for the minute. At the millday rollover, a PI performance equation CR-cond_collection.PctGd calculates the percentage of time that the CR-cond_collection.Filt tag had a valid numerical value over the previous mill day (1440 minutes). The CR-cond_collection.PctGd tag is read by Proficy and displayed on an Autolog sheet to help explain missing data and for monitoring by operators and the environmental contact.

Daily condensate data flow is depicted in FIG. 1B.

Daily Condensate Collection

At the end of each mill day a PI totalizer tag, CR-cond_collection.DAY, calculates a time-weighted totalized flow out of the main collection tank (GPM) over the previous 24-hour period. Proficy reads the condensate daily total and stores the value in the variable Daily—PI Main Tank Totalized Flow. As long as 80% of the daily runtime minutes experienced good flow meter data quality, the PI system will extrapolate the flow total based upon 100% of the runtime minutes. The operator can also manually enter a flow value for the day (Daily—Manual Main Tank Totalized Flow) that will override an incorrect or missing PI value for daily flow. This value (and the Daily—MeOH Conc. Used for Avg value—see below) is used to calculate the daily collected MeOH (Daily—MeOH Collected). Daily collected MeOH is used in the calculation of 15 day collected MeOH (15 Day—MeOH Collected).

Daily condensate data flow is depicted in FIG. 1B.

MeOH Concentration

MeOH concentration is determined by lab analysis of samples taken from the main collection tank. The CRC lab analysis uses File Transfer Protocol (FTP) to automatically enter the lab determined MeOH concentration into the Main Tank Autolog variable Daily—Lab MeOH Conc for the period (mill day) from which the sample was taken (and applies to). For other labs, the daily concentration must be manually entered by the mill. Alternatively a second Autolog variable, Fixed MeOH Conc, can be used in place of the Daily—Lab MeOH Conc if the mill and state regulatory agency agree upon an approach to calculate and verify a fixed MeOH factor, referred to as the Fixed MeOH Conc (Fixed MeOH Concentration). A pull down selection (Concentration Method) is used to select between the use of the Daily—Lab MeOH Conc and the Fixed MeOH Conc. The Fixed MeOH Conc is a manually entered, repeating Autolog variable and is used whenever the pull down selection is set to FIXED CONC. The calculation of Daily MeOH Avg (lbs/ODTP) will immediately occur once the daily tons produced (ODTP) and daily totalized flows are entered in the system (either manually or automatically from PI data). Since this is a mill specific averaging period, the system administrator, in concert with the environmental contact, is responsible to manually update the value of Fixed MeOH Conc to accurately reflect the most current fixed factor MeOH concentration whenever the factor value changes (and in accordance with the regulatory agency agreed upon requirements). If the Concentration Method pull down is set to DAILY SAMPLE, the system will wait until a lab concentration is available in the Daily—LAB MeOH Conc field to compute the Daily MeOH Avg (lbs/ODTP).

A third variable, Daily—Manual MeOH Conc, is available for the environmental contact to enter a manual concentration that will override the automatically entered value (either the Daily—LAB MeOH Conc [if Concentration Method is set to DAILY SAMPLE] or the Fixed MeOH Conc [if Concentration Method is set to FIXED CONC]) in case of an incorrect or missing concentration. Either the automatic or manually entered concentration (if entered) is copied into a fourth variable, Daily—MeOH Conc Used for Avg. The value initially is set to the automatically entered value (Daily—LAB MeOH Conc or Fixed MeOH Conc). The value updates when:

1) a value is added to the Daily—Manual MeOH Conc;
2) the Concentration Method flag changes (from/to DAILY SAMPLE to/from FIXED CONC); or
3) a previously entered manual value is deleted.

Whenever the value in this variable changes, the system will re-compute the Daily MeOH Avg (lbs/ODTP) and affected 15 day averages using the new value.

Security will be applied to the variables Fixed MeOH Conc and the Concentration Method selection field to prevent anyone except the designated person from modifying the method used (Daily or Fixed) or change the value of the repeating fixed concentration. This is usually accomplished by the security on the autolog display.

Figure 1C:
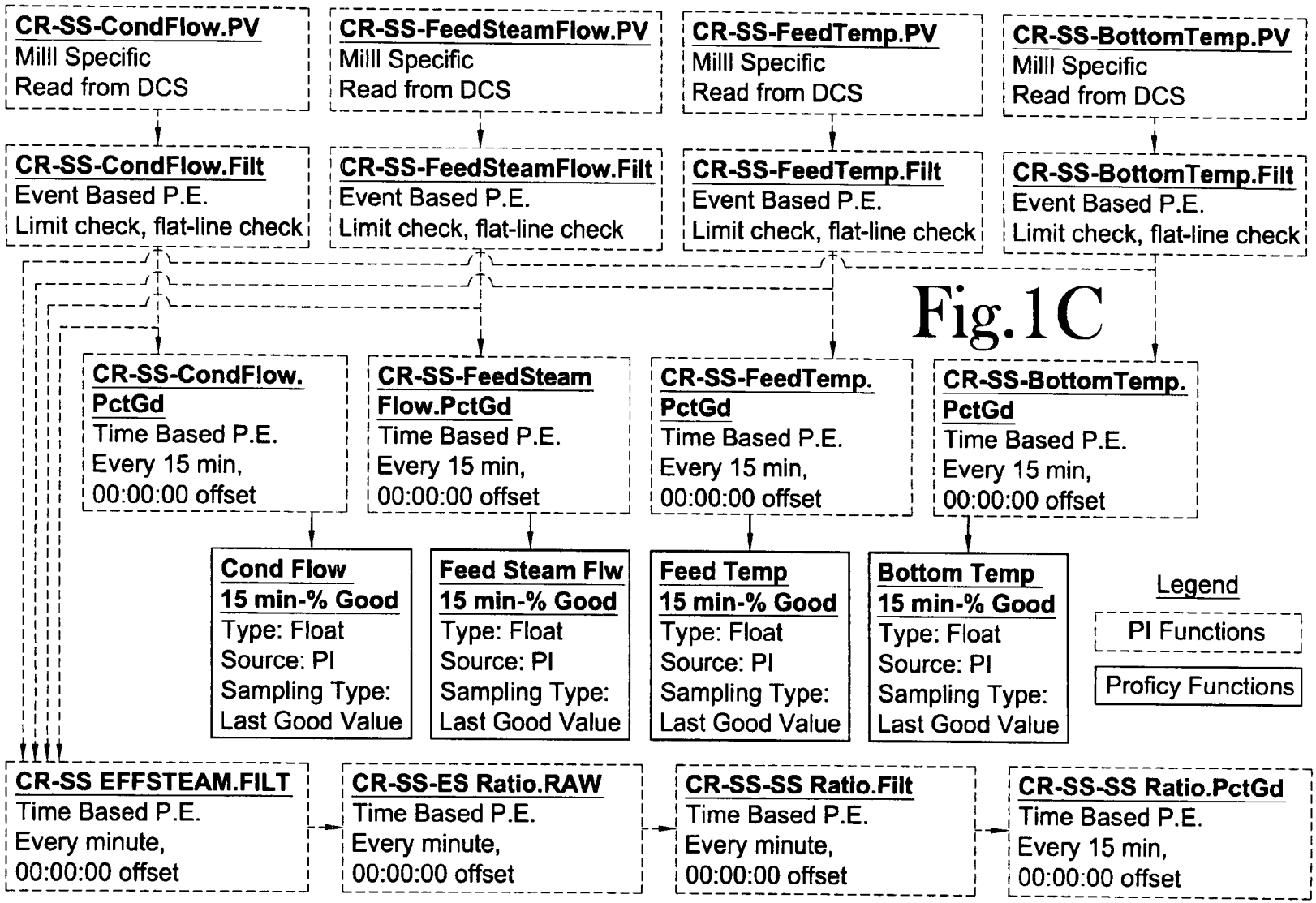
FIG. 1C is a flow diagram of Steam Stripper 92% Ratio Data Flow.

Daily MeOH concentration data flow is depicted in FIG. 1C.

10) 15-Day Totals

Fifteen-day totals for collected pounds MeOH (15 Day—MeOH Collected) and pulp production (15 Day—Digester Tons) are calculated in Proficy from the respective daily values. The calculation looks at the data over the last 30-days and sums the most recent 15 daily values where the corresponding data quality is good (as specified by the data quality flag, Condensate Collection Data Quality (CMS)). Fifteen values are required before a total is calculated. The 15-day average MeOH, 15 Day—MeOH Avg (lbs/ODTP), is calculated by dividing the 15-day collected MeOH total (15 Day—MeOH Collected) by the 15-day pulp production total (15 Day—Digester Tons).

For mills following the ASB Treatment methodology, a warning limit (the Proficy lower user specification limit) is attached to the 15 Day—MeOH Avg variable to warn the operator that MeOH Collection is close to falling below the excess emission limit (the Proficy lower warning specification limit) for condensate collection. The Proficy lower user specification limit is specific to the mill based upon the biological treatment efficiency of the ASB at the sCOD/HP upper limit in Proficy for the ASB system. The value of the warning limit (Proficy lower user specification limit) is calculated from the minimum $f_{bio}$ (fraction bio-degraded) that correlates to the sCOD/HP upper limit, determined during a performance test; the limit is set to $11.1/f_{bio}$ for bleached mills and $7.2/f_{bio}$ for non-bleached mills. This warning notifies the operator to inspect and troubleshoot the condensate closed collection and treatment systems to insure compliance during the next quarterly performance test.

Data flow for 15-day totals is depicted in FIG. 1D-*a*.

Condensate Collection System EE

A main tank condensate collection EE event is created whenever the 15 Day—MeOH Avg (lbs/ODTP) is less than its lower warning specification limit configured in Proficy. The event duration is 24-hours. Data flow for condensate system EE is depicted in FIG. 2A-*a*.

Condensate System Bypass Events

Bypasses of the condensate closed collection system are monitored by PI. A typical bypass indicator is the state of a two-way divert valve (Open/Closed) or the state of a tank overflow indicator (Overflow/NotOverflow). For divert valves, a PI performance equation, CR-devicename.Divert, returns a value of "Collect" when flow through the device is directed toward the main condensate collection tank and returns a value of "Divert" when flow through the device is diverted from the main collection tank (while the device's area—digesters, evaporators or both—has a PTE status of "CanEmit"). These performance equations are calculated every minute. Bypass events are monitored for Leak Detection and Repair reporting and may contribute to an EE event if the 15-day average MeOH Lbs/ODTP collected at the main tank falls below the lower warning specification limit.

Proficy monitors these tags using Proficy downtime model 200 with up to a 15 minute filter. Any PI value other than "Collect" begins a Bypass event. The Event ends when the PI value returns to "Collect".

Bypass Event data flow is depicted in FIG. 2A-*a*.

Condensate Data Quality Indicator Events

For Data Quality indicator events, Proficy monitors the data quality status for the main tank flow meter and each digester production indicator (blow counters are usually exempt) using Proficy downtime Model-200 with a mill specific delay filter. PI performance equations, CR-devicename.DQ, return a value of "Bad" when the instrument readings are outside the mill-specified instrument range while the respective area has a PTE status of "CanNotEmit" as indicated by the associated filtered (.Filt) tag; otherwise, the returned value is "Good". Whenever Proficy reads any value from PI other than "Good," a Data Quality Indicator event is started. The event ends when the PI value returns to "Good." These events are not reportable to the state and are used for diagnostic troubleshooting of the closed condensate collection system.

Missing MeOH concentration data due to problems with the sample or the lab test are captured with manual downtime events in Proficy. This event is not reportable to the state and is used for diagnostic troubleshooting of the closed collection system.

Condensate CMS Events

A reportable, 24-hour CMS downtime event is created whenever the operator sets the Condensate Collection Data Quality (CMS) pull-down selection to a value of "Bad Data—24 Hr CMS". This selection will be chosen when the MeOH Concentration, daily flow total, or daily digester production (ODTP) cannot be determined for the day. The operator will use the reasons assigned to the Data Quality Indicator events for the day to assign the appropriate reasons to the 24-hour CMS event. If the mill is using a fixed MeOH concentration factor (Concentration Method set to FIXED CONC), the absence of a daily MeOH concentration will no longer result in a reportable CMS event.

Condensate System Shutdown

Whenever the condensate system sources (digesters and evaporators) have been shutdown for a majority of the day (<20% of the potential runtime minutes or <4.8 hours per production day) the operator can manually select the option Shutdown from the pull-down selection on the Condensate Collection Data Quality (CMS) variable. This has the effect of eliminating the shutdown day data from use in computing subsequent 15-day rolling MeOH collection averages.

When one or more of the required values to compute MeOH collection are missing, Proficy will suspend MeOH calculations until the values are available or operator intervention (through manual entry of a value or manual selection regarding data quality) is made. The table below reflects the appropriate action under differing runtime conditions and/or data quality conditions.

Guidelines For Use of Manual Pull-Down Selections

| Running Conditions | Appropriate Action |
|---|---|
| >20% of daily runtime and >80% Good data | No action required; values automatically entered in PI and read by Proficy. |
| >20% runtime and <80% Good data (Bad or missing PI Data) and an approved alternate method of obtaining ODTP, Flow, or MeOH Concentration | Manual entry of ODTP, Total Flow, and/or MeOH Concentration as required |
| <20% runtime (4.8 hours or 288 min.) over the production day | Select "Shutdown" |
| <80% Good Data for runtime min. with no approved alternate method of ODTP, Flow, or MeOH Concentration | Select "Bad Data - 24 Hrs CMS" |

Standard PI Model

Tag Name Specifications

All Cluster Rule PI tags will begin with "CR-".

Digital State Set Specifications

The following are the minimum required digital state sets in PI to support the Cluster Rule Bleach Plant model.

| Digital Set Name | State 0 | State 1 |
|---|---|---|
| P2Emit | CanEmit | CanNotEmit |
| OK-EE | OK | EE |
| GOOD-BAD | Good | Bad |
| DivertCollect | Divert | Collect |
| Running | Running | NotRunning |

Scan Class Specifications

The following scan classes must be available in PI. Note, the scan class number will vary from mill to mill.

A one minute scan class offset 0 seconds from midnight;

A twenty-four hour scan class offset to the start of mill day.

Examples of the scan class syntax are as follows:

/f=00:01:00, 00:00:00 (alternately /f=00:01:00, 0)

/f=24:00:00, 07:00:00 (alternately /f=24:00:00, 25200) for mill day at 07:00 am

PI Totalizer Configuration

PI Totalizer tags are used to calculate daily totals from flow meters and production rate tags. In order to properly account for potential to emit status and percent good limits for the source tag, the following procedures are used to configure these totalizers:

1. The flow source tag, which is read directly from a DCS flow indicator, will be referred to as cond_collection (Condensate Flow Indicator). The pulp production source tag, which is read directly from a DCS chip meter or blow counter, will be referred to as pulp_production (total ODTP/d).
2. The totalizer souce tag needs to have cluster rule data quality criteria applied. This includes data quality limits (instrument range), flat-lined signal tests and PTE status. Some tags, such as chip meter RPM, may change so slowly that a flat-lined signal test is not applicable. Other tags, such as condensate flow, will check the difference in the maximum value and the minimum value over the previous three hours to insure that the tag is not flat-lined. When the PTE status is "CanNotEmit", the .FILT tag returns a value of 0 so that the Totalizer will total a value of 0 instead of an interpolated value. The FILT tag should be a PI PE tag, event scheduled, so that buffered DCS data will re-trigger the calculations. so that the totalizer will compute a value within one minute of the end of the day, the raw DCS tag exception max attribute must be set to 60 seconds or less. This will help Proficy's ability to read the value at the mill day rollover.
3. Proficy will generate informational downtime events, when CMS instruments are not reading, which can be used to identify reasons for 24 hour CMS downtime, when totalizer values are missing because the % good is less than 80%. These downtime events are generated from a .DQ tag which is "GOOD" if the .Filt tag has a numeric value and "BAD" when the .Filt tag's value is a digital state. The .DQ tag is an event scheduled PE tag, based on changes in the FILT tag, so that it computes immediately whenever the process value changes.
4. A .PctGd PE tag will calculate daily percent good of the .FILT, but will not generate CMS events automatically. It will be read by Proficy and displayed for operator information. Daily CMS events are manually created by the environmental contact using a Proficy Autolog pull down menu.
5. The daily totalizer, DAY, will use .FILT as its SourceTag using a %-good attribute of 80% (or other value negotiated with the state agency). The effect of this is that the totalizer only totalizes pulp_production or cond_collection when the status of the source tag is good (a numeric value), and there is a potential to emit (included in the .Filt tag logic). If the percent good of FILT is greater than 80%, but less than 100%, the totalizer will extrapolate the available values to estimate a 100% daily total. If the percent good is less than 80%, the totalizer will not generate a valid daily total. When there is no potential to emit, the FILT tag will have a value of zero, so will contribute nothing to the daily total for that period.

PI Tag Configuration Specification

Tables 10-1 and 10-2 provide tag configuration examples of performance equations for a typical condensate collection model. Tables 10-3 and 10-4 provide tag configuration examples of totalizers for a typical condensate collection model. Table 10-5 gives exception and compressions attribute standards for raw DCS PI tags.

TABLE 10-1

| Tag Name/Descriptor | Comments | Exdesc |
|---|---|---|
| CR-Dig.Stat/CR-Evaps.Stat[6] Running status | Mill-Dependent | If ('flow.PV'<lowflowlimit...) then "NotRunning" else "Running" |
| CR-Dig_PTE.STAT[7] Digesters Potential to Emit Status | CanEmit if the area is running, producing MeOH, or has been running and has not yet purged all MeOH from the system | if BadVal(TimeEQ('CR-Dig.STAT', '*-delaytime, '*', "Running")) then PrevVal('CR-Dig_PTE.STAT', '*-delaytime') else if TimeEQ('CR-Dig.STAT', '*-delaytime', '*', "Running") >0 then "CanEmit" else "CanNotEmit" |
| CR-Evaps_PTE.STAT[2] Evaporators Potential to Emit Status | CanEmit if the area is running, producing MeOH, or has been running and has not yet purged all MeOH from the system | if BadVal(TimeEQ('CR-Evaps.STAT', '*-delaytime', '*', "Running")) then PrevVal('CR-Evaps_PTE.STAT', '*-delaytime') else if TimeEQ('CR-Evaps.STAT', '*-delaytime', '*', "Running") > 0 then "CanEmit" else "CanNotEmit" |
| CR-Cond_PTE.STAT[2] Condensate Potential to Emit Status | CanEmit if either dig or evaps area PTE is "CanEmit"; CanNotEmit if both dig and evaps area PTE is CanNotEmit | If 'CR-Dig_PTE.STAT' = "CanNotEmit" and 'CR_Evaps_PTE.STAT = "CanNotEmit" then "CanNotEmit" else "CanEmit" |
| CR-Cond_Down.Day[8] Daily Condensate downtime | Total minutes in the CanNotEmit state for yesterdays operating day | TimeEq('CR-Cond_PTE.STAT','Y+7H','T+7H','CanNotEmit")/60 |
| CR-pulp_production.Filt Pulp production rate filtered | Filters raw DCS tag based on upper and lower limits and PTE status | Event=pulp_production, if 'CR-Dig_PTE.STAT'="CanEmit" then (if ('pulp_production'>=lowlowlimit and 'pulp_production'<=hihilimit) then 'pulp_production' else "Bad") else 0 |
| CR-cond_collection.Filt Condensate collection filtered | Filters raw DCS tag based on upper and lower limts and PTE status | Event=cond_collection, if 'CR-Cond_PTE.STAT'="CanEmit" then (if (TagMax('cond_collection','*−3h','*') − TagMin('cond_collection','*−3h','*') > 0 and 'cond_collection'>=lowlowlimit and ' cond_collection'<=hihilimit) then ' cond_collection' else "Bad") else 0 |
| CR-pulp_production.DQ[4] Pulp production rate data quality | BAD if .Filt tag has BAD value; GOOD is Filt tag has numeric value | event=CR-pulp_production.Filt,if BadVal(' CR-pulp_production.Filt ') then "Bad" else "Good" |
| CR-cond_collection.DQ[9] Condensate Collection Data Quality | BAD if .Filt tag has BAD value; GOOD is Filt tag has numeric value | event=CR-pulp_production.Filt,if BadVal(' CR-pulp_production.Filt ') then "Bad" else "Good" |
| CR-pulp_production.PctGd Pulp production rate % Good | Calculates the daily percent good of the .Filt tag | If BadVal(PctGood('CR-pulp_production.Filt','Y+420M','T+420M')) then 0 else PctGood('CR-pulp_production.Filt','Y+420M','T+420M') |
| CR-cond_collection.PctGd Condensate collection % Good | Calculates the daily percent good of the .Filt tag | If BadVal(PctGood('CR-pulp_production.Filt','Y+420M','T+420M')) then 0 else PctGood('CR-pulp_production.Filt','Y+420M','T+420M') |
| CR-devicename.Divert[10] Bypass event | Monitor tank overflows and diverts of condensate to sewer for leak detection and repair reporting | For tank overflows - If ('CR-Cond_PTE.STAT'="CanNotEmit") then "Collect" else if ('tank_level.PV' <= HiHiLimit) then "Collect" else "Divert" For divert valves - If ('CR-Cond_PTE.STAT'="CanNotEmit") then "Collect" else if ('devicename.PV' = "Open") then "Collect" else "Divert" |
| CR-MeOHCollection.15Day | 15-Day Average MeOH collection | |
| CR-MeOHCollection.LL | 15-Day Avg MeOH collection Low Limit | |
| CR-MeOHCollection.LWL[11] | 15-Day Avg MeOH coll. Low User Limit | |

[6]Running Status tag logic is to be defined so that any error conditions will default to the value of "Running" (final clause is else "Running")
[7]If delaytime is not required, running status logic is used in the PTE tag and the running status tag is not needed. PTE Status tag logic is defined so that the default value is "CanNotEmit" (final clause is else "CanNotEmit")
[8]Daily downtime tag logic, Y+7H refers to 7:00 am yesterday and T+7H refers to 7:00 am today for a mill-day rollover of 7:00 am (adjust for mill's actual rollover)
[9]Data Quality (CMS) tag logic is defined so that any error conditions will default to the value of "BAD" (final clause is else "BAD")
[10]Bypass Divert tag logic is defined so that any error conditions will default to the value of "Divert" (final clause is else "Divert")
[11]Lower User Specification Limit is written to PI ONLY when ASB Treatment method is used.

TABLE 10-2

| Tag Name | engunits | Point source | Ppoint type | DigitalSet | LLocation4 | cComp dev |
|---|---|---|---|---|---|---|
| *CR-Dig.Stat/CR-Evaps.Stat* | Running/Not Running | C | Digital | Running | 1 | Mill std |
| CR-Dig_PTE.STAT | CanEmit/Can NotEmit | C | Digital | P2EMIT | 1 | 0 |
| CR-Evaps_PTE.STAT | CanEmit/Can NotEmit | C | Digital | P2EMIT | 1 | 0 |

TABLE 10-2-continued

| | | | | | | |
|---|---|---|---|---|---|---|
| CR-Cond_PTE.STAT | CanEmit/CanNotEmit | C | Digital | P2EMIT | 1 | 0 |
| CR-Cond_Down.Day | Min/Day | C | Float32 | | 4 | 0 |
| CR-*pulp_production*.Filt | ODTP/m | C | Float32 | | 1 | 0 |
| CR-*cond_collection_tag*.Filt | GPM | C | Float32 | | 1 | 0 |
| CR-*pulp_production*.DQ | GOOD-BAD | C | Digital | BAD-GOOD | 1 | 0 |
| CR-*cond_collection_tag.DQ* | GOOD-BAD | C | Digital | BAD-GOOD | 1 | 0 |
| CR-*pulp_production*.PctGd | % | C | Float32 | | 4 | 0 |
| CR-*cond_collection_tag*.PctGd | % | C | Float32 | | 4 | 0 |
| CR-*devicename*.Divert | Divert-Collect | C | Digital | DivertCollect | 1 | 0 |
| CR-MeOHCollection.15Day | Lbs/ODTP | Lab | Float32 | | 1 | 0 |
| CR-MeOHCollection.LL | Lbs/ODTP | Lab | Float32 | | 1 | 0 |
| CR-MeOHCollection.LWL | Lbs/ODTP | Lab | Float32 | | 1 | 0 |

| Tag Name | Compressing | Comp Max | Eexc dev | excmax | shutdown | step | zero | Span |
|---|---|---|---|---|---|---|---|---|
| *CR-Dig.Stat/CR-Evaps.Stat* | 1 | Mill std | Mill std | Mill std | 1 | 0 | | |
| CR-Dig_PTE.STAT | 1 | 28800 | 00 | 60 | 1 | 0 | | |
| CR-Evaps_PTE.STAT | 1 | 28800 | 00 | 60 | 1 | 0 | | |
| CR-Cond_PTE.STAT | 1 | 28800 | 00 | 60 | 1 | 0 | | |
| CR-Cond_Down.Day | 1 | 7200 | 00 | 60 | 0 | 1 | 0 | 1440 |
| CR-*pulp_production*.Filt | 1 | Mill std | 0 | 60 | 1 | 0 | ? | ? |
| CR-*cond_collection_tag*.Filt | 1 | Mill std | 0 | 60 | 1 | 0 | ? | ? |
| CR-*pulp_production*.DQ | 1 | 28800 | 0 | 60 | 0 | 0 | | |
| CR-*cond_collection_tag.DQ* | 1 | 28800 | 0 | 60 | 0 | 0 | | |
| CR-*pulp_production*.PctGd | 1 | 7200 | 00 | 60 | 1 | 1 | 0 | 100 |
| CR-*cond_collection_tag*.PctGd | 1 | 7200 | 0 | 60 | 0 | 1 | 0 | 100 |
| CR-*devicename*.Divert | 1 | 28800 | 0 | 60 | 0 | 1 | | |
| CR-MeOHCollection.15Day | 1 | 28800 | 0 | 600 | 0 | 1 | 0 | 15 |
| CR-MeOHCollection.LL | 1 | 28800 | 0 | 600 | 0 | 1 | 0 | 15 |
| CR-MeOHCollection.LWL | 1 | 28800 | 0 | 600 | 0 | 1 | 0 | 15 |

Note:
Italics print represents mill specific information.

TABLE 10-3

| Tag Name/Descriptor | comments | Eng units | pointsource | Pt class | Sourcetag | FilterExpr |
|---|---|---|---|---|---|---|
| CR-pulp_production.DAY Daily Total Digester Production | Totalizes filtered pulp production rate tag for yesterday. Must have 80% of good value | ODTPD | T | Totalizer | CR-pulp_production_tag.Filt (daily digester production) | Must be none |
| CR-cond_collection DAY Daily Total Condensate to Treatment | Totalizes filteredcondensate flow to treatment for yesterday. Must have 80% of good values | Gal/Day | T | Totalizer | CR-Cond_collection_tag.Filt | Must be none |

TABLE 10-4

| Tag Name | Rate Sample Mode | Total Close Mode | Report Mode | Function | CalcMode | Period | Offset | Pct Good |
|---|---|---|---|---|---|---|---|---|
| CR-*pulp_production*.DAY | Natural | Clock | Period End | Total | Time weighted | +1 d | +7 h[1] | 80 |

TABLE 10-4-continued

| Tag Name | Rate Sample Mode | Total Close Mode | Report Mode | Function | CalcMode | Period | Offset | Pct Good |
|---|---|---|---|---|---|---|---|---|
| CR-*cond_collection*.DAY | Natural | Clock | Period End | Total | Time weighted | +1 d | +7 h[1] | 80 |

Note:
Italics print represents mill specific information.
[1]Totalizes values for yesterday's MILL day. Example shows offset for mill day rollover at 7:00 am.

TABLE 10-5

| Tag Name | Descriptor | ExcDev | ExcMax | Comp Dev | Comp Max | Compressing |
|---|---|---|---|---|---|---|
| pulp_production | Raw DCS tag for pulp production | Mill std | 60 | Mill std | <=3600 | 1 |
| cond_collection | Raw DCS tag for main tank flow | Mill std | 60 | Mill std | <=3600 | 1 |
| devicename.PV | Raw DCS tag for divert valve | Mill std | 60 | Mill std | Mill std | 1 |
| tank_level.PV | Raw DCS tag for tank level | Mill std | 60 | Mill std | Mill std | 1 |

Standard Proficy Model

The Proficy model consists of input variables (PI inputs), calculated variables, stored procedures, and Visual Basic scripts (VB scripts). Variables for a typical Condensate Main Tank Collection system and descriptions of the stored procedures and the VB scripts are included below. Complete listings of the Stored Procedures can be found herein.

TABLE 11

PI Interface Proficy Variables

| Variable Description | DataSource | Eng Units | Event Type | Data Type | Pre-cision | Sampling Window | Sampling Interval | Sampling Offset[1] | Sampling Type | PI Tag |
|---|---|---|---|---|---|---|---|---|---|---|
| 15 Day - MeOH Avg Warning Limit | Calculation | lbs/ODTP | Time | Float | 2 | | 1440 | 420 | | CR-MeOHCollection.LWL[2] |
| 15 Day - MeOH Avg Lower Limit | Calculation | lbs/ODTP | Time | Float | 2 | | 1440 | 420 | | CR-MeOHCollection.LL[2] |
| 15 Day - MeOH Avg | Calculation | lbs/ODTP | Time | Float | 2 | | 1440 | 420 | | CR-MeOHCollection.15Day[2] |
| Daily - PI Digester Tons | PI | ODTP | Time | Float | 0 | 60 | 1440 | 420 | Last Good Value | CR-pulp_production.DAY |
| Daily - PI Main Tank Totalized Flow | PI | Gals | Time | Float | 0 | 60 | 1440 | 420 | Last Good Value | CR-cond_collection.DAY |
| Daily - PI Chip Meter % Good | PI | % | Time | Float | 1 | 60 | 1440 | 420 | Last Good Value | CR-pulp_production.PctGd |
| Daily - PI Main Tank Flow Meter % Good | PI | % | Time | Float | 1 | 60 | 1440 | 420 | Last Good Value | CR-cond_collection.PctGd |
| Condensate Daily Downtime | PI | MMinutes | Time | Integer | | 60 | 1440 | 420 | Last Good Value | CR-Cond_Down.Day |

[1]The sampling offset is determined based upon the mill-specific start of day time. The offset value is the number of minutes from midnight to the mill start of day. Example shows mill day start at 7:00 am.
[2]Values written to PI

TABLE 12

Proficy Calculated Variables

| Variable Description | Eng Units | Event Type | Data Type | Precision | Sampling Interval | Sampling Offset[1] | Sampling Window | Calc Type | Calc Name |
|---|---|---|---|---|---|---|---|---|---|
| Condensate CMS Events | Status | Time | String | | 1440 | 420 | | Stored Procedure | Condensate CMS Events |
| 15 Day - Digester Tons | ODTP | Time | Float | 1 | 1440 | 420 | 21599 | Stored Procedure | 15 Day Total |

TABLE 12-continued

Proficy Calculated Variables

| Variable Description | Eng Units | Event Type | Data Type | Precision | Sampling Interval | Sampling Offset[1] | Sampling Window | Calc Type | Calc Name |
|---|---|---|---|---|---|---|---|---|---|
| 15 Day - MeOH Avg (Lb/ODTP) Warning Limit | lbs/ODTP | Time | Float | 2 | 1440 | 420 | | Equation | Lower User Spec Limit |
| 15 Day - MeOH Avg Lower Limit | lbs/ODTP | Time | Float | 2 | 1440 | 420 | | Equation | Lower Warning Spec Limit |
| 15 Day - MeOH Avg | bs/ODTP | Time | Float | 2 | 1440 | 420 | | Equation | Calc (A/B) |
| 15 Day - MeOH Collected | lbs | Time | Float | 0 | 1440 | 420 | 21599 | Stored Procedure | 15 Day Total |
| Condensate EE Events | Status | Time | String | | 1440 | 420 | | Stored Procedure | Condensate EE Events |
| Daily - Digester Tons Used for Avg | ODTP | Time | Float | 1 | 1440 | 420 | | Stored Procedure | Manual Update |
| Daily - LAB MeOH Conc | ppm | Time | Float | 0 | 1440 | 420 | | Stored Procedure | GetMeOHLabData |
| Fixed or LAB MeOH Conc | ppm | Time | Float | 0 | 1440 | 420 | | Stored Procedure | Fixed or LAB MeOH Conc. |
| Daily - MeOH Conc Used for Avg | ppm | Time | Float | 0 | 1440 | 420 | | Stored Procedure | Manual Update |
| Daily - Main Tank Totalized Flow Used for Avg | Gals | Time | Float | 0 | 1440 | 420 | | Stored Procedure | Manual Update |
| Daily - MeOH Collected | lbs | Time | Float | 0 | 1440 | 420 | | Equation | Calc (A * 8.34 * B/1000000) |
| Daily - MeOH Avg | lbs/ODTP | Time | Float | 2 | 1440 | 420 | | Equation | Calc (A/B) |
| Condensate Daily UpTime | Minutes | Time | Integer | | 1440 | 420 | | Equation | UpTime (Daily) |

TABLE 13

Proficy Autolog & File Transfer Variable

| Variable Description | DataSource | Eng Units | Event Type | DataType | Precision | Sampling Interval | Sampling Offset[1] | Repeating |
|---|---|---|---|---|---|---|---|---|
| Condensate Collection Data Quality (CMS) | AutoLog | Status | Time | Data Quality | | 1440 | 420 | |
| 15 Day - Avg End Time | AutoLog | Date | Time | String | | 1440 | 420 | |
| 15 Day - Avg Start Time | AutoLog | Date | Time | String | | 1440 | 420 | |
| Daily - Manual Digester Tons | AutoLog | ODTP | Time | Float | 1 | 1440 | 420 | |
| Fixed MeOH Conc | AutoLog | ppm | Time | Float | 0 | 1440 | 420 | Yes |
| Concentration Method | AutoLog | ppm | Time | Sampling Method | | 1440 | 420 | Yes |
| Daily - Manual MeOH Conc | AutoLog | ppm | Time | Float | 0 | 1440 | 420 | |
| LAB MeOH Conc Test Result | File Transfer | ppm | Production Event | Float | 0 | 1 | | |

[1]The sampling offset is determined based upon the mill-specific start of day time. The offset value is the number of minutes from midnight to the mill start of day. Example shows mill day start at 7:00 am.

Specification Limits

Proficy has upper and lower specification limits that can be defined for every variable: entry limits, user limits, warning limits, and reject limits. The following descriptions define how Proficy uses these limits to trigger events and inform operators of impending events:

User Limits

Provides a visible warning that event trigger points are being approached by changing the font color of the variable on an Autolog sheet Warning Limits Trigger level for EE events Reject Limits Trigger level for CMS events or data quality limits Entry Limits Restricts the range of valid numerical entries used for a manual entry variable.

TABLE 14

Proficy Variables and Specifications limits

| Variable Name | Specification Limit | Use |
|---|---|---|
| Daily - Manual Digester Tons | Lower Entry | Minimum possible daily digester tons |
| | Upper Entry | Maximum possible daily digester tons (max ODTP/m*1440) |

TABLE 14-continued

Proficy Variables and Specifications limits

| Variable Name | Specification Limit | Use |
|---|---|---|
| Fixed MeOH Concentration | Lower Entry | Minimum possible daily MeOH Concentration |
| | Upper Entry | Maximum possible daily MeOH Concentration (max ppm*1440) |
| Daily - Manual MeOH Concentration | Lower Entry | Minimum possible daily MeOH Concentration |
| | Upper Entry | Maximum possible daily MeOH Concentration (max ppm*1440) |
| Daily - Manual Main Tank Totalized Flow | Lower Entry | Minimum possible daily main tank flow |
| | Upper Entry | Maximum possible daily main tank flow (max gpm*1440) |
| Daily - MeOH Avg | Lower User | Visible warning that EE limit is being approached |
| | Lower Warning | Visible warning that EE limit for the day has been tripped (No EE event is created) |
| 15 Day - MeOH Avg | Lower User | Visible warning that EE limit is being approached |
| | Lower Warning | Trigger 24 hour EE event |
| Daily - PI chip meter % Good | Lower Reject | Used to indicate bad data quality (value is always 80) |
| Daily - PI Main Tank Flow Meter % Good | Lower Reject | Used to indicate bad data quality (value is always 80) |

MeOH Test Data File Transfer

MeOH concentration test results are imported from the testing lab host via file transfer. New test data is stored in a delimited ASCII file in a specified folder on the testing lab host. Proficy's FTP engine, at a specified frequency, looks for new files with a name matching a specified mask in the designated folder on the remote host. When the FTP engine detects a new file, the file is moved from the host to the folder "\Proficy\Incoming" folder on the Proficy server. Similarly, Proficy import Model-79 continuously monitors "\Proficy\Incoming" every minute for a new data file. If a new file is found, the data is parsed and transferred as inputs to the stored procedure spLocal_CRCEvent_Data where it is processed. The data file structure consists of four fields: the data source ID (e.g., example: CR-AU-MT-HP-IN where AU=mill Id), date, timestamp, and test result. The stored procedure runs once for every record in the file, creates a production event (event number format—mmddhhmmss from the data's date/time), and records the data in the TESTS table while retaining the data's relationship to the event number. If processing is successful, the file is moved to the folder "\Proficy\Processed" and the file name appended with a timestamp designating the processing date/time. If processing is unsuccessful, the file is moved to the folder "\Proficy\UnProcessed" and timestamped.

Calculations

15 Day Total

Type: Stored Procedure—spLocal_15 DayTotal

This procedure looks at daily data for a specified variable (either Daily—MeOH Collected (Lbs) or Daily—Digester Tons Used for Avg (ODTP)) over the last 30-days and sums the most recent 15 daily values where the data quality is good (as specified by the data quality flag, Condensate Collection Data Quality (CMS)). Fifteen values are required before a total is calculated. Values with a timestamp that is not the mill-day rollover are excluded from the calculation.

Condensate EE Events

Type: Stored Procedure—spLocal_CondEvents

This procedure reads the value of the dependent variable (15 Day—MeOH Avg (Lbs/ODTP)) and compares it to the variable's specification limit, as specified in the calculation inputs (LW, LR, etc.). If this value is outside of the limit, then a 24-hr downtime event is created (appended if a contiguous event exists) on the variable's unit. The following table lists the possible status messages and their definition. This status message is displayed on the Autolog display as the variable Condensate EE Events.

| Status Message | Definition |
|---|---|
| No Dep Var | Calculation is not configured correctly, dependant variable is not configured |
| No Reject | Calculation is not configured correctly, reject limit input constant is not configured. |
| Incorrect Reject | Calculation is not configured correctly, reject limit is incorrect. |
| Bad Limit | The reject specification limit is NULL. |
| No Value | The dependant variable value is NULL |
| Event Created | A downtime event was created because the 15 day MeOH Avg is less than the reject limit. |
| Event Updated | An existing event was extended because the next day's 15 day MeOH Avg is still less than the reject limit. |

Condensate CMS Events

Type: Stored Procedure—spLocal_CondCMSEvents This stored procedure creates a 24-hour downtime event that is triggered by a manual input from the operator (via Condensate Collection Data Quality (CMS) which is configured as the dependent variable). The following table lists the possible status messages and their definition. This status message is displayed on the Autolog display as the variable Condensate CMS Events.

| Status Message | Definition |
|---|---|
| No Dep Var | Calculation is not configured correctly, dependant variable is not configured |
| No Event | A downtime event was not created. |
| Event Created | A downtime event was created when the "Bad Data - 24 hr CMS" option was chosen on the Autolog display. |
| Event Updated | An existing event was extended when the "Bad Data - 24 hr CMS" option was chosen on the Autolog display for the next mill day. |

Calc (A*8.34*B/1000000)

Type: Equation

Calculates the MeOH quantity (Lbs) from the MeOH concentration (A in ppm) and the condensate collection total (B in gals).

ManualUpdate

Type: Stored Procedure—spLocal_ManualUpdate

This procedure uses one input and one dependent variable. This procedure performs a signal selection between a manually entered (dependent variable) value and another variable (the input). If the dependant variable value (the manually entered value) is NULL, the output is the value of the input variable. Otherwise, the output is set to the value of the dependant variable. The triggers for this procedure are time (based on the sample interval for the variable), value change for the dependant variable or value change for the input variable.

Fixed or LAB MeOH Conc

Type: Stored Procedure—spLocal_MeOHConcSelect

This procedure selects the correct MeOH concentration value, Fixed MeOH Conc or Daily—LAB MeOH Conc based on the value of the pulldown selector, Concentration Method.

GetMeOHLabData

Type: Stored Procedure—spLocal_GetMeOHLabData

This procedure returns the last value for LAB MeOH Conc. Test Result, from the previous 24-hour period.

Uptime (Daily)

Type: Equation

Calculates the daily uptime in minutes (Condensate Daily UpTime) from the daily downtime received from PI (Condensate Daily Downtime)

Lower Warning Spec Limit

Type: Equation

Returns the lower warning specification limit of the specified input variable.

Lower User Spec Limit

Type: Equation

Returns the lower User specification limit of the specified input variable.

Calc (A/B)

Type: Equation

Returns quotient of the two inputs, A and B.

AutoLog Displays

THIS IS THE BEGINNING OF lvhc hvlc

The purpose of this document is to describe the design of the record keeping and reporting system for the collection and destruction of Low Volume/High Concentration (LVHC) and High Volume/Low Concentration (HVLC) gases. The software is comprised of PI Data Archive software (which is used for automatic data collection from various process instrumentation and control systems) and Proficy software (which uses the data collected by PI in conjunction with manual inputs and business rules to monitor and report on the performance of the LVHC/HVLC collection and destruction system). This documentation is directed toward system administrator level personnel.

The following sections describe the general configuration of the standard LVHC/HVLC monitoring system. Deviations from the standard model, configuration listings for specific areas, and mill-specific details are contained in the appendices.

Low Volume/High Concentration (LVHC) and High Volume/Low Concentration gases from regulated sources (e.g., blow tanks, blow heat recovery, turpentine system, stripper off gas, diffusion washers, etc.) are collected by a closed vent system and treated by incineration in one or more of the following systems:

(a) Thermal oxidizer (incinerator), (b) Power Boiler, (c) Lime Kiln, or (d) Flare.

The Proficy system is used to track both Excess Emission (EE) and Continuous Monitoring System (CMS) DOWNTIME events. Excess emission events occur whenever

TABLE 15

Main Tank Compliance

| Unit | Variable | Title Text |
|---|---|---|
| | | Mill Day |
| Reporting Unit | Mill Day | |
| | | Pulp Production |
| Main Tank Compliance | Daily - PI Pine Digester Tons | |
| Kamyr Chip Meter Data Quality | Daily - PI Pine Chip Meter % Good | |
| Main Tank Compliance | Daily - Manual Pine Digester Tons | |
| Main Tank Compliance | Daily - Manual Hwd Digester Tons | |
| Main Tank Compliance | Daily - Total Digester Tons | |
| | | MeOH Concentration |
| Main Tank Compliance | Daily - LAB MeOH Conc | |
| Main Tank Compliance | Fixed MeOH Conc | |
| Main Tank Compliance | Concentration Method | |
| Main Tank Compliance | Daily - Manual MeOH Conc | |
| Main Tank Compliance | Daily - MeOH Conc Used for Avg | |
| | | MeOH Collection |
| Main Tank Compliance | Daily - PI Main Tank Totalized Flow | |
| Main Tank Compliance | Daily - PI Main Tank Flow Meter % Good | |
| Main Tank Compliance | Daily - Manual Main Tank Totalized Flow | |
| Main Tank Compliance | Daily - MeOH Collected | |
| Main Tank Compliance | Daily - MeOH Avg | |
| | | 15 Day Averages |
| Main Tank Compliance | 15 Day - MeOH Collected | |
| Main Tank Compliance | 15 Day - Digester Tons | |
| Main Tank Compliance | 15 Day - MeOH Avg | |
| Main Tank Compliance | 15 Day - Avg Start Time | |
| Main Tank Compliance | 15 Day - Avg End Time | |
| Condensate Event (CMS) | Condensate Collection Data Quality (CMS) | |
| | | Reporting |
| Reporting Unit | Down Time | |
| Reporting Unit | Running Time | |

LVHC/HVLC gases (also referred to as Non-Condensable Gases) are vented to the atmosphere, when gases are inadequately treated, and when no destruction device is operating while gases are being produced. PI monitors the state of each potential emission source (e.g., vent valves, rupture disks, relief valves, loop seals, etc.) while accounting for the area's Potential to Emit status and triggers Proficy to record an event anytime gases are vented. The recorded event includes the event start time, end time and duration.[12]

[12] As required by 40CFR §63.10(c). The regulations provide a non-SSM excess emissions allowance of 1% of operating time for the reporting period for LVHC systems before a violation is recorded (4% for HVLC systems) as stated in §63.443 (e).

PI tags also monitor the state of all destruction devices. The PI tags trigger instantaneous excess emission events in Proficy whenever any individual destruction device stops operating while regulated gas is directed to it (as determined by mill-specific process input signals). Destruction device excess emissions are recorded by the system whenever

- a thermal oxidizer is in use and the monitored parameter(s) fail to meet the required standard, or
  [13] Thermal-oxidizer monitoring requirements are contained in 40 CFR §63.453(b) and §63.443(d)1-3.
- no destruction device is operating while regulated gases are being produced.

The Proficy system also captures and records failures (downtime) of Continuous Monitoring System (CMS) devices, referred to as CMS events. LVHC/HVLC CMS events are created only for applicable destruction devices (thermal oxidizers) and only when the device is in use as a destruction device. The system records failures whenever the data signal

- is suspect (out of a specified data quality range or flat-lined),
- cannot be determined due to signal malfunction, or
- is unavailable due to maintenance calibration.

The CMS events are summarized individually for each applicable control device and reported separately to the state in a semi-annual CMS performance report or more frequently as required.

The Proficy software logs all excess emission and CMS events and operator responses to those events. The responses record the operator determined Trouble, Cause, Correction (response), and Report Code (report categorization) for the event. The report categorization specifies if the event is considered an allowable excess emission or CMS occurrence as the event may be allowed due to Startup, Shutdown, and Malfunction (SSM) provisions. The events for LVHC collection/treatment and HVLC collection/treatment are compiled separately by the system and reported separately to the state regulatory agency on a semi-annual basis or more frequently as required.

The PI system also calculates and makes available to Proficy a "Daily Down Time" which is the time that the processes capable of producing regulated HAPs are not operating. Proficy, in turn calculates the process uptime. The total Daily Uptime for the reporting period becomes the denominator in determining if the mill has exceeded the excess emission allowance for the reporting period.

Additionally, the PI system calculates the time each day that each LVHC CMS device (thermal oxidizer) is not used to treat gases (Daily Downtime). Proficy uses this daily calculation to calculate the thermal oxidizer uptime, which becomes the denominator in determining if the mill has exceeded the CMS allowance for the reporting period.[14]

[14] As required by 40CFR §63.454(b)(11)-(12) and §63.10(c)-(e). HVLC and LVHC CMS downtime is calculated and reported as a percentage of source runtime.

Events and TCC answers are recorded within the Proficy system. On a periodic or scheduled basis, mill environmental personnel can run reports listing the events (start time, end time, and duration) and their TCC answers, summarizing the total duration of all events by specific report code, and calculating excess emissions and CMS downtime against the allowances. The reports are run from Microsoft Excel using an Excel VBA add-in specifically written and designed to generate environmental reports which meet the regulatory reporting requirements.[15]

[15] The regulatory record keeping and reporting requirements are codified in 40 CFR §63.6(e)(3), §63.8(c)(1), and §63.10.

For HVLC and LVHC reporting simultaneous excess emission events answered with different report codes are allotted time in the report summaries according to the following report hierarchy:[16]

[16] The report code hierarchy is from top to bottom; that is, if one event is categorized Other Known Causes and a simultaneous event is categorized Process Problems, the event time is allocated and summarized as towards Other Known Causes.

1. Other Unknown Causes
2. Other Known Causes
3. Process Problems
4. Control Equipment Problems
5. Startup/Shutdown Additionally a sixth report code, No Excess Emission, eliminates an event from inclusion in the report categorization hierarchy and indicates that the event was recorded by the system in error. When this report code is utilized, the user must have appropriate documentation that the event was created in error and that no excess emission occurred. The single event will be excluded from the report summarization but concurrent events, either unanswered or with different report codes will be included in the report summary.

For excess emission events that contain incomplete or missing TCC answers, the report system allocates the event time to either Other Unknown Causes (in the case that there was no simultaneous event answered) or to the report code category of simultaneous events following the hierarchy above.[17]

[17] When the only existing simultaneous event is answered No Excess Emission, the unanswered event is categorized as Other Unknown Causes for the purposes of report code summarization.

For HVLC and LVHC reporting, simultaneous CMS events answered with different report codes are allotted time according to the following report hierarchy:

1. Other Unknown Causes
2. Other Known Causes
3. Monitor Equipment Malfunctions
4. Non-Monitor Equipment Malfunctions
5. QA/QC Calibrations Additionally a sixth report code, No Monitor Downtime, eliminates an event from inclusion in the report categorization hierarchy and indicates that the event was recorded by the system in error. When this report code is utilized, the user must have appropriate documentation that the event was created in error and that monitoring of the thermal oxidizer was maintained. Unanswered events (or events with incomplete answers resulting in a missing report code) are categorized as Other Unknown Causes from a report summarization standpoint.

Tables-16, 17, & 18 give PI tag naming conventions and description for typical variables used in the standard model.

TABLE 16

Typical Emission Source PI Tags

| Tag Format | Description |
|---|---|
| CR-millarea.STAT | Running/NotRunning status of mill area. |
| CR-millarea_PTE.STAT | Indicates when a mill area is capable of producing regulated gases. |
| Ventvalve.PV<br>MainValve.PV | An emissions point device state indicator such as a vent valve position. |
| CR-devicename.Vent<br>CR-Main.Vent<br>CR-Rupture.Vent | EE event trigger sent to Proficy. |

TABLE 17

Typical Destruction Device PI Tags

| Tag Format | Description |
|---|---|
| CR-destdevice.TREAT | Indicates when the destruction device is operating and that regulated gases are being directed to a given destruction device. |
| CR-LVHC.TREAT (or CR-HVLC.TREAT) | Indicates when at least one destruction device in the LVHC (or HVLC) system is treating. |
| CR-destdevice.EE | Destruction device EE event trigger sent to Proficy. |
| CR-destdevice.DQ | Indicates when the destruction device status cannot be confirmed. This is the CMS downtime event trigger monitored by Proficy. |
| CR-destdeviceDown.Day | Calculates total time for previous mill day that the destruction device was not treating gases. |

TABLE 18

Reporting PI Tags

| Tag Format | Description |
|---|---|
| CR-HVLC_PTE.STAT | Outputs "CanEmit" when any one HVLC area has a PTE value of "CanEmit" |
| CR-LVHC_PTE.STAT | Outputs "CanEmit" when any one LVHC area has a PTE value of "CanEmit" |
| CR-HVLC_Down.Day | Daily minutes of time when the HVLC system is in a "CanNotEmit" state. |
| CR-LVHC_Down.Day | Daily minutes of time when the LVHC system is in a "CanNotEmit" state. |

The following sections describe in detail how the Proficy /LVHC/HVLC model triggers EE and CMS events.

Mill Area State—PTE

Each area that produces regulated gases has a potential to emit (PTE) performance equation tag in PI. The performance equation logic returns a state of "CanEmit" when HAPS are present, and can potentially be emitted when a vent valve is opened. This is normally during the period from startup of the area until a mill specified period after the area stops running, and regulated gases have been cleared from all areas of the system. The area PTE state is calculated each minute based upon mill specified, site specific criteria such as flow, motor running state or pump running state.

Figure 2B:
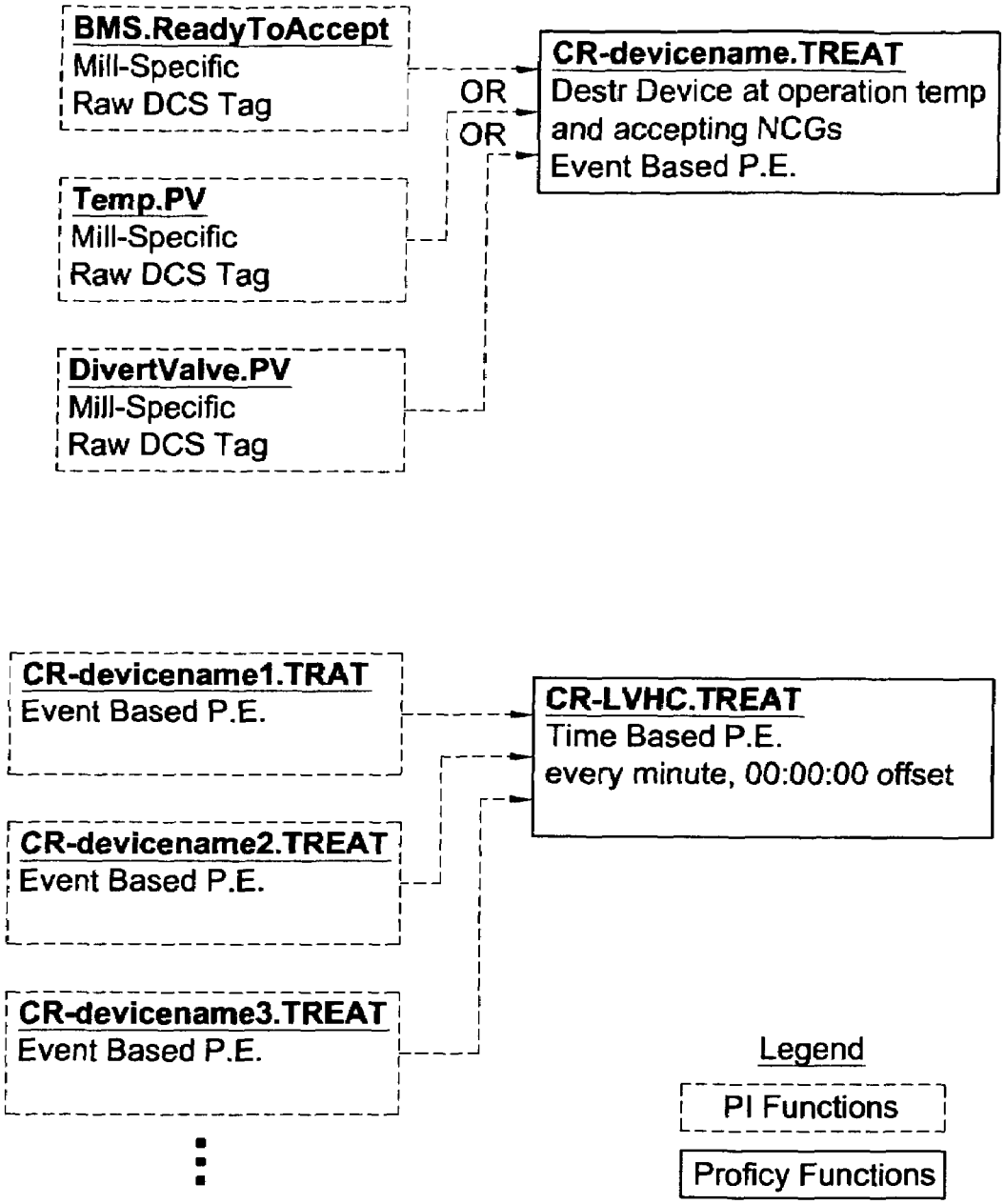

A block diagram of potential to emit and daily downtime/uptime data flow is depicted in FIG. 2A-*b*.

Vent Source EE

For each mill area that can produce regulated gases, PI receives raw DCS states for all of the possible emission points. Generally these are digital tags that give the state of the valve (open or closed) or rupture disk (if the source is a modulating valve, PI receives an analog value from the DCS that represents % open). An event-based performance equation, CR-devicename.VENT, determines when an emission point is venting to the atmosphere while the mill area has a potential to emit. This PI performance equation returns a value of "Vent" or "NotVent."

Vent Source EE events are created by Proficy using the Proficy downtime model 200. Proficy monitors the digital tag, CR-devicename.VENT, for the fault value of "Vent". Whenever the value enters the fault state (or remains in the fault state for a period longer than a specified filter time), an EE event is recorded by the system.

A block diagram of the vent data flow is depicted in FIGS. 2C-*a* and 2C-b.

Main Vent Filtering (Optional)

Main vent filtering is an additional configuration to each ".Vent" tag that attempts to reduce the number of events that operators must answer when a system-wide event occurs. All upstream vents points are filtered out in PI whenever the Main Vent tag has a value of "Vent." The main vent is defined as the last vent before the gases are routed to the destruction devices (vents at the destruction devices are not main vents).

A PI performance equation, CR-MainVent.Filt, outputs "Venting" when the main vent is "Venting" and continues to output "Venting" for a mill determined time after the main vent returns to "NotVenting." This delay is intended to give operators time to close the upstream vents after they have closed the main vent. Each upstream vent tag is set to "NotVenting" whenever the CR-MainVent.Filt tag has the value of "Venting".

Destruction Device Treating LVHC/HVLC Gases and EE

For destruction devices, a PI performance equation, CR-devicename.TREAT, determines if the device is accepting gases by verifying the correct operating conditions (operating flow, motor running, operating pressure or operating temperature), and that the appropriate valves are in position for LVHC/HVLC gases to be directed to the device. For thermal oxidizer devices (incinerators), where a burner management system (BMS) is connected to PI, the preferred running indicator is the BMS "Ready to Accept Gases" tag. The destruction device treating status is required for thermal oxidizer devices to determine running time for the CMS device on the reports. For other types of destruction devices, the device treating status is for other purposes. A block diagram of destruction device treatment status data flow is depicted in FIG. 2B. For thermal oxidizer destruction devices, another performance equation, CR-destdevice.EE, returns the digital state "EE" whenever the PI logic determines that the device is not properly destroying HAPS while gases are being sent to it; otherwise the equation returns the value "OK". This tag triggers an EE event when the flame temperature is less than the minimum acceptable temperature, there is the potential to emit, and the device is accepting gases. Proficy monitors this tag using the Proficy downtime model 200. If the fault state of "EE" is detected (or remains for a period longer than a specified filter time) an EE event is triggered. A block diagram of destruction device EE and CMS data flow is depicted in FIG. 2D-*a*.

Destruction Device CMS

Mills that utilize a thermal oxidizer as a destruction device for LVHC/HVLC gases must monitor the temperature of the incinerator and report CMS downtime whenever the incinerator is in use and the flame temperature sensor can not be read by PI. A PI performance equation, CR-devicename.DQ, calculates the value "Bad" when the temperature is out of range, or is in an error state, and the incinerator is selected for treatment; otherwise the value "Good" is calculated.

Proficy uses the Proficy downtime model 200 to monitor CR-devicename.DQ for the fault state, "Bad". Whenever the PI tag value "Bad" is detected (or remains for a period longer than a specified filter time), a CMS event is recorded by the system.

A block diagram of destruction device EE and CMS data flow is depicted in FIG. 2D-*a*.

CMS Runtime Counter

At the start of each mill day, a PI performance equation, CR-Incin_Down.Day, totals the "NotTreating" time for CR-Incin.TREAT over the previous 24-hour period. This value is read by Proficy and is used for both the daily display and daily calculation of Incinerator runtime ("Treating" for the daily period). The daily runtime minutes are kept in Proficy and used to compute the total incinerator treating runtime minutes for the reporting period.

LVHC/HVLC PTE Downtime Counter

Every minute, a PI performance equation, CR-LVHC_PTE.STAT/CR-HVLC_PTE.STAT, looks at each mill area PTE tag, CR-millarea_PTE.STAT. If any one mill area tag has a value of "CanEmit", the equation returns the digital state "CanEmit". If all of the mill area tags have a value of "CanNotEmit", the equation returns the digital state "CanNotEmit". At the start of each mill day, another PI performance equation, CR-LVHC_Down.Day/CR-VLC_Down.Day, totals the "CanNotEmit" time for CR-LVHC_PTE.STAT/CR-HVLC_PTE.STAT over the previous 24-hour period. This value is read by Proficy and is used for both the daily display and daily calculation of LVHC/HVLC runtime ("CanEmit" for the daily period). The daily runtime minutes are kept in Proficy and used to compute the total runtime minutes for the reporting period.

A block diagram of potential to emit and daily downtime/uptime data flow is depicted in FIG. 2A-*b*.

Tag Name Specifications

All Cluster Rule PI tags will begin with "CR-".

Digital State Set Specifications

The following are the minimum required digital state sets in PI to support the Cluster Rule LVHC/HVLC model.

| Digital Set Name | State 0 | State 1 |
|---|---|---|
| P2Emit | CanEmit | CanNotEmit |
| OK-EE | OK | EE |
| GOOD-BAD | Good | Bad |
| VENT-NOTVENT | Vent | NotVent |
| Running | Running | NotRunning |
| TREATING | Treating | NotTreating |
| ACCEPTING | Accepting | NotAccepting |

Scan Class Specifications

The following scan classes must be available in PI. Note, the scan class number will vary from mill to mill.

1. A one minute scan class offset 0 seconds from midnight;
2. A twenty-four hour scan class offset to the start of mill day.

Examples of the scan class syntax are as follows

1. /f=00:01:00, 00:00:00 (alternately /f=00:01:00, 0)
2. /f=24:00:00, 07:00:00 (alternately /f=24:00:00, 25200) for mill day at 07:00 am PI Tag Configuration Specification Tables 19 and 20 provide tag configuration examples for a typical LVHC/HVLC model. Table 21 contains exception and compression statistic requirements for underlying DCS PI tags.

TABLE 19

Typical PI Tag Configuration

| Tag Name/Descriptor | Comments | Exdesc |
|---|---|---|
| | | Area + LVHC Statuses |
| CR-millarea.STAT[18] Mill Area running status (e.g. Evap, Dig, etc. running status) | Extremely mill-dependent (and area dependent) | If ('flow.PV'<lowflowlimit . . . ) then "NotRunning" else "Running" |
| CR-millarea_PTE.STAT Mill Area potential to emit status | CanEmit if the area is running, producing HAPS, or has been running, and has not yet purged all HAPS from the system. | If BadVal(TimeEq('CR-millarea.STAT','*-delaytime','*','Running')) then PrevVal('CR-millarea_PTE.STAT', '*-delaytime') else if TimeEq('CR-millarea.STAT', '*-delaytime', '*','Running')>0 then "CanEmit" else "CanNotEmit" |
| CR-LVHC_PTE.STAT LVHC System PTE Status | CanEmit if any one LVHC production area is in the CanEmit state. | If ('CR-MillArea$_1$_PTE.STAT' = "CanNotEmit" and 'CR-MillArea$_2$_PTE.STAT' = "CanNotEmit" and . . . and 'CR-MillArea$_n$_PTE.STAT' = "CanNotEmit") then "CanNotEmit" else "CanEmit" |
| | | Treatment Device Status |
| CR-destdevice.TREAT[1] Destruction Device treating status (for incinerator, lime kiln, power boiler, etc.) | Treating if the thermo-oxidizer device is at operating temperature, and is accepting NCG gases. | Event=BMS.ReadyToAccept,(If (BMS.ReadyToAccept <>"Ready") then "NotTreating" else "Treating")<br>-- or you can use the following if you do not have a Burner Management System (BMS)--<br>Event=temp.PV,(If ('temp.PV'<=lowtemplimit . . . )then "NotTreating" else "Treating")<br>-- or you can use the following --<br>Event= divertValve.PV ,(If ('divertValve.PV' = "Open") then "Treating" else "NotTreating") |
| CR-LVHC.TREAT Some Destruction Device in the LVHC System is Treating NCGs | Treating if any one LVHC treatment device is Treating.<br>This is optional and for display only. | If (CR-destdevice$_1$.TREAT="Treating") or (CR-destdevice$_2$.TREAT = "Treating") or (CR-destdevice$_3$.TREAT = "Treating") then "Treating" else "NotTreating" |

TABLE 19-continued

| Tag Name/Descriptor | Comments | Exdesc |
|---|---|---|
| | | Typical PI Tag Configuration |
| | | Venting-Main & Regular |
| CR-devicename.Vent[19,4] DeviceName venting EE for Regular Vent | Vent if vent device is open to the atmosphere, there is a potential to emit in that LVHC area, and at least one LVHC treatment device is Treating. | Event= divertValve.PV,(If ('CR-millarea__PTE.STAT' = "CanNotEmit") or ('CR-MainVent.FILT'="Venting") then "NotVent" else if ('divertValve.PV' = "Closed") then "NotVent" else "Vent")<br>---or for non-isolated area ---<br>Event= VentValve.PV, (If ('CR-LVHC__PTE.STAT' = "CanNotEmit") or ('CR-MainVent.FILT'="Venting") then "NotVent" else if ('VentValve.PV' = "Closed") then "NotVent" else "Vent") |
| CR-Main.Vent Main Vent Location Venting | Vent if the main NCG vent is open to the atmosphere, and there is a potential to emit | Event= MainVent.PV, (If ('CR-LVHC__PTE.STAT' = "CanNotEmit") then "NotVent" else if ('MainVent.PV' = "Closed") then "NotVent" else "Vent") |
| CR-MainVent.FILT Main Vent Location Venting extended | Extend Vent for mill-specified time so that operators can close vents upstream of the main vent after the main vent is closed. This does NOT extend the recorded event. Optional. | event=CR-Main.Vent,if 'CR-Main.Vent'="Venting" then "Venting" else if TimeEq('CR-Main.Vent','*-delaytime','*','NotVenting')<delaytime in sec then "Venting" else "NotVenting" |
| CR-Rupture.Vent Rupture Disk | Same as device.Vent | Typically the same as CR-devicename.Vent (except that the logic must take into account that the pressure differential may not return after a Rupture disk breaks) |
| | | Dest Device Vent (low Temp) |
| CR-destdevice.EE Destruction Device Excess Emission (for incinerator, lime kiln, power boiler, etc.) | EE if LVHC treatment device is accepting NCG gases, and there is potential to emit, but the flame temperature is less than the minimum required to sufficiently destroy HAPS. | Event=temp.PV, (If ('CR-LVHC__PTE.STAT' = "CanNotEmit") or ('CR-destdevice.TREAT'="NotTreating") then "OK" else if ('temp.PV >= 'temp.TARGET') then "OK" else "EE") |
| | | Incinerator CMS |
| CR-destdevice.DQ[20,21,4] Destruction Device CMS | Bad if you cannot measure the incinerator flame temperature due to instrumentation or data collection problems (detected by a flame temp. reading either BAD or outside of the reasonable instrument range.) | Event= temp.PV ,(If (CR-destdevice.TREAT<>"Treating") then "Good" else if (TagMax('temp.PV','*−3h','*')−TagMin('temp.PV','*−3h','*') > 0) and ('temp.PV'>=lowlowtemplimit) and ('temp.PV'<=highhightemplimit) then "Good" else "Bad") |
| | | Daily Down Minutes |
| CR-LVHC__Down.Day Daily LVHC Downtime | Total minutes in the CanNotEmit state for yesterdays operating day. | TimeEq('CR-LVHC__PTE. STAT','Y+7H','T+7H','CanNotEmit')/60[5,22] |
| CR-Incin__Down.Day Daily Incinerator Not Treating Time | Total minutes in the NotTreating state for yesterday's operating day | TimeEq('CR-Incin.TREAT', 'Y+7H','T+7H','NotTreating')/60[5] |

[18]Define logic so that else "Running" (or "Treating") is the final clause, so that any error conditions will result in a default value of "Running" (or "Treating")
[19]Define logic so that (else "Vent") is the final clause, so that any error conditions will result in a default value of "Vent"
[20]Define logic so that (else "Bad") is the final clause, so that any error conditions will result in a default value of "Bad".
[21]Where possible, use event scheduled PE tags for EE and DQ tags. This will help guarantee that PE calculations are performed shortly after the underlying process values change. For time based PE tags, take care in assigning scan classes so that undue delays are not incurred waiting for multiple passes through the PE scans.
[22]Y+7H refers to 7:00 AM Yesterday & T+7H refers to 7:00 AM today (used when the mill start of day = 7:00)

TABLE 20

| Tag Name | engunits | point-source | Pointtype | DigitalSet | Location 4 | compdev | compressing |
|---|---|---|---|---|---|---|---|
| CR-millarea.STAT | Running/NotRunning | C | Digital | Running | 1 | Mill std | 1 |
| CR-millarea__PTE.STAT | CanEmit/CanNotEmit | C | Digital | P2EMIT | 1 | Mill std | 1 |
| CR-LVHC__PTE.STAT | CanEmit/CanNotEmit | C | Digital | P2EMIT | 1 | 0 | 1 |
| CR-destdevice.TREAT | Treating | C | Digital | Treating | 1 | 0 | 1 |
| CR-LVHC.TREAT | Treating | C | Digital | Treating | 1 | 0 | 1 |

TABLE 20-continued

| | | | | | | | |
|---|---|---|---|---|---|---|---|
| CR-devicename.Vent | Vent/NotVent | C | Digital | Vent/NotVent | 1 | 0 | 1 |
| CR-Main.Vent | Vent/NotVent | C | Digital | Vent/NotVent | 1 | 0 | 1 |
| CR-MainVent.FILT | Vent/NotVent | C | Digital | Vent/NotVent | 1 | 0 | 1 |
| CR-Rupture.Vent | Vent/NotVent | C | Digital | Vent/NotVent | 1 | 0 | 1 |
| CR-destdevice.EE | EE-OK | C | Digital | EE-OK | 1 | 0 | 1 |
| CR-destdevice.DQ | Bad/Good | C | Digital | Bad-Good | 1 | 0 | 1 |
| CR-LVHC__Down.Day | Min/Day | C | Float32 | | 4 | 0 | 1 |
| CR-Inicn__Down.Day | Min/Day | C | Float32 | | 4 | 0 | 1 |

| Tag Name | CompMax | excdev | excmax | shutdown | step | zero | span |
|---|---|---|---|---|---|---|---|
| CR-millarea.STAT | Mill Std | Mill std | Mill std | 1 | 1 | | |
| CR-millarea__PTE.STAT | Mill std | Mill std | Mill std | 1 | 1 | | |
| CR-LVHC__PTE.STAT | 28800 | 0 | 60 | 1 | 1 | | |
| CR-destdevice.TREAT | 28800 | 0 | 60 | 1 | 1 | | |
| CR-LVHC.TREAT | 28800 | 0 | 60 | 1 | 1 | | |
| CR-devicename.Vent | 28800 | 0 | 60 | 1 | 1 | | |
| CR-Main.Vent | 28800 | 0 | 60 | 1 | 1 | | |
| CR-MainVent.FILT | 28800 | 0 | 60 | 1 | 1 | | |
| CR-Rupture.Vent | 28800 | 0 | 60 | 1 | 1 | | |
| CR-destdevice.EE | 28800 | 0 | 60 | 1 | 1 | | |
| CR-destdevice.DQ | 28800 | 0 | 60 | 1 | 1 | | |
| CR-LVHC__Down.Day | 7200 | 1 | 60 | 0 | 1 | 0 | 1440 |
| CR-Inicn__Down.Day | 7200 | 1 | 60 | 0 | 1 | 0 | 1440 |

TABLE 21

| Tag Name | Descriptor | Point-type | compdev | compressing | CompMax | excdev | excMax |
|---|---|---|---|---|---|---|---|
| Vent.PV | Source (DCS) vent tag | Digital | Mill std | 1 | Mill Std | Mill std | 60 |
| Temp.PV | Incinerator Source (DCS) tag | Float32 | Mill std | 1 | <=3600 | Millstd | 60 |

1. VI. Standard Proficy Model

The Proficy model consists of input variables (PI inputs), calculated variables and equations. Variables for a standard LVHC/HVLC collection system and descriptions of EE and CMS event logic are included below.

TABLE 22

PI Interface Proficy Vaiables

| Variable | Data Type | Precision | Sampling Interval | Sampling Offset | Sampling Window | Sampling Type | PI Tag |
|---|---|---|---|---|---|---|---|
| Down Time | Integer | | 1440 | 420[1] | 15 | Last Good Value | CR-LVHC__Down.Day |
| Down Time | Integer | | 1440 | 420 | 15 | Last Good Value | CR-HVLC__Down.Day |
| Down Time | Integer | | 1440 | 420 | 15 | Last Good Value | CR-Incin__Down.Day |

[1]The sampling offset is determined based upon the mill Start of Day time. The offset value is the number of minutes from midnight to the mill start of day. In this example the start of day is 7:00 AM (as there are 420 minutes from midnight until 7:00 AM).

Calculation Manager Proficy Variables

| Variable | Data Type | Precision | Sampling Interval | Sampling Offset | Calc. Type | Calc. Name |
|---|---|---|---|---|---|---|
| Running Time | Integer | | 1440 | 420 | Equation | Uptime (Daily) |
| Running Time | Integer | | 1440 | 420 | Equation | Uptime (Daily) |
| Running Time | Integer | | 1440 | 420 | Equation | Uptime (Daily) |

EE Event Logic

Emission source EE events are generated whenever a vent valve, rupture disk or other valve type opens to the atmosphere while the gas source(s) is operating as determined by PI. Likewise, destruction device EE events are generated whenever the device is not running and regulated gases are being directed to the device. Overlapping intervals from two or more EE events is counted as a single event for the duration of the overlap. Overlapping events are resolved at report creation by the report package and not by the Proficy or PI models. EE events are detected using downtime model-200, with an optional, mill specific delay filter.

CMS Event Logic

CMS downtime events are monitored only for particular destruction devices. Typically, the trigger is a PI tag that tests thermal oxidizer device temperature data quality. CMS events are detected using downtime model-200, with an optional, mill specific delay filter.

Include autologs and downtime event log description

Describe interaction between DCS/PI/Proficy as a part of the general overview. See Figures below.

The purpose of this document is to describe the design of the Continuous Monitoring System for foul-condensate treatment monitoring operations. Specifically, the design of the monitoring system for a Steam Stripper column adhering to the 92% compliance option, as specified in §63.446(e)3, is addressed by this document.

FIGS. 2D-*b* to 3C-b depict various steam stripper calculation data flows.

The software is comprised of PI Data Archive software (which is used for automatic data collection from various process instrumentation and control systems) and Proficy software (which monitors and reports compliance based on the PI data and operator inputs). This documentation is directed toward system administrator level personnel but can be used as a basic understanding of how the system works.

The following sections describe the general configuration of a standard steam stripper monitoring system following the 92% efficiency option. Deviations from the standard model, configuration listings for specific lines, and mill-specific details are contained within the appendices.

Foul condensate is collected in a central collection tank (also referred to as a Main Foul Condensate Collection Tank or Stripper Feed Tank) from sources such as digesters, evaporators, and turpentine systems. From this tank, the condensate is usually heated in a stripper condensate pre-heater heat exchanger using hot, stripped condensate, before being fed to the steam stripper column. Strippers that operate at a vacuum and low temperatures may not have a pre-heater.

Typically, low pressure steam is used to strip the MeOH out of the foul condensate however strippers can also use medium pressure steam, steam generated from a condensate re-boiler, or evaporator vapor to strip the MeOH from the condensate. The steam flow carries the vaporized MeOH out of the column to a reflux condenser that condenses most of the water vapor out of the MeOH/water vapor stream leaving the column. The concentrated MeOH vapor is often called stripper off gas (SOG). Hydrogen sulfide and other total reduced sulfur (TRS) compounds will be stripped along with the MeOH and are found in high concentrations in the SOG. The SOG is sent to an incinerator, boiler, or kiln where it is incinerated for disposal. The stripped condensate is collected in the bottom of the steam stripper and usually sent through the condensate preheater to heat the incoming condensate to within about 20° F. of the stripper column operating temperature. After exiting the pre-heater, the stripped condensate is either sent to a sewer or is used back in the process.

Most steam stripper pre-heaters are designed to heat the inlet condensate temperature to within 20° F. of the outlet stripped condensate temperature. If the feed temperature is colder than design, more steam is consumed to preheat the condensate in the column, leaving less steam to actually strip (e.g. reducing the effective stripping steam). In this case, the total stripping steam required to accomplish the same degree of methanol removal should be increased to offset the portion of applied steam needed to further heat the colder incoming condensate. In general, the main reason why the inlet and outlet temperature gap widens over time is due to fouling of the condensate pre-heater.

One of the treatment options for a steam stripper is to remove or strip 92% of the MeOH in the condensate entering the stripper. The efficiency of a steam stripper to remove MeOH correlates to the ratio of effective steam flow to condensate flow in the stripper. The minimum effective steam ratio to maintain a minimum 92% MeOH removal efficiency is established by the mill during a Performance Test and used as a lower limit to determine excess emissions events.

Typically, 0.2 lbs of low pressure steam is needed for stripping to achieve 92% methanol removal per pound of foul condensate. This ratio can be expressed as a percentage, such as 20%. For a given condensate flow, inlet temperature, and MeOH concentration; the steam to foul condensate feed flow ratio is fairly constant to achieve a specific methanol removal. Some of the steam fed to the stripping column is condensed to heat the incoming foul condensate to the boiling temperature at the stripper operating pressure. The heating occurs quickly in the first feed tray of the column. About 0.001 pound of steam is needed to heat 1 pound of condensate by 1° F., or about 0.02 pounds of steam (0.02%) to heat the foul condensate 20° F. The steam that is actually doing the work to strip the methanol out of the condensate is referred to as effective steam. Every 10° F. drop in feed temperature takes 1% off the effective steam flow ratio. The effect steam ratio needed to get greater than 92% removal is approximately 0.18.

Five parameters are required to compute the effective steam ratio, which includes the three parameters required by §63.453(g):

Foul Condensate Feed Flow, lbs/hr, (FCFF)

Stripper Steam Flow, lbs/hr, (SSF)

Stripper Bottom Temperature, degF, (SBT)

Foul Condensate Feed Temperature, degF,(FCFT)

Enthalpy of the condensing steam, Btu/lb, (H), τ 1000 BTU/lb, usually assumed as a constant.

Effective Steam Ratio (ESR) is computed as the ratio of effective steam flow divided by the foul condensate flow, or:

$$ESR = \frac{\text{Effective Steam Flow}}{\text{Foul } Cond \text{ Flow}} = \frac{SSF - ((FCFF \times (SBT - FCFT) \times (1\ \text{BTU/lb} - F))/H)}{FCFF}$$

For example, assuming:

| | |
|---|---|
| Stripper Steam Flow (SSF) = | 10,000 lb/hr |
| Foul Condensate Feed Flow (FCFF) = | 100 gpm (100 gpm × 500 lb/hr/gpm = 50,000 lb/hr) |
| Stripper Bottom Temp (SBT) = | 275° F. |
| Foul Condensate Feed Temp (FCFT) = | 255° F. |
| Enthalpy (H) = | 1000 BTU/lb (assumed constant) |

yields an effective steam ratio of $$ESR = \frac{10{,}000 - (((50{,}000 \times (275 - 225)) \times (1\ \text{BTU/lb} - {}^{\circ}\text{F}))/1000)}{} = \frac{9000\ \text{lb/hr}}{50{,}000\ \text{lb/hr}} = 0.18$$

As the effective steam flow ratio drops below its target, the operator can either increase steam flow to get the effective steam back up to its target level, or can reduce flow to the stripper at the same steam flow to restore the effective steam flow ratio target. The later method may result in slowing back production, or may risk sewering too much condensate per the collection requirements.

These variables are collected and archived by the PI system and made available to the Proficy system to analyze against specific criteria to determine if an Excess Emission (EE) event has occurred. Two types of excess emission events can occur during the operation of a 92% Steam Stripper system: a low 3-hour rolling average stripper efficiency event (3-hour rolling average excess emission event) and a stripper bypass event (stripper excess emission bypass event). Excess emission events for steam stripper treatment are recorded by the system whenever:

- the steam stripper has the potential to emit (PTE) pollutants (as defined in PI) and the three hour effective steam ratio average falls below the lower effective steam ratio limit (lower reject specification limit); or
- the condensate system sources are operating and the collection tank (stripper feed tank) overflows while the stripper is not running; or
- collected MeOH is diverted from steam stripper treatment, irrespective of whether the condensate sources and steam stripper are running or not.

The steam stripper system has a 10% allowance against condensate runtime for all excess emission events, as specified in §63.446(g).

The steam stripper treatment system has the potential to emit pollutants whenever the condensate sources are operating. Therefore the potential to emit runtime for the steam stripper system corresponds to the condensate collection operating time reported to the state regulatory agency on a semi-annual basis or more frequently as required.

The PI system computes an effective steam flow and effective steam ratio every minute (CR-SS_EFFSteam.Filt and CR-SS_ESRatio.Filt) from the four parameters above (using 1000 as an enthalpy constant). The effective steam flow calculation flow is clamped at zero in the PI tag (CR-SS_ESRATIO.RAW). Additionally every fifteen minutes the related PI tag (CR-SS_ESRatio.Filt) compute what percentage of time the data quality of the effective steam ratio was good over the fifteen minute interval.

The following table 22 gives an overview of the minimum required process inputs, their engineering units, associated PI tags, and corresponding Proficy variable names.

TABLE 22

| Input | Eng Units | PI Tagname | Proficy Variable |
|---|---|---|---|
| Steam Stripper Treating Status | Treating/Not Treating | CR-SS-TREAT.STAT | Steam Stripper Treating (Potential to Emit) Status (Snapshot) |
| Steam Stripper Numeric PTE Status | 0/100 | CR-SS__TREAT.NUM | Steam Stripper Treating Status - Numeric |
| Condensate System PTE Status | CanEmit/ CanNotEmit | CR-Cond-PTE.Stat | Condensate System Potential to Emit (Snapshot) |
| Daily Steam Stripper Not Treating minutes - calculated at mill end of day | Min/day | CR-SS__Treat.Day | Stripper Daily Downtime |
| Bottom Temperature | ° F. | CR-SS-BottomTemp.PV | N/A |
| Condensate Feed Temperature | ° F. | CR-SS-FeedTemp.PV | N/A |
| Condensate Feed Flow[23] | Lbs/hr | CR-SS-CondFlow.PV | N/A |
| Feed Steam Flow | Lbs/hr | CR-SS-FeedSteam.PV | N/A |
| Bottom Temperature Data % Good | % | CR-SS-BottomTemp.PctGd | Bottom Temperature 15 Min - % Good |
| Condensate Feed Temperature Data % Good | % | CR-SS-FeedTemp.PctGd | Feed Temperature 15 Min - % Good |
| Feed Steam Data % Good | % | CR-SS-FeedSteamFlow.PctGd | Feed Steam Flow 15 Min - % Good |
| Condenate Feed Flow Data % Good | % | CR-SS-CondFlow.PctGd | Condensate Flow 15 Min - % Good |
| Effective Steam Flow | Lbs/hr | CR-SS__EFFSTEAM.Filt | N/A |

TABLE 22-continued

| Input | Eng Units | PI Tagname | Proficy Variable |
|---|---|---|---|
| Effective Steam Flow clamped to 0 | Lbs/hr | CR-SS_ESRATIO.RAW | N/A |
| Steam Stripper Ratio | | CR-SS-ES_Ratio.Filt | Effective Steam Ratio 15 Min (Raw PI Avg) |
| Effective Steam Flow Data % Good | % | CR-SS-ES_Ratio.PctGd | Effective Steam Ratio 15 min - % Good (CMS) |
| Stripper Divert Valve Indicator | EE/OK | CR-SS-DivertValve.EE | Stripper Bypass EE Event |
| Tank Overflow Indicator | EE/OK | CR-SS-TankOverflow.EE | Stripper Tank Overflow EE Event |

[23]To complete the effective steam ratio calculation Condensate Feed Flow must be expressed in lbs/hr. To convert condensate flow to lbs/hr, multiply the flow rate (in gal/min) by 8.35 * 60.

Data quality limits for the Bottom Temperature, Feed Temperature, Condensate Flow, and Steam Flow are maintained in PI. These data quality limits are used by a PI performance equation to determine if the PI process value has "Good" or "Bad" signal quality and contribute to the overall data quality of the Effective Steam Ratio calculation. Anytime that the data quality of the four parameters results in a failure of the system to reliably calculate an effective steam ratio for the fifteen minute interval, the system records a Continuous Monitoring System (CMS) event (explained in detail below).

The following sections describe in detail how the PI/Proficy steam stripper model computes effective steam and triggers Steam Stripper EE and CMS events.

a) Steam Stripper PTE and Total Runtime

In general, the steam stripper treatment system has a potential to emit pollutants whenever the condensate collection system or steam stripper column is operating. Specifically the steam stripper treatment system has three distinct potential to emit (PTE) conditions. First the steam stripper has potential to emit pollutants whenever it is operating (usually determined by a minimum flow on a flow meter and a "Running"/"NotRunning" indicator on the stripper). Under these conditions emissions occur whenever the 3 hour rolling average of stripper efficiency falls below 92%. Secondly steam stripper treatment emissions can occur whenever the condensate system is operating while the stripper is not operating. Under this condition overflows of the collection tank or foul condensate diverts upstream of the collection tank are considered steam stripper treatment excess emissions. Lastly emissions can occur if the foul condensate is present in the stripper feed tank (indicated by tank level) irrespective of stripper or condensate system operating status. In this case, emissions occur if the foul condensate is pumped out of the feed tank and towards a non-treated collection point (such as to sewer or through the column when steam is not present).

The steam stripper system has a 10% emission allowance against source (condensate collection) operating time for all types of emissions. The total number of runtime minutes used to calculate this emission allowance corresponds to the total number of runtime minutes for the condensate collection system over the same period of time.

The steam stripper is considered to be treating when the following three conditions are met:

Condensate Flow>minimum value (set by mill but not far from zero)

Steam Flow>minimum (set by mill; generally 1000 to 10000 lb/hr)

Bottom Temp>minimum treating limit (generally 212)

Each minute, the above conditions are monitored with the PI performance equation, CR-SS_Treat.Stat. This treating status is converted into a numeric value (0=NotTreating, I=Treating) in the tag, CR-SS_Treat.NUM. This PI tag is averaged every 15 minutes and every hour by Proficy (SS % Time Treating (15 min) and SS % Time Treating (1 Hr)) to determine the average treating status over the previous 15 minutes and one hour. Proficy then translates the numeric average into a treating status using VBScript (SS CMS Treating Status (15 min) and SS EE Treating status (1 Hr)). These average treating statuses are used to filter out EE and CMS events during NotTreating time periods.

On a daily basis, a PI tag (CR-SS_Treat.Day) computes the total number of minutes that the steam stripper was down during the previous production day. This value is used by Proficy to compute the daily total number of runtime minutes of the steam stripper system. These daily totals are used by the reporting system to compute the total number of steam stripper runtime minutes over the reporting period.

b) Computing the Effective Steam Ratio

The effective steam ratio is computed in PI each minute based upon the process data for the four process parameters above from the mill DCS system (and assuming a constant of 1000 for enthalpy). The raw value for each of the four parameters necessary to compute effective steam is first validated in PI against upper and lower specification limits (maintained in PI). If the value is within range (and not flat-lined), PI records the value into an intermediate variable (CR-SS-FeedSteam.FILT, CR-SS-CondFlow.FILT, CR-SS-BottomTemp.FILT, and CR-SS-CondTemp.FILT); if the value is out of range the intermediate variable records "Bad" instead. These PI performance equations are event based (calculated every time a new value enters the PI snapshot) so that data buffered in the PI interface will be captured and used regardless of its PI archive status. If all four process values exhibit good data quality, PI uses the intermediate values to compute an effective steam flow for the minute. PI stores this value in the PI tag CR-SS_EFFSTEAMFilt. It is possible for the effective steam flow calculation to have a negative result during times of stripper upsets. Since negative values are theoretically impossible and can cause long periods of low three hour averages, the PI tag, CR-SS_ESRATIO.RAW clamps the effective steam ratio to 0 whenever the tag CR-SS_EFFSTEAMFilt has a negative value. If all four process values exhibit good data quality, PI outputs the value from CR-SS_ESRATIO-.RAW to Proficy.

c) Steam Stripper CMS Events

When the steam stripper system is running, failures to calculate the effective steam ratio of the stripper result in Continuous Monitoring System (CMS) events. Every fifteen minutes, Proficy computes a time-weighted average of the effective steam ratio calculation (CR-SS-SS_Ratio.Filt) over the previous fifteen minutes and stores the value in the variable Effective Steam Ratio—15 Min PI Avg. At the same time Proficy examines the CR-SS_ESRatio.PctGd tag to determine if CR-SS_ESRatio.Filt maintained "Good" data quality during at least 50% of the fifteen-minute period. If so, the computed fifteen-minute average is copied into the Proficy variable Effective Steam—15 Min Qualified Avg. If any fifteen-minute period fails to meet the 50% criteria while the SS CMS Treating Status (15 min) value is Treating, Proficy instead creates a fifteen-minute steam stripper CMS downtime event (via a stored procedure calculation) for the period or it appends fifteen-minutes to an existing CMS event (if a contiguous CMS event already exists).

Every fifteen-minutes Proficy also reads and displays the data quality results (% Good) for each parameter required to complete the effective steam ratio calculation. These data-quality values assist the operator in determining which of the four signal(s) was (were) responsible if the effective steam ratio average could not be calculated (resulting in the CMS event). These values are displayed on the steam stripper display for diagnostic purposes but do not, by themselves, create CMS events.

The Proficy software logs all Steam Stripper CMS events and operator responses to those events. The responses record the operator determined Trouble, Cause, Correction (response), and Report Code (report categorization) of the event. The events are compiled, measured against the stripper operating time for the reporting period, and reported to the state regulatory agency on a semi-annual basis or more frequently as required.

d) Steam Stripper Excess Emission Events

Two types of excess emission events can occur during the operation of a 92% Steam Stripper system: a 3-hour rolling average excess emission event and a stripper bypass excess emission event.

13) 3-Hour Rolling Average Excess Emission Event

Once per hour, Proficy examines all fifteen-minute qualified averages (Effective Steam Ratio—15 Min Qualified Avg) during the previous three-hour period. If greater than 50% of the averages exist and have good data quality, Proficy computes a 3-hour rolling average effective steam ratio (Effective Steam Ratio—3 HR Avg.) from all fifteen minute averages exhibiting Good data quality. This computed three hour average is compared against a lower limit (lower specification warning limit on the Effective Steam—3 HR Avg. variable) and if the value falls below the limit and the SS EE Treating Status (1 Hr) value is Treating, Proficy creates a one-hour Excess Emission downtime event or, in the case that a previous contiguous excess emission event existed, it appends one-hour to the existing event (via a stored procedure calculation). The value is also written back to the PI tag CR-SS_ESRatio.3H for trending within the mill.

No manual entry of steam stripper effective steam ratio is available in the system.

The Proficy software logs all Steam Stripper Rolling Average EE events and operator responses to those events. The responses record the operator determined Trouble, Cause, Correction (response), and Report Code (report categorization) of the event. All report categorizations except No Excess Emission are totaled and reported to the state regulatory agency on a semi-annual basis, or more frequently as required, against the 10% steam stripper emission allowance.

14) Steam Stripper Excess Emission Bypass Events

In addition to 3-hour rolling average excess emission events, a steam stripper column also incurs excess emissions if condensate bypasses the stripper column prior to or without treatment while the condensate collection system is operating or during stripper downtime if previously collected condensate is diverted to a non-treated collection point (such as sewer).

The five types of PI calculations used to monitor steam stripper bypass excess emissions are described below. All of the following PI performance equations are evaluated at least once a minute and are monitored by the Proficy system using model 200 (with a mill specific filter applied). Proficy creates an (EE) event for each minute that the PI performance equations' value is E.

1. Main Collection Tank Overflow

When the tank level is greater than a maximum while the condensate system is operating and the stripper is not running, the performance equation records the minute as a steam stripper bypass excess emission.

2. Main Collection Tank Bypass Before Collection Boundary

When a bypass value located after the tank outlet and before the condensate collection boundary (flow meter) is open (bypassing) while the condensate system is operating and the stripper is not running, a performance equation records the minute as a steam stripper bypass excess emission.

3. Main Collection Tank Upstream Bypass

When the condensate system is operating, the stripper is not running, the main collection tank is not overflowing and all bypasses after the main collection tank outlet are not bypassing, a performance equation checks for any overflows or diverts upstream of the main collection tank. If any upstream diverts occur under the described conditions, the performance equation records the minute as a steam stripper bypass excess emission.

4. Main Collection Tank Bypass after collection boundary

When the stripper is not running, a PI performance equation examines the state of any bypass valves past the collection tank (flow meter) but prior to the stripper column to determine if collected condensate is being directed away from the steam stripper column, which is recorded as a steam stripper bypass excess emission.

5. Steam Stripper Feed without Steam Flow

When the condensate system is operating and the stripper is not running, a performance equation monitors the foul condensate feed flow to the column. If the condensate feed flow is greater than a minimum value, the performance equation records the minute as a steam stripper excess emission.

The Proficy software logs all Steam Stripper EE Bypass events and operator responses to those events. The responses record the operator determined Trouble, Cause, Correction (response), and Report Code (report categorization) of the event. The steam stripper system has a 10% allowance against the overall condensate system runtime period. Events categorized as No Excess Emission are excluded from this calculation however all other report codes are included in it. The events are compiled and reported to the state regulatory agency on a semi-annual basis or more frequently as required.

Should a bypass event occur simultaneously during the period when the steam stripper three-hour effective steam rolling average falls below the minimum effective steam limit, only one hour of excess emissions will be reported by the reporting system. That is, in any 24-hour period, there can be no more than 24 hours of total stream stripper excess emissions.

Table-23 gives the process inputs required for a typical steam stripper system, their engineering units, data source, and corresponding Proficy variable names.

TABLE 23

| Input Variables | | | | |
|---|---|---|---|---|
| Production Unit | Proficy Variable | Eng Units | Data Source | Description |
| SS Treatment Variables | Effective Steam Ratio (% Good) | % | PI | 15 min percent good effective steam ratio calculation |
| SS Treatment Variables | Effective Steam Ratio (Raw 15 M Avg) | ratio | PI | 15 min Avg of one minute PI calculated effective steam ratio. |
| SS Treatment Variables | Bottom Temperature 15 Min - % Good | % | PI | 15 min percent good of Bottom Temperature. Used for display only. |
| SS Treatment Variables | Feed Temperature 15 Min - % Good | % | PI | 15 min percent good of Cond Feed Temperature. Used for display only. |
| SS Treatment Variables | Cond Feed Flow 15 Min - % Good | % | PI | 15 min percent good of Condensate Feed Flow. Used for display only. |
| SS Treatment Variables | Feed Steam Flow 15 Min - % Good | % | PI | 15 min percent good of Feed Steam Flow. Used for display only. |
| Reporting Unit | Steam Stripper Treating Status (snapshot) | Treating/ NotTreating | PI | snapshot of SS Treating Status. Used for display only. |
| Reporting Unit | SS % Time Treating (15 min) | % | PI | 15 minute average of SS numeric treating status |
| Reporting Unit | SS % Time Treating (1 Hr) | % | PI | 1 hour average of SS numeric treating status |
| Reporting Unit | Condensate Daily Downtime | Min | PI | Condensate System process downtime (mins) |
| Reporting Unit | Stripper Daily Downtime | Min | PI | Steam Stripper system downtime (mins) |

Table-24 lists typical calculated variables for the system and a brief description of each.

TABLE 24

| Calculated Variables | | | |
|---|---|---|---|
| Production Unit | Proficy Variable | Eng Units | Description |
| SS Treatment Variables | Effective Steam Ratio 15 Min Avg | | Raw average of 15 min effective steam |
| SS Treatment Variables | Effective Steam Ratio 15 Min Avg (Status) | Status | Data quality status of 15 min average based on percent good over the 15 minute window. |
| SS Treatment Variables | Effective Steam Ratio 15 Min Avg/Status (Used for 3 Hr Avg) | Status | Qualified 15 minute average or the status if data quality criteria was not met. |
| SS Treatment Variables | Effective Steam Ratio 3 Hr Rolling Avg | | Rolling 3 hour average, calculated every hour, of 15 minute qualified averages. |
| SS Treatment Variables | Effective Steam Ratio 3 Hr Rolling Avg (Status) | Status | Status of 3 hour average ("OK", "Unit Down", "No PTE"). |
| SS Treatment Variables | Effective Steam Ratio Lower Limit | | Lower excess emission limit for 3 hour rolling average effective steam. This value is maintained as a Proficy Lower Warning Specification on the Effective Steam 3 Hr Rolling Avg variable. |
| Reporting Unit | SS CMS Treating Status (15 min) | Treating/ NotTreating | Treating status based on 15 min treating average. Used in 15 minute calculations and CMS event creation, |
| Reporting Unit | SS EE Treating Status (1 Hr) | Treating/ NotTreating | Treating status based on 1 hour treating average. Used in 3 hour calculations and EE event creation. |

e) Tag Name Specifications

All Cluster Rule Steam Stripper PI tags will begin with the prefix "CR-SS".

f) Digital State Set Specifications

The following are the minimum required digital state sets in PI to support the Cluster Rule Steam Stripper 92% model.

| Digital Set Name | State 0 | State 1 |
|---|---|---|
| P2Emit | CanEmit | CanNotEmit |
| OK-EE | OK | EE |
| GOOD-BAD | Good | Bad |
| RUN-STOP | Run | Stop |
| Treat | Treating | NotTreating |

g) Scan Class Specifications

The following scan classes must be available in PI. Note, the actual scan class number will vary by location.

A one minute scan class offset 0 seconds from midnight;

A fifteen minute scan class offset 0 seconds from midnight;

A twenty-four hour scan class offset to the start of mill day.

Examples of the scan class syntax is as follows

/f=00:01:00, 00:00:00 (alternately /f=00:01:00, 0)

/f=00:15:00, 00:00:00 (alternately /f=00:15:00, 0)

/f=24:00:00, 07:00:00 (alternately /f=24:00:00, 25200) for mill day at 07:00 am h) PI Tag Configuration Specification The following tables 25 to 29 provide the typical PI tags (and their configuration) required for a Steam Stripper Treatment system following the 92% treatment methodology and standard exception and compression attribute values for mill specific DCS PI tags.

TABLE 25

| Tag Name | Descriptor | exdesc |
|---|---|---|
| CR-SS__TREAT.STAT | Steam Stripper Treating Status | if 'CR-SS-CondFlow.PV' > LL and 'CR-SS-SteamFlow.PV' > LL and 'CR-SS-Bottom Temp.PV' > LL then "Treating" else "NotTreating" |
| CR-SS__TREAT.NUM | Numeric Steam Stripper | event=CR-SS__TREAT.STAT, if 'CR-SS__TREAT.STAT' <> "Treating" and 'CR-SS__TREAT.STAT' <> ="NotTreating" then PrevVal('CR-SS__TREAT.NUM', '*') else if 'CR-SS__TREAT.STAT' <> "Treating" then 0 else 100 |
| CR-Cond-PTE.STAT[24] | Condensate System Potential to Emit Status | |
| CR-SS-TREAT.Day | Steam Stripper Daily Not Treating | TimeEq('CR-SS__TREAT.STAT','Y+7H','T+7H',"CanNotEmit")/60 |
| CR-Cond-Down.Day | Condensate System Potential to Emit downtime/day | TimeEq('CR-Cond.STAT','Y+7H','T+7H',"CanNotEmit")/60 |
| CR-SS__Overflow.EE | SS Overflow Excess Emissions Status | if 'CR-SS__TREAT.STAT'="NotTreating" and 'CR-CONDSYS-PTE.STAT'="CanEmit" then (if 'TankLevel.PV' > HHL then "EE" else "OK") else "OK" |
| CR-SS__DivertValve.EE | SS Treatment Bypass EE Status | After Cond Coll Flow Meter<br>if 'CR-CONDSYS-PTE.STAT'="CanEmit" then (if 'DivertValve.PV' = "Open" then "EE" else "OK") else "OK"<br>Before Cond Coll Flow Meter<br>if 'CR-SS__TREAT.STAT'="NotTreating" and 'CR-CONDSYS-PTE.STAT'="CanEmit" then (if 'DivertValve.PV' = "Open" then "EE" else "OK") else "OK" |
| CR-SS__FlowEmissions.EE | Flow out of bottom of column EE Status | if 'CR-SS__TREAT.STAT' <> "Treating" and 'CR-SS-CondFlow.Filt' > min then "EE" else "OK" |
| CR-SS-Cond.Divert | Any upstream condensate divert | If 'CR-Valve1.Divert'="Divert" or 'CR-Level1.Divert'="Divert" or . . . then "Divert" else "Collect" |
| CR-SS__CondDvrt.EE | Upstream condensate divert EE Status | if 'CR-SS__TREAT.STAT'="NotTreating" and 'CR-CONDSYS-PTE.STAT'=∞CanEmit" and 'CR-SS__Overflow.EE'="OK" and 'CR-SS__DivertValve.EE'="OK" then if 'CR-SS-Cond.Divert'="Divert" then "EE" else "OK" |
| CR-SS-BottomTemp.Filt | SS Bottoms Temperature Filter | event=CR-SS-BottomTemp.PV, if (TagMax('CR-SS-BottomTemp.PV','*-3h','*')-TagMin('CR-SS-BottomTemp.PV','*-3h','*') > 0) and ('CR -SS-BottomTemp.PV' > LLL) and ('CR-SS-BottomTemp.PV' < HHL) then 'CR-SS-BottomTemp.PV' else "BAD" |
| CR-SS-FeedTemp.Filt | SS Condensate Feed Temperature Filter | event=CR-SS-FeedTemp.PV, if (TagMax('CR-SS-FeedTemp.PV','*-3h','*')-TagMin('CR-SS-FeedTemp.PV','*-3h','*') > 0) and ('CR-SS-FeedTemp.PV' > LLL) and ('CR-SS-FeedTemp.PV' < HHL) then 'CR-SS-FeedTemp.P' else "BAD" |
| CR-SS-FeedSteamFlow.Filt | SS Feed Steam Flow Filter | event=CR-SS-FeedSteam Flow.PV, if (TagMax('CR-SS-FeedSteamFlow.PV','*-3h','*')-TagMin('CR-SS-FeedSteamnFlow.PV','*-3h','*') > 0) and ('CR-SS-FeedSteamFlow.PV'> LLL) and ('CR-SS-FeedSteamFlow.PV' < HHL) then 'CR-SS-FeedSteamFlow.PV' else "BAD" |
| CR-SS-CondFlow.Filt[25] | SS Condendate Feed Flow Filter | event=CR-SS-CondFlow.PV, if(TagMax('CR-SS-CondFlow.PV','*-3h','*')-TagMin('CR-SS-CondFlow.PV','*-3h','*') > 0) and ('CR-SS-CondFlow.PV' > LLL) and ('CR-SS-CondFlow.PV' < HHL) then ('CR-SS-CondFlow.PV' * 8.35 * 60 / 1000) else "BAD" |
| CR-SS-BottomTemp.PctGd | SS Bottoms Temperature % Good | if BadVal(PctGood('CR-SS-BottomTemp.Filt', '*-15M', '*')) then 0 else PctGood('CR-SS-BottomTemp.Filt', '*-15M', '*') |
| CR-SS-FeedTemp.PctGd | SS Feed Temperature % Good | if BadVal(PctGood('CR-SS-FeedTemp.Filt', '*-15M', '*')) then 0 else PctGood('CR-SS-FeedTemp.Filt', '*-15', '*') |
| CR-SS-FeedSteamFlow.PctGd | SS Feed Steam Flow % Good | if BadVal(PctGood('CR-SS-FeedSteamFlow.Filt', '*-15M', '*')) then 0 else PctGood('CR-SS-FeedSteamFlow.Filt', '*-15M', '*') |
| CR-SS-CondFlow.PctGd | SS Condensate Feed Flow % Good | if BadVal(PctGood('CR-SS-CondFlow.Filt', '*-15M', '*')) then 0 else PctGood('CR-SS CondFlow.Filt', '*-15M', '*' |
| CR-SS-EffSteam.Filt | SS One Minute Effective Steam Filter | if Bad Val('CR-SS-BottomTemp.Filt')or BadVal('CR-SS-FeedTemp.Filt') or BadVal('CR-SS-CondFlow.Filt')orBadVal('CR-FeedSteamFlow.Filt') then "Bad" else ('CR-SS-FeedSteam.Filt' - (('CR-SS-BottomTemp.Filt' - 'CR-SS-FeedTemp.Filt')*'CR-SS-CondFlow.Filt'/1000)) |

TABLE 25-continued

| Tag Name | Descriptor | exdesc |
|---|---|---|
| CR-SS__ESRATIO.RAW | SS One Minute Eff Steam Ratio Raw Value | if 'CR-SS__EFFSTEAM.FILT'<0 or 'CR-SS__CondFlow.FILT'<0 then 0 else 'CR-SS__EFFSTEAM.FILT'/'CR-SS__CondFlow.FILT' |
| CR-SS__ESRatio.Filt | SS One Minute Effective Steam Ratio Filter | if Bad Val('CR-SS-BottomTemp.Filt')or Bad Val('CR-SS-FeedTemp.Filt')or BadVal('CR-SS-CondFlow.Filt')or BadVal('CR-FeedSteamFlow.Filt') then "Bad" else CR-SS__ESRATIO.RAW |
| CR-SS__ESRatio.PctGd | SS One Minute Effective Steam Ratio % Good | IfBad Val(If BadVal(PctGood('CR-SS__ESRatio.Filt', '*-15M', '*')) then 0 else PctGood('CR-SS__ESRatio.Filt', '*-15M', '*') |
| CR-SS-__ESRatio.15M | Effective Steam / Cond Flow 15 Min Avg | |
| CR-SS-__ESRatio.3H | Effective Steam / Cond Flow 3 Hr Avg | |
| CR-SS-__ESRatio.LL | Effective Steam / Cond Flow Lower Limit | |

[24]The Condensate PTE tag (CR-Cond-PTE.STAT) is available and displayed in the Condensate Collection system. A unique tag for Steam Stripper treatment is not required.
[25]This example assumes that the raw flow is expressed in M-gpm (1000's gal/min). Subsequent calculations require that the units of condensate flow (gpm) and feed steam rate (lbs/hr) match. To convert the condensate flow (in gpm) into lbs/hr, multiply the flow by 8.35*60. If flow is expressed in M-gpm, the conversion factor is further divided by 1000.

TABLE 26

| Tag Name | engunits | Point-source | point-type | Digital-Set | Loca-tion4 | comp-dev | com-pressing | Comp-Max | exc-dev | excmax | shut-down | step | zero | span |
|---|---|---|---|---|---|---|---|---|---|---|---|---|---|---|
| CR-SS__TREAT.STAT | Treating/ Not-Treating | C | Digital | TREAT | 1 | 0 | 1 | 28800 | 0 | 60 | 1 | 1 | | |
| CR-SS__TREAT.NUM | 0/100 | C | Float32 | | | 0 | 1 | 60 | 0 | 60 | 1 | 1 | 0 | 100 |
| CR-Cond-PTE.STAT | CanEmit/ CanNot-Emit | C | | | | | | | | | | | | |
| CR-SS__Treat.Day | Min/Day | C | Float32 | | 4 | 0 | 1 | 7200 | 0 | 60 | 0 | 1 | 0 | 1440 |
| CR-Cond-Down.Day | Min/Day | C | | | | | | | | | | | | |
| CR-SS-Overflow.EE | OK-EE | C | Digital | OK-EE | 1 | 0 | 1 | 28800 | 0 | 60 | 1 | 1 | | |
| CR-SS-DivertValve.EE | OK-EE | C | Digital | OK-EE | 1 | 0 | 1 | 28800 | 0 | 60 | 1 | 1 | | |
| CR-SS__FlowEmissions.EE | OK-EE | C | Digital | OK-EE | 1 | 0 | 1 | 28800 | 0 | 60 | 1 | 1 | | |
| CR-SS-Cond.Divert | Divert-Collect | C | Digital | Divert-Collect | 1 | 0 | 1 | 28800 | 0 | 60 | 1 | 1 | | |
| CR-SS__CondDvrt.EE | OK-EE | C | Digital | OK-EE | 1 | 0 | 1 | 28800 | 0 | 60 | 1 | 1 | | |
| CR-SS-BottomTemp.Filt | Deg F. | C | Float32 | | 1 | 0 | 1 | 840 | 0 | 60 | 1 | 0 | 0 | 2500 |
| CR-SS-FeedTemp.Filt | Deg F. | C | Float32 | | 1 | 0 | 1 | 840 | 0 | 60 | 1 | 0 | 0 | 2500 |
| CR-SS-FeedSteamFlow.Filt | Lbs/hr | C | Float32 | | 1 | 0 | 1 | 840 | 0 | 60 | 1 | 0 | 0 | 20000 |
| CR-SS-CondFlow.Filt | Lbs/hr | C | Float32 | | 1 | 0 | 1 | 840 | 0 | 60 | 1 | 0 | 0 | 75000 |
| CR-SS-BottomTemp.PctGd | % | C | Float32 | | 3 | 0 | 1 | 600 | 0 | 60 | 1 | 1 | 0 | 100 |
| CR-SS-FeedTemp.PctGd | % | C | Float32 | | 3 | 0 | 1 | 600 | 0 | 60 | 1 | 1 | 0 | 100 |
| CR-SS-FeedSteamFlow.PctGd | % | C | Float32 | | 3 | 0 | 1 | 600 | 0 | 60 | 1 | 1 | 0 | 100 |
| CR-SS-CondFlow.PctGd | % | C | Float32 | | 3 | 0 | 1 | 600 | 0 | 60 | 1 | 1 | 0 | 100 |
| CR-SS-EffSteam.Filt | Lbs/hr | C | Float32 | | 1 | 0 | 1 | 840 | 0 | 60 | 1 | 0 | 0 | 20000 |
| CR-SS__ESRATIO.RAW | | C | Float32 | | 3 | 0 | 1 | 600 | 0 | 60 | 1 | 1 | 0 | 1 |
| CR-SS-__ESRatio.Filt | | C | Float32 | | 1 | 0 | 1 | 600 | 0 | 60 | 1 | 0 | 0 | 1 |
| CR-SS-__ESRatio.PctGd | % | C | Float32 | | 3 | 0 | 1 | 600 | 0 | 60 | 1 | 1 | 0 | 100 |
| CR-SS-SS__Ratio.15M[2] | | Lab | Float32 | | 1 | 0 | 1 | 28800 | 0 | 600 | 0 | 1 | 0 | 1 |
| CR-SS-SS__Ratio.3H[2] | | Lab | Float32 | | 1 | 0 | 1 | 28800 | 0 | 600 | 0 | 1 | 0 | 1 |
| CR-SS-SS__Ratio.LL[3] | | Lab | Float32 | | 1 | 0 | 1 | 28800 | 0 | 600 | 0 | 1 | 0 | 1 |

[2]Calculated in Proficy and written periodically to PI.
[3]Maintained in Proficy as a Specification Limit and written periodically from Proficy to PI

TABLE 27

| Tag Name | Descriptor | pointtype | compdev | compressing | CompMax | excdev | excmax |
|---|---|---|---|---|---|---|---|
| Temp or Flow.PV | Raw DCS Temp or Flow Value | Float32 | Mill std | 1 | ≦3600 | Mill std | 60 |
| Tank Level.PV | Raw Coll Tank Level | Float32 | Mill Std | 1 | Mill Std | Mill Std | 60 |
| Divert Valve.PV | Divert Valve Status | Digital | Mill Std | 1 | Mill Std | Mill Std | 60 |

The Proficy model consists of input variables, calculated variables, stored procedures, and Visual Basic scripts (VB scripts). Variables and associated parameters for a typical 92% steam stripper treatment system and descriptions of the stored procedures and the VB scripts are included below. Complete listings of the Stored Procedures can be found herein below.

TABLE 28

Proficy Input Variables (From PI)

| Variable Description | Data Type | Precision | Sampling Interval | Sampling Offset | Sampling Window | Sampling Type | PI Tag |
|---|---|---|---|---|---|---|---|
| | | | Used For Display Only | | | | |
| Bottom Temperature 15 Min - % Good | Float | 2 | 15 | 0 | 15 | Last Good Value | CR-SS-BottomTemp.PctGd |
| Cond Feed Temperature 15 Min - % Good | Float | 2 | 15 | 0 | 15 | Last Good Value | CR-SS-FeedTemp.PctGd |
| Feed Steam Flow 15 Min - % Good | Float | 2 | 15 | 0 | 15 | Last Good Value | CR-SS-FeedSteamFlow.PctGd |
| Condensate Flow 15 Min - % Good | Float | 2 | 15 | 0 | 15 | Last Good Value | CR-SS-CondFlow.PctGd |
| Condensate System Potential To Emit (Snapshot) | String | | 15 | 0 | 15 | Interpolated | CR-Cond-PTE.STAT |
| | | | Used In Proficy Calculations | | | | |
| SS % Time Treating (15 min) | Float | 1 | 15 | 0 | 15 | Average | CR-SS__Treat.Num |
| SS % Time Treating (1 Hr) | Float | 1 | 60 | 0 | 60 | Average | CR-SS__Treat.Num |
| Effective Steam Ratio 15 Min (Raw PI Avg) | Float | 2 | 15 | 0 | 0 | Average | CR-SS__ESRatio.Filt |
| Effective Steam Ratio 15 Min - % Good (CMS) | Float | 2 | 15 | 0 | 15 | LastGood Value | CR-SS__ESRatio.PctGd |
| Effective Steam Ratio 15 Min Avg | Float | 2 | 15 | 0 | 0 | | CR-SS__ESRatio.15M |
| Effective Steam Ratio 3 Hr Rolling Avg | Float | 2 | 60 | 0 | 0 | | CR-SS__ESRatio.3H |
| Effective Steam Ratio Lower Limit | Float | 2 | 15 | 0 | 0 | | CR-SS__ESRatio.LL |
| Down Time | Integer | 0 | 1440 | 420[26] | 15 | LastGood Value | CR-SS-TREAT.Day |

[26]The sampling offset is determined based upon the mill Start of Day time. The offset value is the number of minutes from midnight to the mill start of day. In this example the start of day is 7:00 AM (as there are 420 minutes from midnight until 7:00 AM).

TABLE 29

Proficy Calculated Variables

| Variable | Data Type | Precision | Sampling Interval | Sampling Offset | Calc. Type | Calc. Name |
|---|---|---|---|---|---|---|
| Effective Steam Ratio 15 Min Avg | Float | 1 | 15 | 0 | VBScript | SS Qualified 15 Min Avg |
| Effective Steam Ratio 15 Min Avg (Status) | String | | 15 | 0 | VBScript | SS Qualified 15 Min Avg Status |
| Effective Steam Ratio 15 Min Avg/Status (Used for 3 Hr Avg) | String | | 15 | 0 | VBScript | SS 15 Min Avg/Status Reassembly |
| Effective Steam Ratio 3 Hr Rolling Avg | Float | 2 | 60 | 0 | Stored Procedure | StripperRollingAvg with AvgPTE |
| Effective Steam Ratio 3 Hr Rolling Avg (Status) | String | | 60 | 0 | Stored Procedure | StripperRollingAvgStatus with AvgPTE |
| Effective Steam Ratio Lower Limit | Float | 2 | 15 | 0 | Equation | Effective Steam Ratio Lower Limit |
| Steam Ratio EE Events | String | | 60 | 0 | Stored Procedure | SS Treatment Events |
| SS CMS Treating Status (15 Min) | String | | 15 | 0 | VBScript | SS PTE CMS Status (15 Min) |
| SS EE Treating Status (1 Hr) | String | | 60 | 0 | VBScript | SS PTE EE Status (1 Hr) |
| Run Time | Integer | 0 | 1440 | 420[1] | Equation | Uptime (Daily) |
| Mill Day | String | | 15 | 0 | Stored Procedure | MillDay |

Proficy Calculations

EE event logic

Steam Stripper Rolling Average Excess Emission events are created in one hour increments using the stored procedure spLocal_SSTreatmentEvents as described below. Bypass events (Treatment Bypass, Overflow bypass, Flow Emissions and Upstream Bypass) EE events are created using Proficy's downtime model 200 with a 61-second (or other mill specific) filter applied. The PI tags, CR-SS_Overflow.EE, CR-SS_CondDivert.EE, CR-SS_FlowEmissions.EE and CR-SS_Bypass.EE, trigger the start of an event whenever their state changes from OK (the normal running state) to EE (the fault state). The event ends when the state changes back to OK. If the state returns to OK within the filter period the state changes are ignored and no event is created in Proficy.

CMS event logic

CMS events for the Steam Stripper treatment system are created in fifteen minute intervals as described below in the stored procedure spLocal_SSTreatmentEvents. There are no CMS events associated with collection tank overflows or treatment bypass valves.

SS Qualified 15 Min Avg

Type: VBScript

The inputs to this script are the SS CMS Treating Status (15 Min), the 15 minute raw PI average of Effective Steam ratio, the percent good value for the effective steam calculation over the fifteen minute window, and a lower reject specification limit attached to the percent good variable. This script is triggered by time (based on the sample interval for the variable—normally 15 minutes) or an input value change. This script filters the 15 minute average based on the 15 minute average Treating status and the percent good value for the average. If the percent good value is greater than required (lower reject limit) and the Treating status is Treating, the script outputs the average value for the period. If the Treating status is NotTreating or the percent good value is less than required, this script outputs a null value.

SS Qualified 15 Min Avg Status

Type: VBScript

The inputs to this script are the effective steam 15 minute percent good value, the lower warning limit for percent good, the SS CMS Treating Status (15 Min) and the raw PI effective steam ratio 15 minute average. This script is triggered by time (based on the sample interval for the inputs) or an input value change. This script outputs the status of the Eff Steam Ratio 15 Min Avg (Status) for display on the Autolog display. If the Treating status is NotTreating, this script outputs Unit Down. If the percent good value is greater than 50% and the Treating status is Treating, this script outputs OK. If the percent good value is less than 50% and the Treating status is Treating, the script outputs Bad Val.

SS 15 Min Avg/Status Reassembly

Type: VBScript

The inputs to this script are the Eff Steam Ratio 15 Min Avg and the Eff Steam Ratio 15 min Avg (Status). This script is triggered by time (based on the sample interval for the inputs) or by an input value change. This script combines the two inputs into one string value based on the string value of the Eff Steam Ratio 15 Min Avg (Status). If the Eff Steam Ratio 15 Min Avg (Status) is OK, this script outputs the Eff Steam Ratio 15 min Avg. If the Eff Steam Ratio 15 min Avg (Status) is Unit Down or Bad Val, this script outputs Unit Down or Bad Val.

spLocal_StripperRollingAvg_wAvgPTE

Type: Stored Procedure

This procedure has two inputs, the percent good value for effective steam ratio and the SS EE Treating Status (1 Hr), and one dependant variable, the reassembled 15 min avg/status for the effective steam ratio. This procedure calculates a 3 hour moving average of the dependant variable every hour from a minimum number of samples over the 3 hour interval. The requirement for a good average is that there must be more than 50% good samples. "Good" samples consist of valid numeric values taken while the EE Treating Status (1 Hr) is Treating and the percent good value is greater than 50%, as determined by the 15 min avg/status reassembly VB script. Values of Bad Val, Unit Down and NULL are excluded from the moving average. The triggers for this procedure are time (based on the sample interval for the variable), value change for the dependant variable or value change for the input variable.

spLocal_StripperRollingAvgStatus_wAvgPTE

Type: Stored Procedure

This procedure has four inputs (the percent good value for the effective steam ratio, the lower warning limit for this variable, the effective steam ratio 3 Hr Rolling Avg and the SS EE Treating Status (1 Hr)) and one dependant variable (the reassembled 15 min avg/status for the effective steam ratio). This procedure generates a status string to compliment the 3 hour moving average calculation, spLocal_StripperRollingAvg_wAvgPte. The following table 30 shows the possible outputs for this procedure and the sample types required to generate them.

TABLE 30

| Output | Condition Required |
|---|---|
| OK | >50% of samples have good numeric values, the average is greater than the lower warning limit and the 1 Hr Treating Status is Treating |
| EE | >50% of samples have good numeric values, the average is less than the lower warning limit and the 1 Hr Treating Status is Treating |
| Null In | >=50% of samples have Null value |
| Bad Data | >=50% of samples have % good values <50% |
| No Dep Variable | Dependent variable is not configured |
| No Spec Variable | The input variable from which specification limits are retrieved is not configured. |
| No Limit | The Reject Limit Input constant is not configured |
| Bad Limit | The retrieved specification limit is NULL. |
| Bad PctGood | The lower reject limit of the % good variable is NULL |
| No PTE Value | The EE Treating Status (1 Hr) is NULL |
| Too Many Samples | The total count of samples (columns) exceeds the expected number of samples (typ. 12). |
| No Value | The average of the samples is NULL |
| Unit Down | The 1 Hr EE Treating Status is NotTreating |
| Insuf Data | <= 50% of samples have a good numeric values and there is not a majority of these "bad" samples with the same value OR the number of samples is less than the expected number of samples |
| Insuf Columns | <=50% sample points |

The triggers for this procedure are time (based on the sample interval for the variable), value change for the dependant variable or value change for the input variable.

spLocal_SSTreatmentEvents

Type: Stored Procedure

This procedure is used to create CMS and EE events for the effective steam ratio. The inputs variables and dependant variables for both CMS and EE are shown in the following table 31.

TABLE 31

| Variables | EE | CMS |
|---|---|---|
| Specification Limit (Constant) | LW | LR |
| Event Duration (Constant) | 60 | 15 |
| PTE | SS EE Treating Status (1 Hr) | SS CMS Treating Status (15 Min) |
| EE or CMS (Constant) | EE | CMS |
| Dependant Variable | Eff Steam Ratio 3 Hr Rolling Avg | Eff Steam Ratio 15 Min-% Good |

This procedure tests for CMS or EE events by comparing the dependant variable value against a lower warning specification limit as specified in the calculation input. If the value is above the lower warning limit, a downtime event with duration as specified in the inputs is created. If an event exists for the previous time interval, the duration is appended to the existing event and the event end time is updated. The triggers for this procedure are time (based on the sample interval for the variable), value change for the dependant variable or value change for the input variable.

The purpose of this document is to describe the design of the Continuous Emissions Monitoring System for Bleach Plant Scrubber monitoring operations. The software is comprised of PI Data Archive software (which is used for automatic data collection from various process instrumentation and control systems) and Proficy software (which uses the data collected by PI in conjunction with manual inputs and business rules to monitor and report on the performance of the scrubbing process). This documentation is directed toward system administrator level personnel.

The following sections describe the general configuration of the standard bleach plant monitoring system. Deviations from the standard model, configuration listings for specific lines, and mill-specific details are contained within the appendices.

Cluster Rule regulations require that a continuous monitoring system (CMS) be operated to measure the following parameters for each bleach plant gas scrubber:

Gas scrubber vent gas inlet flow rate (fan running status is an approved surrogate for this CMS), ORP or pH, of the gas scrubber effluent and Gas scrubber liquid influent flow rate (later referred to as recirculation flow).

The data for these variables are collected and archived by the PI system and made available to the Proficy system to analyze against specific criteria to determine if an Excess Emission (EE) event has occurred. Excess Emission events, are recorded by the system when the bleach plant has the potential to emit (PTE) pollutants, as defined in PI, and one of the three monitored parameters does not meet the specified operating criteria. A bleach plant has the potential to emit pollutants when it is running or has been shutdown for less than a specified period of time (typically one hour) as defined by each facility. The potential to emit corresponds to the total source operating time reported to the state regulatory agency on a semi-annual basis or more frequently as required.

The Proficy software logs all events and operator responses to those events. The responses record the operator determined Trouble, Cause, Correction (response), and Report Code (report categorization) for the event. The report categorization specifies if the event is considered an excess emission, as the emission may be allowed due to Startup, Shutdown, and Malfunction (SSM) provisions. The events are compiled by the system and reported to the state regulatory agency on a semi-annual basis or more frequently as required. In addition to capturing and categorizing events, the Proficy system also captures and records failures (downtime) of Continuous Monitoring System (CMS) devices, referred to as CMS events. The system records failures whenever the validity of the data is suspect or out of range. These are also summarized and reported to the state in a semi-annual CMS performance report or more frequently as required. Again, the report categorization specifies if the event is considered allowable based on the specific regulations.

The following table 32 gives an overview of the minimum required process inputs, their engineering units, associated PI tags, and corresponding Proficy variable names.

TABLE 32

| Input | Eng. Units | PI Tagname | Proficy Variable |
|---|---|---|---|
| Bleach Plant PTE Status | CanEmit/ CanNotEmit | CR-BP-PTE.STAT | BP Potential to Emit (Snapshot) |
| Bleach Plant Numeric PTE Status | 0 = CanNotEmit, 100 = CanEmit | CR-BP-PTE.NUM | BP % Time CanEmit (15 Min) BP % Time CanEmit (1 Hr) |
| Daily Bleach Plant Non-PTE minutes - calculated at mill end of day | Min/day | CR-BP-PTEDown.Day | Down Time |
| Bleach Plant Scrubber pH (or ORP) | pH (or ORP) | CR-BP-ScrubPH.Filt (or CR-BP-ScrubORP.Filt) | pH 15 Min (Raw PI Avg) (or ORP 15 Min Raw PI Avg) |
| Bleach Plant Scrubber pH (or ORP) Data % Good | % | CR-BP-ScrubPH.PctGd (or CR-BP-ScrubORP.PctGd) | pH 15 Min - % Good (CMS) (or ORP 15 Min - % Good (CMS)) |
| Bleach Plant Scrubber Recirculation Flow | GPM | CR-BP-ScrubRecirc.Filt | Recirc Flow 15 Min (Raw PI Avg) |
| Bleach Plant Scrubber Recirculation Flow Data % Good | % | CR-BP-ScrubRecirc.PctGd | Recirc Flow 15 Min - % Good (CMS) |
| Bleach Plant Scrubber Fan Status | EE/OK | CR-BP-ScrubFan.EE | Fan EE (Snapshot) |
| Bleach Plant Scrubber Fan Data Quality | Good/Bad | CR-BP-ScrubFan.DQ | Fan Data Quality Snapshot (CMS) |

Proficy also maintains, and periodically writes to PI, the specification limits (upper data quality limit, lower data quality limit, and excess emission limits) for the pH/ORP and recirculation flows. The data quality limits are used by PI to determine if the PI data has "Good" or "Bad" data quality while the excess emission limit is used by Proficy to determine when excess emission events occur.

The following sections describe in detail how the Proficy bleach plant model triggers EE and CMS events.

Bleach Plant State—PTE

The bleach plant's potential to emit (PTE) is determined in PI using a performance equation. The performance equation logic returns a state of "CanEmit" during the period from startup of the bleach plant until a mill specified period after the bleach plant stops running. The bleach plant run-state is calculated each minute based upon mill specified criteria—typically CLO2 flow, motor running state, or pump running state.

A PI performance equation translates the digital PTE status into a numeric value with 0="CanNotEmit" and 100="CanEmit". Proficy averages this numeric PTE value of a specified time period and compares the average to a mill specified limit (usually 50) to determine if the bleach plant had a potential to emit over the desired time period. The Proficy variable, BP % Time CanEmit (15 min), averages the numeric PTE status over the previous 15 minute period. If this average is greater than or equal to the lower warning specification limit for this variable, the status is "CanEmit". If the average is less than the lower warning specification limit, the status is "CanNotEmit". This PTE status is used by Proficy to qualify the 15 min pH (or ORP) and recirculation flow 15 minute averages and to filter out CMS events when the status is "CanNotEmit". The Proficy variable, BP % Time CanEmit (1 hr), averages the numeric PTE status over the previous hour. If this average is greater than the lower warning specification limit for this variable, the status is "CanEmit". If the average is less than or equal to the lower warning specification limit, the status is "CanNotEmit". This PTE status is used by Proficy to qualify the three hour rolling average.Bleach Plant PTE Counter At the start of each mill day, a PI performance equation totals the "CanNotEmit" time over the previous 24-hour period. This value is read by Proficy and is used for both daily display and daily calculation of bleach plant runtime ("CanEmit" for the daily period). The daily runtime minutes are kept in Proficy and used to compute the total runtime minutes for the reporting period.

Recirculation Flow

Bleach Plant scrubber recirculation flow is read by PI from the mill DCS system. The raw value is first validated in PI against the upper and lower specification limits provided by Proficy. If the value is within range PI records the value in an intermediate variable (CR-BP-ScrubRecirc.FILT); If the value is out of range the intermediate variable records "BAD" instead. This PI performance equation is event based (calculated every time a new value enters the PI snapshot) so that data buffered in the PI interface will be captured and used regardless of its PI archive status.

Every 15 minutes, Proficy uses the filtered values to calculate a flow average over the 15-minute interval. Values marked "BAD" by PI are excluded from the calculated average.

The PI system also calculates a data quality metric that provides Proficy with the information it needs to determine whether the measurement of the recirculation flow is reliable. The metric is determined within PI by examining the percentage of time over the 15-minute interval that the recirculation flow data has maintained "good" data quality. This same calculation tests for a flat-lined signal over an extended period of time and calculates a "% Good" of zero if the signal value has remained unchanged. Proficy samples this "%-Good" value every 15-minutes and generates a 15-minute CMS downtime event (via a stored procedure calculation) whenever the percentage falls below 50% within the 15 minute period.

Recirculation flow EE events are triggered based upon a 3 hour rolling average calculation performed within Proficy. Once per hour, a stored procedure (spLocal_BleachRollingAvg) averages the previous twelve 15 Minute Averages for flow rate over the previous 3-hour window (3 Hr Rolling Avg). If the 3-hour average value is less than the lower warning specification limit configured in Proficy, a I-hour EE event is generated by the stored procedure "spLocal_BleachEvents". This 3-hour rolling average calculation excludes averages within periods that reflect a "%-Good" less than 50%, that had no Potential To Emit, and that contained NULL values. Therefore for a 3 Hour Average to be calculated and an EE Event to be created, a minimum of seven valid 15 Minute Averages (>50%, or 7/12) must be present in the 3 hour window.

Each 15-minute flow average ("Qualified 15 Min Avg") is accompanied by a corresponding status message ("Qualified 15 Min Avg Status") that is set to "OK" upon successful calculation of the average. Similarly the 3-hour rolling average has an equivalent variable ("3 Hr Rolling Avg Status") that provides the status regarding calculation of the 3 hour rolling average. The status messages and their meanings are summarized in the tables 33 and 34 below.

TABLE 33

Variable: "Qualified 15 Min Avg Status"

| Status Message | Meaning |
|---|---|
| OK | The 15 Min Avg was calculated |
| Unit Down | No Potential-to-Emit existed for the entire period. The 15 min avg is set to NULL. |
| Bad Val | The % Good for the period was calculated by PI as less than 50%. The 15 min avg is set to NULL. |

TABLE 34

Variable: "3 Hr Rolling Avg Status"

| Status Message | Meaning |
|---|---|
| OK | The 3 Hour Avg was calculated |
| Unit Down | At least six of twelve 15 Min Avgs reflect no Potential to Emit |
| Bad Val | At least six of twelve 15 Min Avgs reflect <50% Good data quality |
| Null In | At least six of twelve 15 Min Avgs are NULL. |
| Insuf Data | At least six of twelve 15 Min Avgs have a combination of NULL Value, <50% Good data quality, or no Potential to Emit. |

Figure 3B:
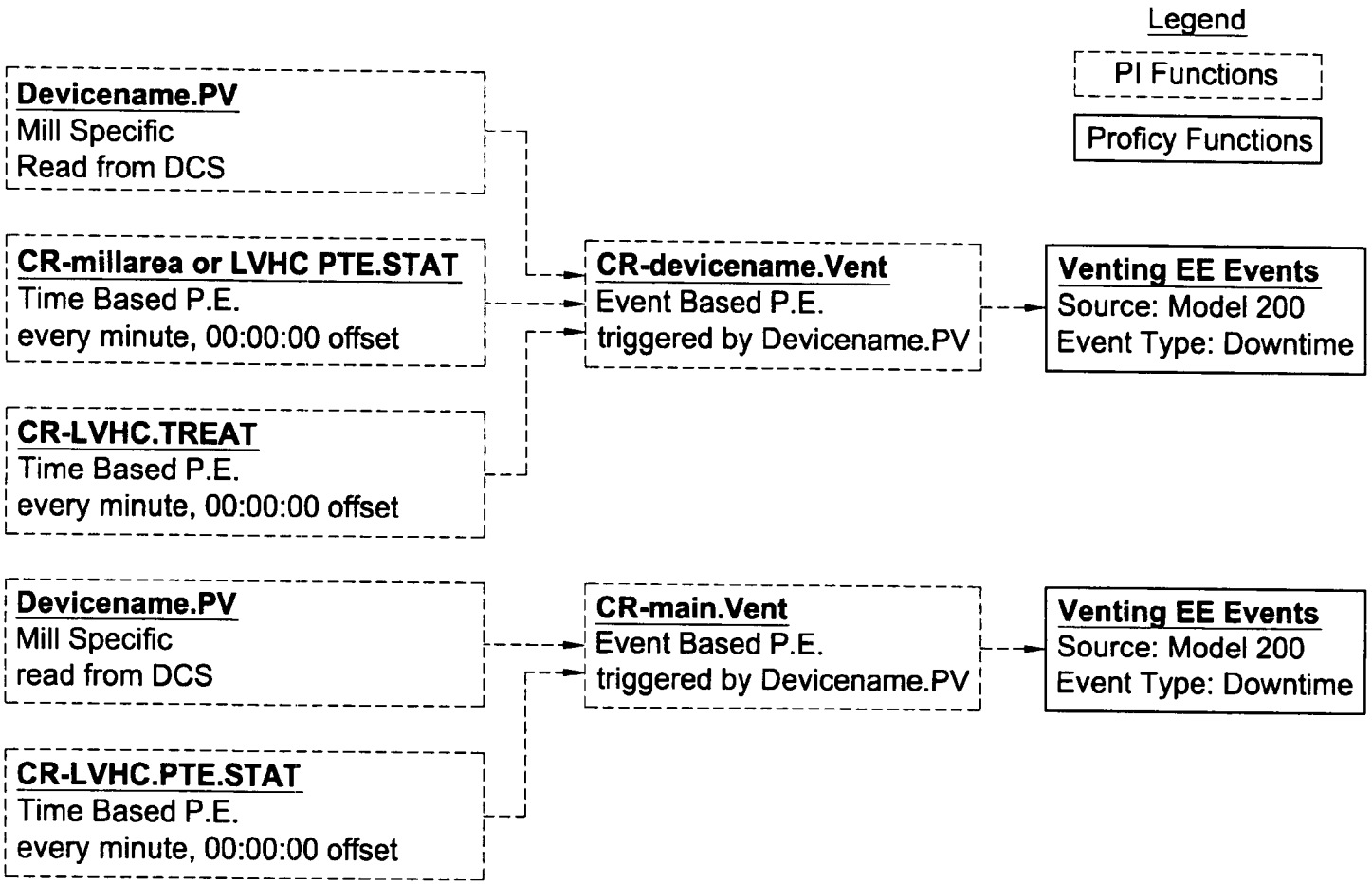
Figure 3D:
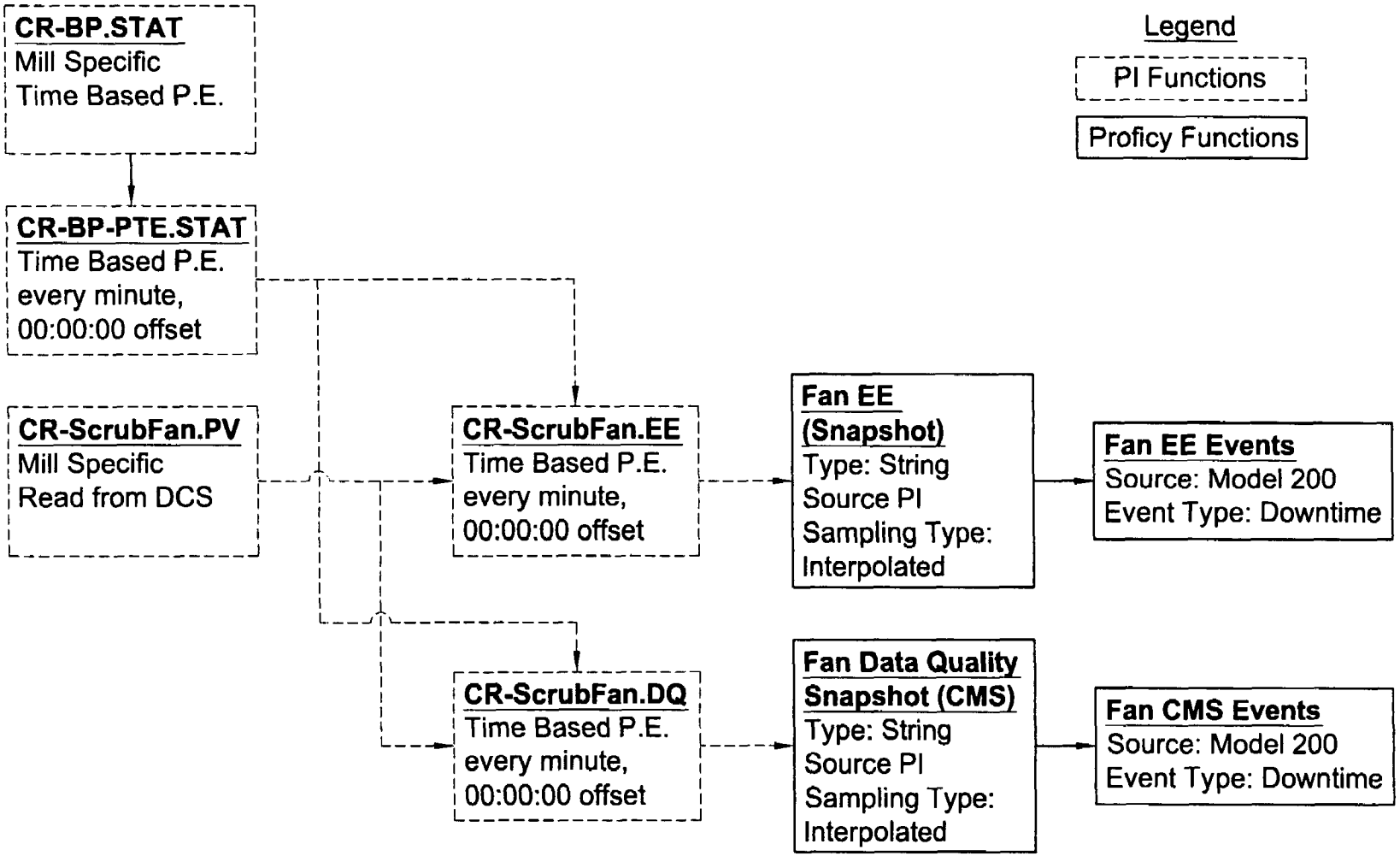
FIG. 3D is a flow diagram of Scrubber Data Flow.

A block diagram of scrubber recirculation data flow is depicted in FIG. 3D.

pH/ORP

The monitoring of pH/ORP is exactly analogous to that for recirculation flow except that a manually entered pH or ORP value can override the Proficy calculated 15 minute average. Additionally ORP measurements are compared to an upper warning specification limit as opposed to a lower warning limit specification used for pH and recirculation flow.

A block diagram of scrubber pH/ORP monitoring data flow is depicted in FIG. 3D.

Scrubber Fan

Scrubber fan running status is determined within PI and communicated to Proficy through the use of a digital signal. Within PI, running status is determined by either comparing the scrubber fan amps to a minimum limit, by examining the differential pressure across the fan to be greater than a minimum limit, or by examining the scrubber motor status from the DCS (through the use of status from a zero speed switch or equivalent digital signal).

Scrubber fan EE and CMS events are created by using the Proficy downtime model 200. The Proficy model is typically configured with a 61 second filter (to eliminate signal noise) in conjunction with a PI performance equation to act as the event trigger.

For excess emissions calculation, the PI tag CR-BP-ScrubFan.EE returns the digital state "EE" whenever the PI logic determines that the fan is not running while the system is in a "CanEmit" state; otherwise the equation returns the value "OK". To determine CMS downtime, a second PI performance equation (CR-BP-ScrubFan.DQ) verifies that the fan amp value (or fan running switch status) is within range (or has a valid state) and returns the value "Good." If these conditions are not met, (and the PTE state of "CanEmit" exists) the equation instead returns the value "Bad."

Proficy monitors the two digital tags CR-BP-ScrubFan.EE and CR-BP-ScrubFan.DQ for the fault values of "EE" and "Bad" respectively. If either value remains in the fault state for longer than the filter time, an EE or CMS event is recorded by the system.

Figure 4B:
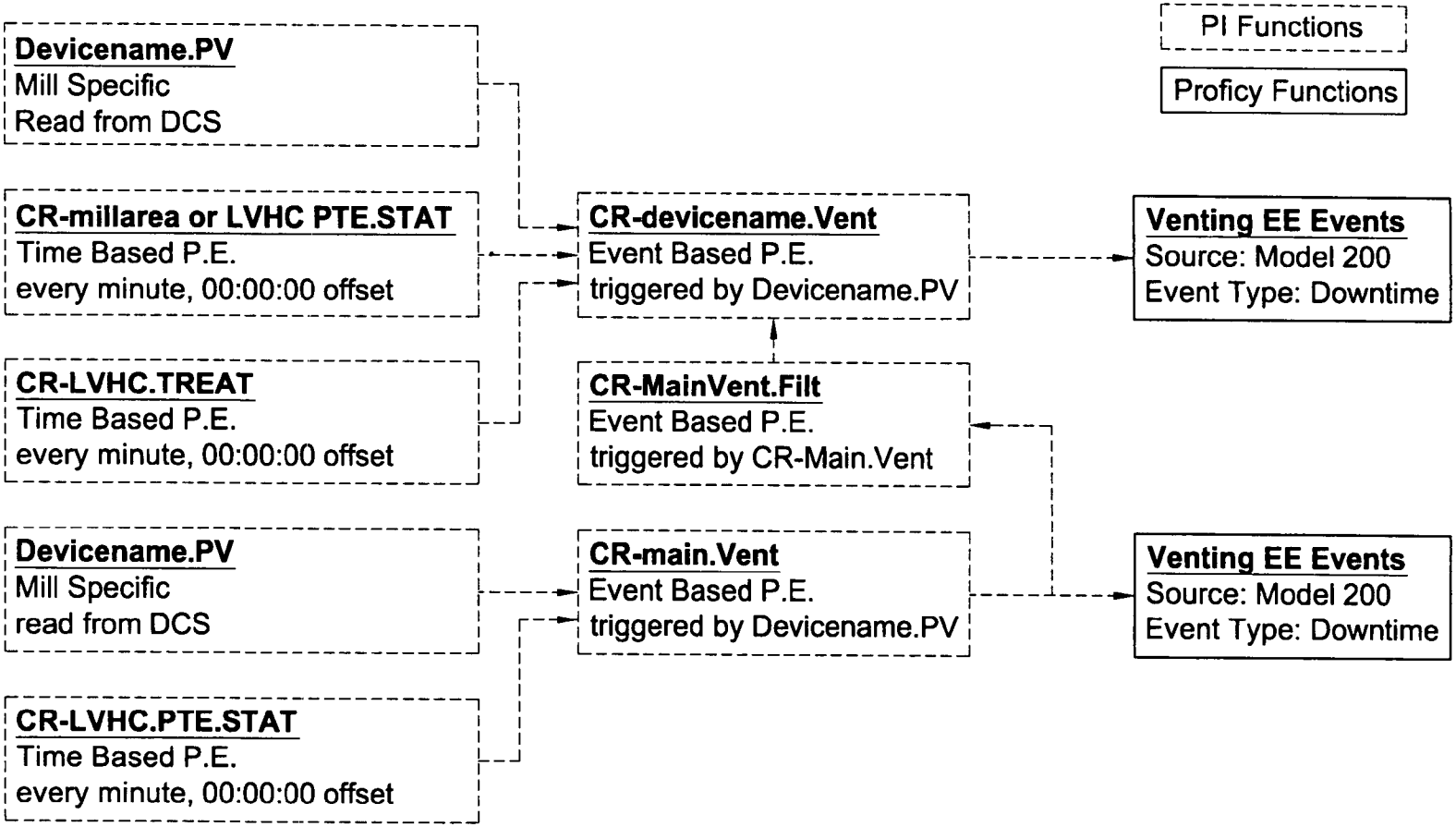
Figure 4C:
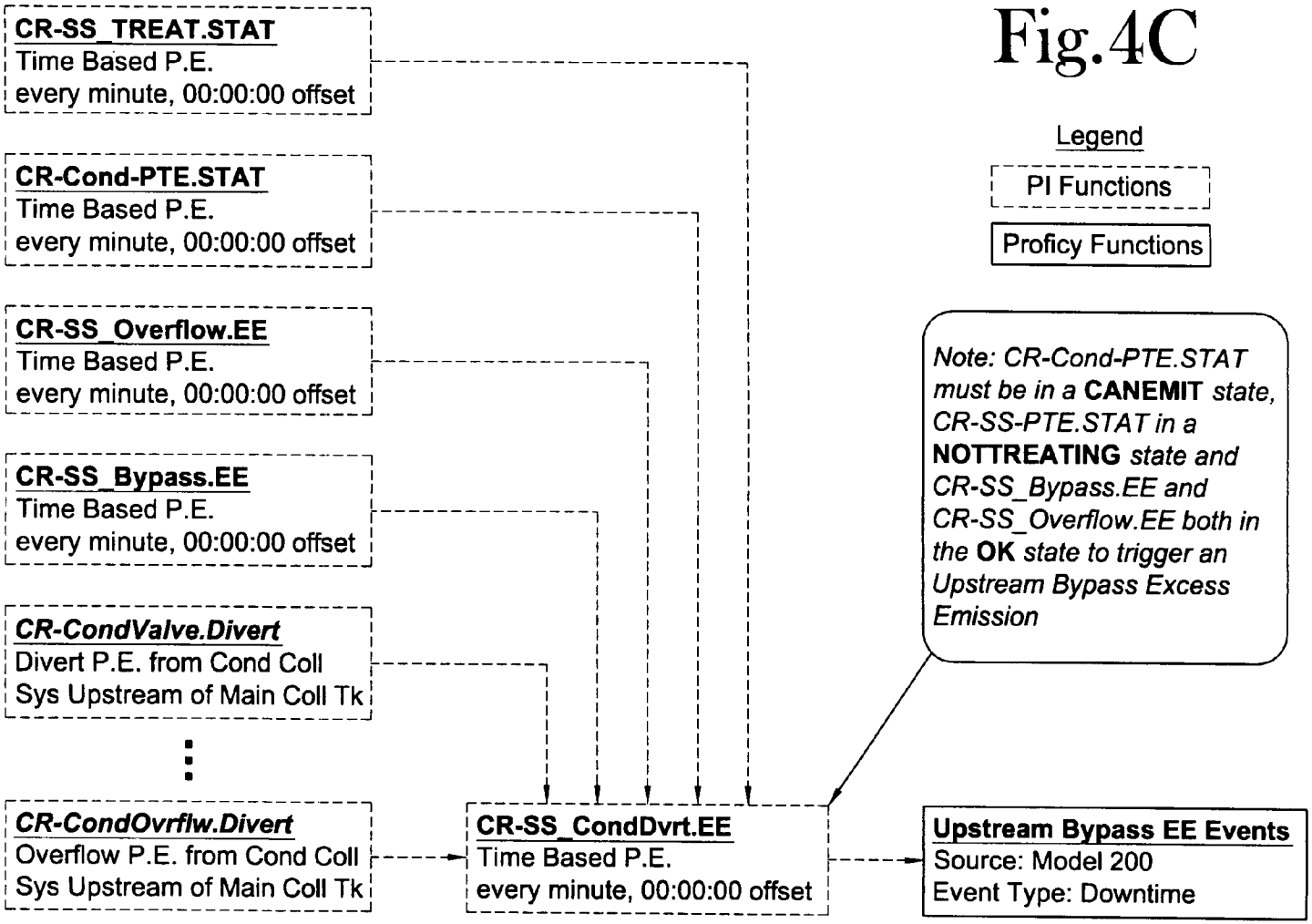
FIG. 4C is a flow diagram of Steam Stripper 92% Treatment Upstream Bypass EE Events.
Figure 5A:
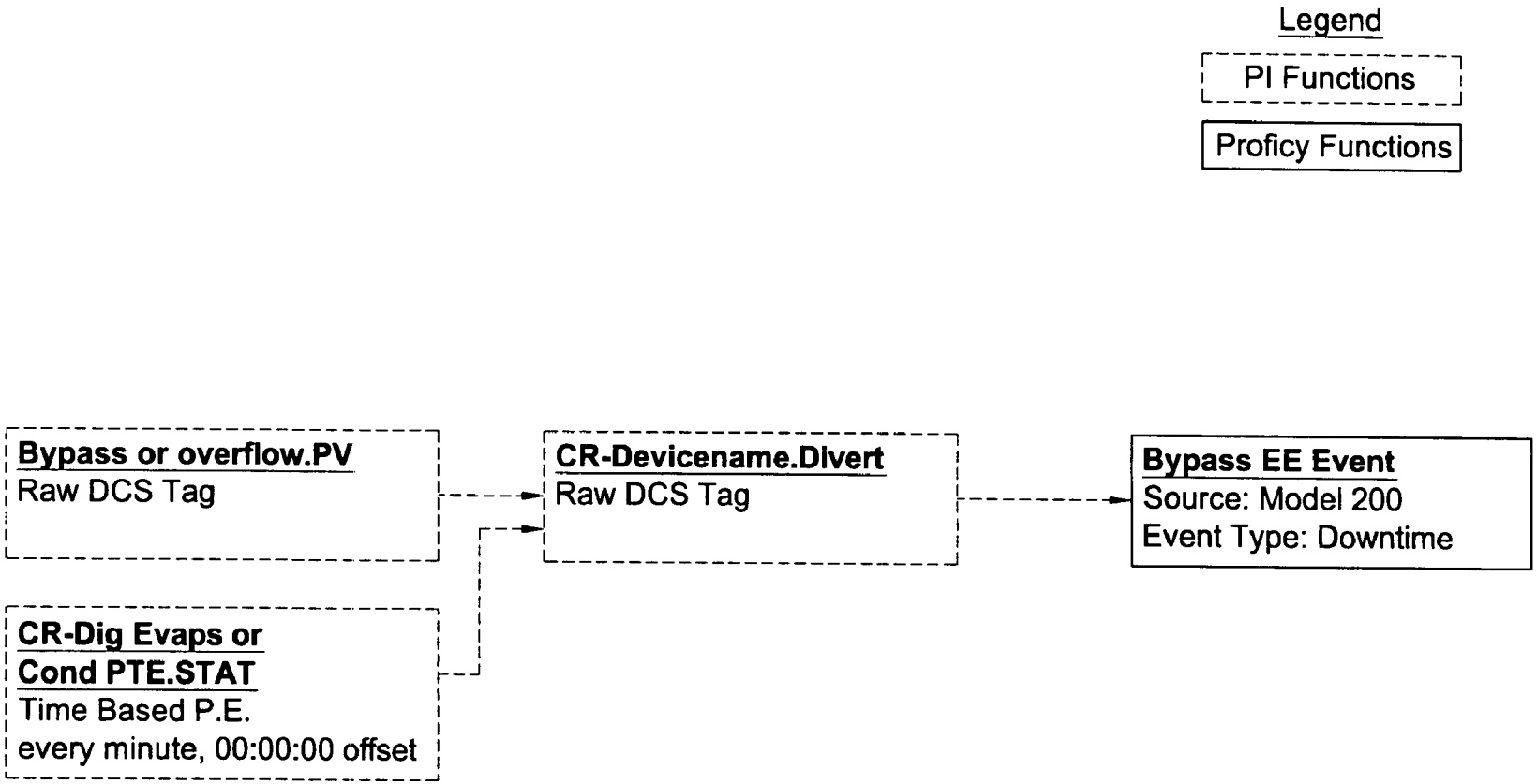
FIG. 5A is a flow diagram of Device CMS and Bypass EE Event Data Flow.
Figure 5B:
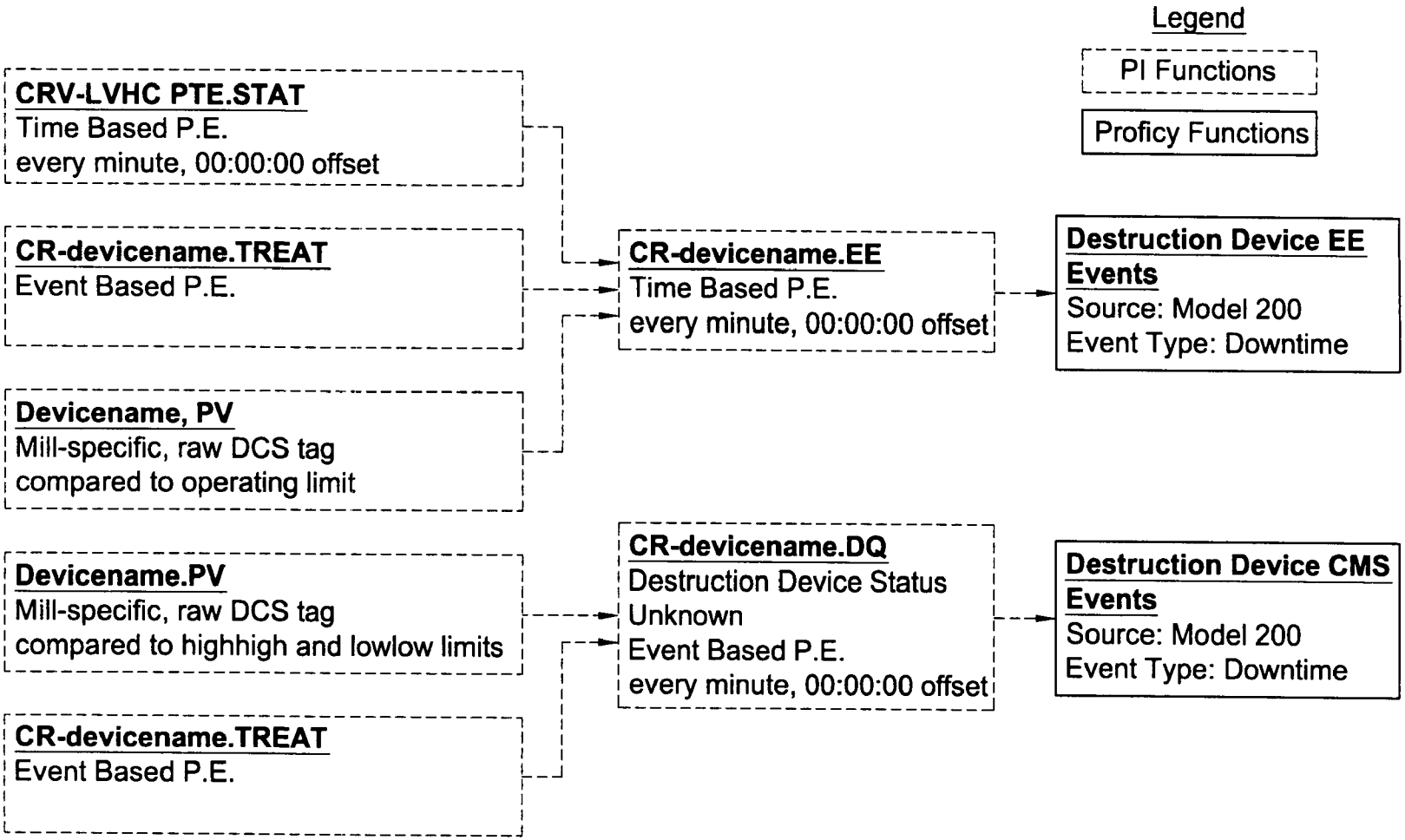
FIG. 5B is a flow diagram of Destruction Device EE and CMS Data Flow.
Figure 5C:
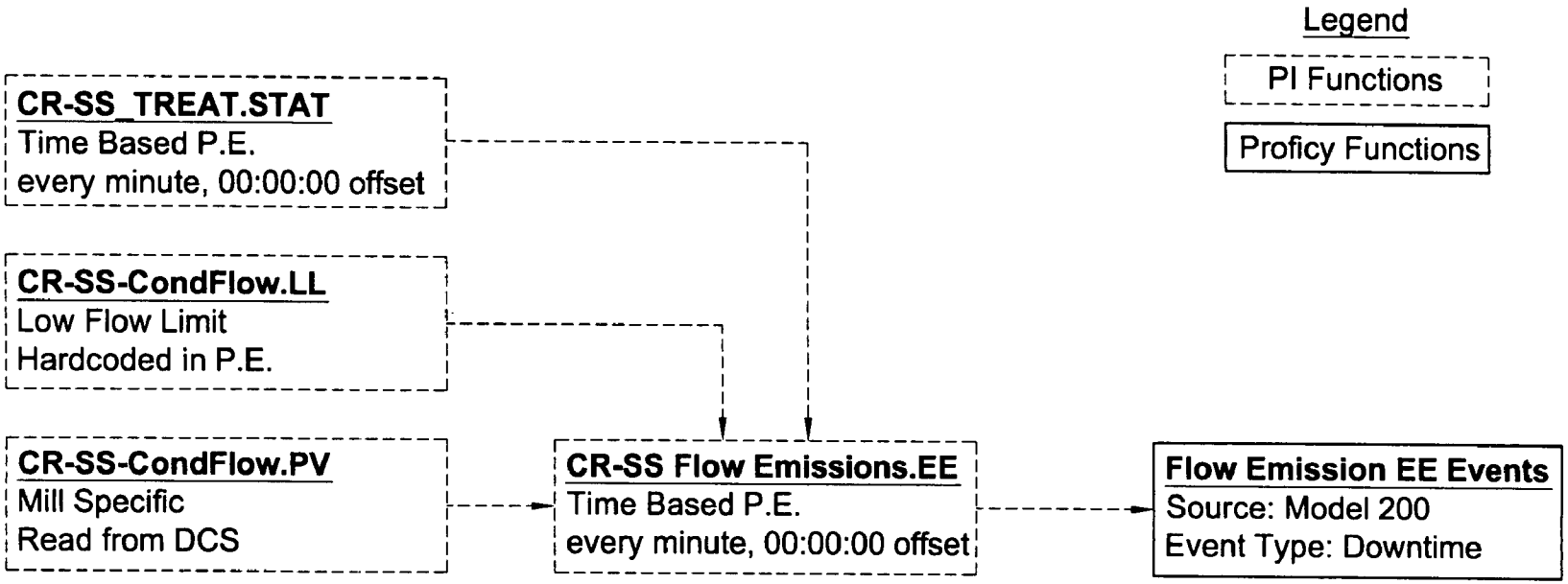
FIG. 5C is a flow diagram of Steam Stripper 92% Bottom Flow EE Event.

A block diagram of scrubber fan monitoring data flow is depicted in FIG. 4A-*a*.

Tag Name Specifications

All Cluster Rule PI tags will begin with "CR-".

For locations with multiple bleach lines, each line will be differentiated by CR-BPx, where x represents the mill naming convention. For example, Franklin will use CR-BPE for the E-Line and Augusta will use CR-BP1 for #1 Bleach Plant.

Digital State Set Specifications

The following are the minimum required digital state sets in PI to support the Cluster Rule Bleach Plant model.

| Digital Set Name | State 0 | State 1 |
|---|---|---|
| P2Emit | CanEmit | CanNotEmit |
| OK-EE | OK | EE |
| GOOD-BAD | Good | Bad |
| RUN-STOP | Running | Stopped |

Scan Class Specifications

The following scan classes must be available in PI. Note, the scan class number will vary from mill to mill.

A one minute scan class offset 0 seconds from midnight;

A fifteen minute scan class offset 0 seconds from midnight;

A twenty-four hour scan class offset to the start of mill day.

Examples of the scan class syntax are as follows:

/f=00:01:00, 00:00:00 (alternately /f=00:01:00, 0)

/f=00:15:00, 00:00:00 (alternately /f=00:15:00, 0)

/f=24:00:00, 07:00:00 (alternately /f=24:00:00, 25200) for mill day at 07:00 am

PI Tag Configuration Specification

The following tables provide tag configuration examples for a typical bleach plant model and the standard compression and exception attribute settings for the underlying mill tags.

TABLE 35

Bleach Plant PI Tag Configuration

| Tag Name | Descriptor | exdesc |
|---|---|---|
| CR-BP-PTE.STAT | BP Potential to Emit Status | if BadVal(TimeEQ('***CR-BP,STAT,***' '*−60M', '*', "***Running***")) then PrevVal('CR-BP-PTE.STAT', '*−60M') else if TimeEQ('***CR-BP,STAT,***' '*−60M', '*', "***Running***") > 0 then "CanEmit" else "CanNotEmit" |
| CR-BP-PTE-Down.Day | BP Pot. To Emit downtime/day | TimeEq('CR-BP-PTE.STAT','Y+7H','T+7H','CanNotEmit")/60 |
| CR-BP-PTE.NUM | BP PTE Status - Numeric | event=CR-BP-PTE.STAT, if ('CR-BP-PTE.STAT' <> "CanEmit" and 'CR-BP-PTE.STAT' <> "CanNotEmit") then PrevVal('CR-BP-PTE.NUM','*') else if 'CR-BP-PTE.STAT' <> "CanEmit" then 0 else 100 |
| CR-BP-ScrubFan.EE | BP Scrubber Fan Running Status | if ('***CR-BPFan.PV***' <> "***Run***") and ('CR-BP-PTE.STAT' = "CanEmit") then "EE" else "OK" |
| CR-BP-ScrubRecirc.Filt | BP Scrub Recirc PV Filter | event=***CR-BPRecirc.PV***, if ('***CR-BPRecirc.PV***' > 'CR-BP-ScrubRecirc.LLL') and ('***CR-BPRecirc.PV***' < 'CR-BP-ScrubRecirc.HHL') then '***CR-BPRecirc.PV***' else "BAD" |
| CR-BP-ScrubPH.Filt | BP Scrub pH PV Filter | event=***CR-BPpH.PV***, if ('***CR-BPpH.PV***' > 'CR-BP-ScrubPH.LLL') and ('***CR-BPpH.PV***' < 'CR-BP-ScrubPH.HHL') then '***CR-BPpH.PV***' else "BAD" |
| CR-BP-ScrubFan.DQ | BP Scrubber Fan Data Quality | if ('***CR-BPFan.PV***' <> "***Stop***" and '***CR-BPFan.PV***' <> "***Start***") and ('CR-BP-PTE.STAT' <> "CanNotEmit") then "Bad" else "Good" |
| CR-BP-ScrubPH.PctGd | BP Scrubber pH % Good Data | if (TagMax('CR-BP-ScrubPH.Filt', '*−3H', '*') −TagMin('CR-BP-ScrubPH.Filt', '*−3H', '*') = 0) or BadVal(PctGood('CR-BP-ScrubPH.Filt', '*−15M', '*')) then 0 else PctGood('CR-BP-ScrubPH.Filt', '*−15M', '*') |
| CR-BP-ScrubRecirc.PctGd | BP Scrubber Recirc % Good Data | if (TagMax('CR-BP-ScrubRecirc.Filt', '*−3H', '*') − TagMin('CR-BP-ScrubRecirc.Filt', '*−3H', '*') = 0) or BadVal(PctGood('CR-BP-ScrubRecirc.Filt', '*−15M', '*')) then 0 else PctGood('CR-BP-ScrubRecirc.Filt', '*−15M', '*') |
| CR-BP-ScrubPH.HHL | BP Scrubber pH High Lim DQ | |
| CR-BP-ScrubPH.LL* | BP Scrubber pH Low Lim | |
| CR-BP-ScrubPH.LLL | BP Scrubber pH Low Lim DQ | |
| CR-BP-ScrubRecirc.HHL | BP Scrubber Recirc High Lim DQ | |

TABLE 35-continued

Bleach Plant PI Tag Configuration

| Tag Name | Descriptor | exdesc |
|---|---|---|
| CR-BP-ScrubRecirc.LL | BP Scrubber Recirc Low Lim | |
| CR-BP-ScrubRecirc.LLL | BP Scrubber Recirc Low Lim DQ | |
| CR-BP-ScrubPH.15M | BP Scrubber pH 15 Min Avg | |
| CR-BP-ScrubPH.3H | BP Scrubber pH 3 Hr Avg | |
| CR-BP-ScrubRecirc.15M | BP Scrubber Recirc 15 Min Avg | |
| CR-BP-ScrubRecirc.3H | BP Scrubber Recirc 3 Hr Avg | |

Note:

Italics bold print represents mill specific information.

*CR-BP-ScrubPH.LL will become CR-BP-ScrubORP.HL for a mill with ORP control. Other pH tags will change in a similar manner in this and subsequent tables.

TABLE 36

Bleach Plant PI Tag Configuration

| Tag Name | engunits | pointsource | pointtype | DigitalSet | Location4 | compdev | compressing | CompMax | xcdev | xcmax | shutdown | tep | ero | pan |
|---|---|---|---|---|---|---|---|---|---|---|---|---|---|---|
| CR-BP-PTE.STAT | CanEmit/CanNotEmit | C | Digital | P2EMIT | 1 | 0 | 1 | 28800 | | 0 | 1 | | | |
| CR-BP-PTE-Down.Day | Min/Day | C | Float32 | | 4 | 0 | 1 | 7200 | | 00 | 0 | | | 440 |
| CR-BP-PTE.NUM | 0/100 | C | Float32 | | | 0 | 1 | 60 | | 0 | 1 | | | 00 |
| CR-BP-ScrubFan.EE | OK-EE | C | Digital | OK-EE | 1 | 0 | 1 | 28800 | | 0 | 0 | | | |
| CR-BP-ScrubRecirc.Filt | GPM | C | Float32 | | 1 | 0 | 1 | 600 | | 0 | 1 | | | 50 |
| CR-BP-ScrubPH.Filt | pH | C | Float32 | | 1 | 0 | 1 | 600 | | 0 | 1 | | | 4 |
| CR-BP-ScrubFan.DQ | Bad/Good | C | Digital | BAD-GOOD | 1 | 0 | 1 | 28800 | | 0 | 0 | | | |
| CR-BP-ScrubPH.PctGd | % | C | Float32 | | 3 | 0 | 1 | 600 | | 0 | 1 | | | 00 |
| CR-BP-ScrubRecirc.PctGd | % | C | Float32 | | 3 | 0 | 1 | 600 | | 0 | 1 | | | 00 |
| CR-BP-ScrubPH.HHL | pH | Lab | Float32 | | 1 | 0 | 1 | 28800 | | 00 | 0 | | | 4 |
| CR-BP-ScrubPH.LL | pH | Lab | Float32 | | 1 | 0 | 1 | 28800 | | 00 | 0 | | | 4 |
| CR-BP-ScrubPH.LLL | pH | Lab | Float32 | | 1 | 0 | 1 | 28800 | | 00 | 0 | | | 4 |
| CR-BP-ScrubRecirc.HHL | GPM | Lab | Float32 | | 1 | 0 | 1 | 28800 | | 00 | 0 | | | 50 |
| CR-BP-ScrubRecirc.LL | GPM | Lab | Float32 | | 1 | 0 | 1 | 28800 | | 00 | 0 | | | 50 |
| CR-BP-ScrubRecirc.LLL | GPM | Lab | Float32 | | 1 | 0 | 1 | 28800 | | 00 | 0 | | | 50 |
| CR-BP-ScrubPH.15M | pH | Lab | Float32 | | 1 | 0 | 1 | 28800 | | 00 | 0 | | | 4 |
| CR-BP-ScrubPH.3H | pH | Lab | Float32 | | 1 | 0 | 1 | 28800 | | 00 | 0 | | | 4 |
| CR-BP-ScrubRecirc.15M | GPM | Lab | Float32 | | 1 | 0 | 1 | 28800 | | 00 | 0 | | | 50 |
| CR-BP-ScrubRecirc.3H | GPM | Lab | Float32 | | 1 | 0 | 1 | 28800 | | 00 | 0 | | | 50 |

TABLE 37

Bleach Plant Mill Specific PI Tag Compression and Exception Attributes

| Tag Name | Descriptor | pointtype | compdev | compressing | CompMax | xcdev | xcmax | Comments |
|---|---|---|---|---|---|---|---|---|
| CR-BP.STAT | BP Running Status | Digital | Mill Std | 1 | Mill std | ill std | ill std | Mill should st attributes to get representative values |
| CR-BPFan.PV | BP Fan Running Status | Digital | Mill std | 1 | 7200 | ill std | 0 | Mill should st attributes to get representative values |
| CR-BPRecirc.PV | BP Recirculation Flow DCS Value | Float32 | Mill std | 1 | <=3600 | ill std | 0 | Archived values req; d for 3-hr std dev check in the .Filt PE ExcMax is set at 60 s to trigger event-based .Filt PE |
| CR-BPpH.PV | BP pH DCS Value | Float32 | Mill std | 1 | <=3600 | ill std | 0 | Archived values req; d for 3-hr std dev check in the .Filt PE ExcMax is set at 60 s to trigger event-based .Filt PE |

The Proficy model consists of input variables (PI inputs), calculated variables, stored procedures, and Visual Basic scripts (VB scripts). Variables for a typical bleach plant (monitoring pH) and descriptions of the stored procedures and the VB scripts are included below. Complete listings of the Stored Procedures can be found herein below.

TABLE 38

PI Interface Proficy Variables

| Variable | Data Type | Precision | Sampling Interval | Sampling Offset | Sampling Window | Sampling Type | PI Tag |
|---|---|---|---|---|---|---|---|
| Recirc Flow 15 Min (Raw PI Avg) | Float | 2 | 15 | 0 | 0 | Average | CR-BP-ScrubRecirc.Filt |
| Recirc Flow 15 Min - % Good (CMS) | Float | 2 | 15 | 0 | 15 | LastGood Value | CR-BP-ScrubRecirc.PctGd |
| Recirc Flow 3 Hr Rolling Avg | Float | 2 | 60 | 0 | 0 | | CR-BP-ScrubRecirc.3H |
| Recirc Flow 15 Min Avg | Float | 2 | 15 | 0 | 0 | | CR-BP-ScrubRecirc.15M |
| Recirc Flow Lower Limit | Float | 2 | 15 | 0 | 0 | | CR-BP-ScrubRecirc.LL |
| Recirc Flow Lower DQ Limit | Float | 2 | 15 | 0 | 0 | | CR-BP-ScrubRecirc.LLL |
| Recirc Flow Upper DQ Limit | Float | 2 | 15 | 0 | 0 | | CR-BP-ScrubRecirc.HHL |
| pH 15 Min - % Good (CMS) | Float | 2 | 15 | 0 | 15 | Last Good Value | CR-BP-ScrubpH.PctGd |
| pH 15 Min (Raw PI Avg) | Float | 2 | 15 | 0 | 0 | Average | CR-BP-ScrubPH.Filt |
| pH 15 Min Avg | Float | 2 | 15 | 0 | 0 | | CR-BP-ScrubPH.15M |
| pH 3 Hr Rolling Avg | Float | 2 | 60 | 0 | 0 | | CR-BP-ScrubPH.3H |
| pH Lower Limit[1] | Float | 2 | 15 | 0 | 0 | | CR-BP-ScrubPH.LL |
| pH Lower DQ Limit | Float | 2 | 15 | 0 | 0 | | CR-BP-ScrubPH.LLL |
| pH Upper DQ Limit | Float | 2 | 15 | 0 | 0 | | CR-BP-ScrubPH.HHL |
| Fan EE (Snapshot) | String | | 15 | 0 | 15 | Interpolated | CR-BP-ScrubFan.EE |
| BP Potential To Emit (Snapshot) | String | | 15 | 0 | 15 | Interpolated | CR-BP-PTE.STAT |
| Down Time | Integer | | 1440 | 420[2] | 15 | LastGood Value | CR-BP-PTE-Down.Day |
| Fan Data Quality Snapshot (CMS) | String | | 15 | 0 | 15 | Interpolated | CR-BP-ScrubFan.DQ |
| BP % Time CanEmit (15 min) | Float | 1 | 15 | 0 | 15 | Average | CR-BP-PTE.NUM |
| BP % Time CanEmit (1 hr) | Float | 1 | 60 | 0 | 60 | Average | CR-BP-PTE.NUM |

[1]This example monitors pH of the effluent. When ORP (Oxygen Reduction Potential) of the effluent is monitored instead of pH, the pH Lower Limit is replaced by an ORP Upper Limit.
[2]The sampling offset is determined based upon the mill Start of Day time. The offset value is the number of minutes from midnight to the mill start of day. In this example the start of day is 7:00 AM (as there are 420 minutes from midnight until 7:00 AM).

TABLE 39

Calculation Manager Proficy Variables

| Variable | Data Type | Precision | Sampling Interval | Sampling Offset | Calc. Type | Calc. Name |
|---|---|---|---|---|---|---|
| Recirc Flow 15 Min Avg | Float | 1 | 15 | 0 | VBScript | Qualified 15 Min Avg |
| pH 15 Min Avg | Float | 2 | 15 | 0 | VBScript | Qualified 15 Min Avg |
| Recirc Flow 15 Min Avg (Status) | String | | 15 | 0 | VBScript | Qualified 15 Min Avg Status |
| pH 15 Min Avg (Status) | String | | 15 | 0 | VBScript | Qualified 15 Min Avg Status |
| Recirc Flow 15 Min Avg/Status (Used for 3 Hr Avg) | String | | 15 | 0 | VBScript | 15 Min Avg/Status Reassembly |

TABLE 39-continued

Calculation Manager Proficy Variables

| Variable | Data Type | Precision | Sampling Interval | Sampling Offset | Calc. Type | Calc. Name |
|---|---|---|---|---|---|---|
| pH 15 Min Avg or Status (Reassembled) | String | | 15 | 0 | VBScript | 15 Min Avg/Status Reassembly |
| pH Manual/15 Min Avg (Used for 3 Hr Rolling Avg) | String | | 15 | 0 | Stored Procedure | ManualUpdate |
| Recirc Flow 3 Hr Rolling Avg | Float | 1 | 60 | 0 | Stored Procedure | BleachRollingAvg with AvgPTE |
| pH 3 Hr Rolling Avg | Float | 2 | 60 | 0 | Stored Procedure | BleachRollingAvg with AvgPTE |
| Recirc Flow 3 Hr Rolling Avg (Status) | String | | 60 | 0 | Stored Procedure | BleachRollingAvgStatus with AvgPTE |
| pH 3 Hr Rolling Avg (Status) | String | | 60 | 0 | Stored Procedure | BleachRollingAvgStatus with AvgPTE |
| Recirc Flow Lower Limit | Float | 2 | 15 | 0 | Equation | Scrubber Recirc Flow Lower Limit |
| Recirc Flow Lower DQ Limit | Float | 2 | 15 | 0 | Equation | Scrubber Recirc Flow Lower DQ Limit |
| Recirc Flow Upper DQ Limit | Float | 2 | 15 | 0 | Equation | Scrubber Recirc Flow Upper DQ Limit |
| pH Lower Limit[1] | Float | 2 | 15 | 0 | Equation | pH Measurement Lower Limit |
| pH Lower DQ Limit | Float | 2 | 15 | 0 | Equation | pH Measurement Lower DQ Limit |
| pH Upper DQ Limit | Float | 2 | 15 | 0 | Equation | pH Measurement Upper DQ Limit |
| Recirc Flow EE Events | String | | 60 | 0 | Stored Procedure | Bleach Events |
| pH EE Events | String | | 60 | 0 | Stored Procedure | Bleach Events |
| Recirc Flow CMS Events | String | | 15 | 0 | Stored Procedure | Bleach Events |
| PH CMS Events | String | | 15 | 0 | Stored Procedure | Bleach Events |
| Running Time | Integer | | 1440 | 420 | Equation | Uptime (Daily) |
| Mill Day | String | | 15 | 0 | Stored Procedure | MillDay |
| BP CMS PTE Status (15 min) | String | | 15 | 0 | VBScript | BP PTE CMS Status (15 min) |
| BP EE PTE Status (1 hr) | String | | 60 | 0 | VBScript | BP PTE EE Status (1 hr) |

[1]This example monitors pH of the effluent. When ORP (Oxygen Reduction Potential) of the effluent is monitored instead of pH, the pH Lower Limit is replaced by an ORP Upper Limit.

CMS Event Logic pH, ORP and flow CMS events are created from the stored procedure, BleachEvents, as described below. Scrubber fan CMS events are created using Proficy's downtime model 200 with a 61-second filter applied. The PI tag, CR-BP-Scrub-Fan.DQ, triggers the start of an event whenever its state changes from Good (the normal running state) to Bad (the fault state). The event ends when the state changes back to Good. If the state returns to Good within one minute, the change is ignored and an event is not created.

EE Event Logic pH, ORP and flow EE events are created from the stored procedure, BleachEvents, as described below. Scrubber fan EE events are created using Proficy's downtime model 200 with a 61-second filter applied. The PI tag, CR-BP-Scrub-Fan.DQ, triggers the start of an event whenever its state changes from OK (the normal running state) to EE (the fault state). The event ends when the state changes back to OK. If the state returns to OK within one minute, the change is ignored and an event is not created VB Script Descriptions BP PTE CMS Status (15 min)

The inputs to this script are the BP % Time CanEmit (15 min) and the lower warning limit for BP % Time CanEmit (15 min). This script is triggered by time (based on the sample interval for the variable) or an input value change. This script compares the 15 min average numeric PTE value to its lower warning limit. If the % Time CanEmit (15 min) value is less than the lower warning limit (usually 50), the PTE status is CanNotEmit. If the % Time CanEmit (15 min) value is greater than or equal to the lower warning limit, the PTE status is CanEmit.

BP PTE EE Status (1 Hr)

The inputs to this script are the BP % Time CanEmit (1 Hr) and the lower warning limit for BP % Time CanEmit (1 Hr). This script is triggered by time (based on the sample interval for the variable) or an input value change. This script compares the 1 hr average numeric PTE value to its lower warning limit. If the % Time CanEmit (1 hr) value is less than or equal to the lower warning limit (usually 50), the PTE status is CanNotEmit. If the % Time CanEmit (1 Hr) value is greater than the lower warning limit, the PTE status is CanEmit.

Qualified 15 Min Avg

The inputs to this script are the BP CMS PTE Status (15 min), the 15 minute raw PI average for pH, ORP or flow, the percent good value for pH, ORP or flow and the lower warning limit for percent good. This script is triggered by time (based on the sample interval for the variable) or an input value change. This script filters the 15 minute average (pH, ORP or recirculation flow) based on the PTE status or the percent good value for the average. If the percent good value is greater than 50% and the PTE status is CanEmit, this script outputs the average value. If the PTE status is CanNotEmit or the percent good value is less than 50%, this script outputs a null value.

Qualified 15 Min Avg Status

The inputs to this script are the BP CMS PTE Status (15 min), the 15 minute raw PI average for pH, ORP or flow, the percent good value for pH, ORP or flow and the lower warning limit for percent good. This script is triggered by time (based on the sample interval for the inputs) or an input value change. This script outputs the status of the Qualified 15 minute Average (pH, ORP or recirculation flow) for display on the Autolog display. If the PTE status is CanNotEmit, this script outputs Unit Down. If the percent good value is greater than 50% and the PTE status is CanEmit, this script outputs OK. If the percent good value is less than 50% and the PTE status is CanEmit, the script outputs Bad Val.

15 Min Avg/Status Reassembly

The inputs to this script are the Qualified 15 min Avg and the Qualified 15 min Avg Status. This script is triggered by time (based on the sample interval for the inputs) or an input value change. This script combines the two inputs into one string value based on the string value of the Qualified 15 Min Avg Status. If the Qualified 15 Min Avg Status is OK, this script outputs the Qualified 15 min Avg. If the Qualified 15 min Avg Status is Unit Down or Bad Val, this script outputs Unit Down or Bad Val.

Stored Procedure Descriptions

ManualUpdate

This procedure has one input, the 15 min raw PI avg for pH or ORP and one dependant variable, the manually entered value for pH or ORP. This procedure performs a signal selection between a manually entered value and another variable. If the dependant variable value (the manually entered value) is NULL, the output is the value of the input variable (the 15 min raw PI avg). Otherwise, the output is set to the value of the dependant variable. The triggers for this procedure are time (based on the sample interval for the variable), value change for the dependant variable or value change for the input variable.

BleachRollingAvg with AvgPTE

This procedure has two inputs, the percent good value for pH, ORP or flow and the BP EE PTE Status (1 Hr), and one dependant variable, the reassembled 15 min avg/status for pH, ORP or flow. This procedure calculates a 3 hour moving average of the dependant variable every hour from a minimum number of samples over the 3 hour interval if the average PTE status over the last hour is CanEmit. The requirement for a good average is that there must be more than 50% good samples. "Good" samples consist of valid numeric values taken while the PTE status is CanEmit and the percent good value is greater than 50%, as determined by the 15 min avg/status reassembly VB script. Values of Bad Val, Unit Down and NULL are excluded from the moving average. The triggers for this procedure are time (based on the sample interval for the variable), value change for the dependant variable or value change for the input variable.

BleachRollingAvgStatus with AvgPTE

This procedure has three inputs, the percent good value for pH, ORP or flow, the three hour rolling avg for pH, ORP or flow and the BP Ee PTE Status (1 Hr), and one dependant variable, the reassembled 15 min avg/status for pH, ORP or flow. This procedure generates a status string to compliment the 3 hour moving average calculation, BleachRollingAvg. The following table 40 shows the possible outputs for this procedure and the sample types required to generate them.

TABLE 40

| Output | Condition Required |
|---|---|
| OK | >50% of samples have good numeric values |
| Null In | <=50% of samples have good numeric values and the majority of these "bad" samples have a value of NULL |
| Bad Val | <=50% of samples have good numeric values and the majority of these "bad" samples have a value of Bad Val. |
| Unit Down | <=50% of samples have good numeric values and the majority of these "bad" samples have a value of Unit Down or the BP EE PTE Status (1 Hr) is CanNotEmit. |
| Insuf Data | <=50% of samples have a good numeric values and there is not a majority of these "bad" samples with the same value OR the number of samples is less than the expected number of samples |

The triggers for this procedure are time (based on the sample interval for the variable), value change for the dependant variable or value change for the input variable.

BleachEvents

This procedure is used to create CMS and EE events for pH, ORP and flow. This procedure has one input, the BP EE/CMS PTE Status (1 Hr/15 Min), and one dependant variable, the 3 hr rolling avg for pH, ORP or flow. This procedure tests for CMS or EE events when the average PTE status if CanEmit by comparing the dependant variable value against upper or lower specification limits as specified in the calculation inputs. If the value is above (below) the upper (lower) specification limit, a downtime event with duration as specified in the inputs is created. If an events exists for the previous time interval, the duration is appended to the existing event and the event end time is updated. The triggers for this procedure are time (based on the sample interval for the variable), value change for the dependant variable or value change for the input variable.

Stored Procedure Listings

SpLocal_BleachEvents

/*

Procedure Name: spLocal_BleachEvents

General Description:

This procedure tests for CMS or EE events by comparing the dependant variable value against upper or lower specification limits as specified in the calculation inputs. If the value is above (below) the upper (lower) specification limit, a downtime event with duration as specified in the inputs is created. If and event exists for the previous time interval, the duration is appended to the existing event and the event end time is updated.

The "Potential to Emit" (PTE), if configured for CMS events, is also taken into account.

Triggers:

1. Time (based on sample interval for variable)
2. Dependant variable value change
3. Input value change In order for the calculation to execute, non-optional calculation input values cannot be NULL.

Inputs and Depedencies:

1. Requires configuration of the depedant variable which is the value to be tested (e.g., "pH 3-Hr Rolling Avg").
2. Inputs described in body of code.

Outputs:

Type: Status message (string)

| Value | Occurs when . . . |
|---|---|
| "No dependant" | The dependant variable is not configured. |
| "No Reject" | The Reject_Limit input constant is not configured ("LR", "LW", "UW" or "UR."). |
| "No EventType" | The EventType input constant is not specified ("EE" or "CMS"). |
| "No PTE Val" | The event type is "CMS" and the PTE value is not valid. |
| "No Emission" | The event type is "CMS" and the PTE value is "CanNotEmit". |
| "Incorrect Reject" | The Reject_Limit input constant is configured but is incorrect (not "LR", "LW", "UW" or "UR"). |
| "Bad Limit" | The retrieved specification limit is NULL. |
| "No Value" | The dependant variable value is NULL. |
| "No Event" | None of the preceeding conditions apply, the test was performed and passed. |
| "Event Created" | The test failed and a downtime event was created. |

Variables:

1. Described in body of code.

Tables Modified:

1. Timed_Event_Details.

```
*/
CREATE PROCEDURE dbo.spLocal__BleachEvents
--Calculation Input and Output
@OutputValue varchar(50) OUTPUT,          --Status message (output)
@Var__Id int,
                                          --This variable's Id
@PU__Id int,
                                          --This variable's unit Id
@Timestamp datetime,                      --Timestamp
@Reject__Limit varchar(2),                --Specification limit applied in test
                                          --(valid values: "LR","LW","UW" or "UR")
@EventWindow int,                         --Duration of the event (if created)
@PTE Value varchar(30),                   --PTE value for this time interval (optional)
@EventType varchar(3)                     --Event type (valid values: "EE" or "CMS")
AS
                                          --Local variables
Declare
@DepVar__Id int,                          --Variable Id of the configured dependant
                                          variable
@RejectVar__Id int,                       --Variable Id from which specifications limits
                                          are read.
                                          --In this case, this is the same as @DepVar__Id
@RejectVal float,                         --The specification limit value
@Value varchar(30),                       --The value of the depedant variable for this
                                          time interval.
@SourcePU__Id int,                        --not used in this procedure
@StatusId int,                            --not used in this procedure
@FaultId int,
                                          --not used in this procedure
@Reason1 int,                             --Used to retain reasons if an event is appended
@Reason2 int,                             --Used to retain reasons if an event is appended
@Reason3 int,                             --Used to retain reasons if an event is appended
@Reason4 int,                             --Used to retain reasons if an event is appended
@ProductionRate float,                    --Must be specified for event creation (= 0.0 in
                                          this procedure)
@Duration float,                          --Must be specified for event creation (= 0.0 in
                                          this procedure)
@Transaction__Type int,                   --Specifies the transaction type in event creation
                    --(1=Add, 2=Update, 3=Delete, 4=Close)
@EventStartTime datetime,                 --Start time for this event if created
@Start__Time datetime,                    --Start time for the event if appended
@End__Time datetime,                      --End time for an event for the previous interval
                                          if it exists.
@TEDet__Id int,                           --Event Id
@TEFault__Id int,                         --The fault name from the fault translation table
                                          for this unit
.@Count int,
                                          --Number of events with timestamps later than
                                          the timestamp for
                                          --this interval
@Outside__Limit int                       --Indicates that the dependant variable value is
                                          outside of
                                          --the specification limits
Set @OutputValue = 'No Event'
                                          --Validate configured dependant variable
Select @DepVar__Id = Var__Id
    From Calculation__Instance__Dependencies
    Where Result__Var__Id = @Var__Id
If (@Dep Var__Id is Null)
    Begin
        Set @OutputValue = 'No dependant'
        Return
    End
                                          --Validate Configured Reject Limit Constant
if @Reject__Limit = NULL or @Reject__Limit = ''
    begin
        Set @OutputValue ='No Reject'
        Return
    end
                                          --Validate Configured Event Type ('EE' or
                                          CMS')
if @EventType <> 'CMS' and @EventType <> 'EE'
    begin
        Set @OutputValue = 'No EventType'
        Return
    end
```

-continued

```
                                                    --Check for Non Null PTE Status if event type is
                                                    CMS
If @EventType = 'CMS'
            Begin
                    If (@PTE Value <> 'CanNotEmit' and @PTEValue <> 'CanEmit')
                        Begin
                    Set @OutputValue = 'No PTE Val'
                        Return
                    End
            End
--Output status if CanNotEmit (will not evaluate to true for EE events because PTE input not configured)
If (@PTEValue = 'CanNotEmit' and @EventType = 'CMS')
            Begin
            Set @OutputValue = 'No Emissions'
                Return
            End
--Get Spec Limits from specification configuration
Set @RejectVar_Id = @DepVar_Id
Set @RejectVal = NULL
if @Reject_Limit = 'LR'
            Select @RejectVal = L_Reject
                from var_specs
                where var_id = @RejectVar_Id
Else
if @Reject_Limit = 'LW'
            Select @RejectVal = L_Warning
                from var_specs
                where var_id = @RejectVar_Id
Else
if @Reject_Limit = 'UW'
            Select @RejectVal = U_Warning
                from var_specs
                where var_id = @RejectVar_Id
Else
if @Reject_Limit = 'UR'
            Select @RejectVal = U_Reject
                from var_specs
                where var_id = @RejectVar_Id
Else
    begin
        Set @OutputValue = 'Incorrect Reject'
        Return
    end
                                                    --Validate specification value
if @RejectVal = NULL
begin
    Select @OutputValue = 'Bad Limit'
    Return
end
                                                    --Get value of the dependant variable
Select @Value = Result
    From Tests Where Var_Id = @DepVar_Id and Result_On = @Timestamp
                                                    --Validate dependant variable value
If ((@Value is Null) or (@Value = ''))
    Begin
        Set @OutputValue = 'No Value'
        Return
    End
Set @Outside_Limit = 0
--Compare the value of the dependant variable to the specification limit and set flag
--"@Outside_Limit" if the value is out of limit
If @Reject_Limit = 'LR' or @Reject_Limit ='LW'
begin
            if Convert(float,@Value) <= Convert(float,@RejectVal)
                Set @Outside_Limit = 1
end
If @Reject_Limit = 'UW' or @Reject_Limit='UR'
begin
            if Convert(float,@Value) >= Convert(float,@RejectVal)
                Set @Outside_Limit = 1
end
--Check for a later event: Do not create an event for earlier time than latest event
Select @Count = Count(*)
    From Timed_Event_Details
    Where pu_id = @pu_id and ((Start_Time >= @Timestamp) or (End Time >= @Timestamp))
If Convert(float,@Count) > 0.0
    Begin
        Set @OutputValue = 'No Event'
        Return
```

-continued

```
    End
--Setup to create event
Set @EventStartTime = DateAdd(mi,-1*@EventWindow,@Timestamp)Set @ProductionRate = 0.0
Set @Duration = 0.0
--Get the fault value from the fault translation table
Select @TEFault_Id = TEFault_Id
    From Timed_Event_Fault
    Where PU_Id = @PU_Id
--Create or Append event if outside limit
If @Outside_Limit = 1
    Begin
        Set @OutputValue = 'Event Created'
        Select @ TEDet_Id = TEDet_Id,
                                    @Start_Time = Start_Time,
                                    @End_Time = End_Time,
                                    @Reason1=Reason_Level1,
                                    @Reason2=Reason_Level2,
                                    @Reason3=Reason_Level3,
                                    @Reason4=Reason_Level4
                From timed_event_details
                Where pu_id = @Pu_Id and Start_time <= @EventStartTime and ((End_Time >=
@EventStartTime) or (End_Time is Null))
        If @TEDet_Id is NULL
            Begin
                Select 5, @PU_Id,
@PU_Id,NULL,@TEFault_Id,NULL,NULL,NULL,NULL,@ProductionRate,@Duration,1,@EventStart
Time,NULL,0
                Select 5, @PU_Id,
@PU_Id,NULL,@TEFault_Id,NULL,NULL,NULL,NULL,@ProductionRate,@Duration,4,NULL,@Tim
estamp,0
                End
        Else
                Begin
            Select 5, @PU_Id,
@PU_Id,NULL,@TEFault_Id,@Reason1,@Reason2,@Reason3,@Reason4,NULL,NULL,2,@Start_Tim
e,@Timestamp,@TEDet_Id
            End
    End
```

```
/* 5.0B76 required for downtime rst
    // Downtime
    // -------------------------------
    // 0 - Result SetType (5)
    // 1 - PU_Id
    // 2 - Source PU_ID
    // 3 - Status ID
    // 4 - Fault Id
    // 5 - Reason1
    // 6 - Reason2
    // 7 - Reason3
    // 8 - Reason4
    // 9 - Production Rate
    // 10 - Duration
    // 11 - TransType (1,2,3,4)
            -(1 Add)
            -(2 Update)
            -(3 Delete)
            -(4 Close)
    // 12 - StartTime
    // 13 - EndTime
    // 14 - TEDet_Id
*/
```

SpLocal_BleachRollingAvg

/*

Procedure Name: spLocal_BleachRollingAvg

Copyright (C) 2001, International Paper Company

Revision History:

| Date | By | Description |
|---|---|---|
| Jun. 30, 2001 | SC (Entegreat, Inc.) | Initial release |
| Aug. 20, 2001 | SC (Entegreat, Inc.) | Comments added |

General Description:

This procedure calculates a 3-hour moving average of the dependent variable (typically ph, ORP or recirculation flow) value every hour from a minimum number of samples over the 3-hour interval.

Currently, the requirement is that there must be more than 50% good samples in order for the average to be calculated. "Good" samples consist of valid numeric values taken while there was potential to emit (PTE) and where the data validity, as determined by the %-Good PI variable, is good. Null values and values where the %-Good requirement is not met are excluded from the moving average. Typically, for the standard model, this procedure calculates the average of the 15-minute ph, ORP, or recirculation flow values over the last 3-hours.

Triggers:

1. Time (based on sample interval for variable)
2. Dependant variable value change
3. Input value change In order for the calculation to execute, non-optional calculation input values cannot be NULL.

Inputs and Dependencies:

1. Requires configuration of the dependant variable which is the value to be tested (e.g., "pH 15-Min Avg Used for 3 Hr Rolling Avg").
2. Inputs described in body of code.

Outputs:

1. 3-Hour Average (float)

Variables:

1. Described in body of code.

Tables Modified:

1. N/A

```
*/
CREATE PROCEDURE spLocal__BleachRollingAvg
--Calculation Input and Output
@OutputValue float OUTPUT,                    --Calculated 3-hour moving
                                              average (output)
@Var__id int,
                                              --Variable Id of this variable
@Start__Time varchar(30),                     --Beginning of the time interval over which the
                                              3-hr average
                                              --is calculated. Internally calculated by Proficy
                                              based on
                                              --the sample window specified in the variable
                                              sheet.
@End__Time varchar(30),                       --End of the time interval over which the 3-hr
                                              average
                                              --is calculated. Internally calculated by Proficy
                                              based on
                                              --the sample window specified in the variable
                                              sheet.
@PctVar__Id int
                                              --Variable Id of the corresponding %-Good
variable
                                              --that determines data validity.
AS
Declare
      @DepVar__Id int,
      --Dependent variable Id (the variable to be averaged).
      @UnitDownCount int,
--Number of samples with a status of "Unit Down".
      @BadDataCount int,
--Number of samples with a status of "Bad Val".
      @NullCount int,
      --Number of samples with NULL values.
      @PctGood float,
      --Lower reject limit of the %-Good variable.
      @PctLimit float,
      --Calculated upper limit on the number of invalid samples
                --allowed in the 3-hr window.
      @SampleSize float,
      --Calculated expected number of samples over the interval
                --to be averaged (typ 12=180/15).
      @SampleVar int,
      --Sampling window for this variable (typ 180 mins).
      @SampleDepVar int, --
Sampling interval of the dependant variable (typ 15 mins).
      @totalcount int
      --Total number of samples found over the sample
                --window (typ 12 samples over 3-hours).
--Get the variable Id of the dependant variable (i.e., the variable to be averaged)
Select @DepVar__Id = Var__Id
   From Calculation__Instance__Dependencies
   Where Result__Var__Id = @Var__Id
--Validate the dependant variable Id
If (@DepVar__Id is Null)
begin
   Select @OutputValue = Null
   Return
end
--Get the lower reject limit of the corresponding %-Good variable (typically 50%)
Select @PctGood = Convert(float,L__Reject)
  from var__specs
  where var__id = @PctVar__Id
--Get the sampling window for this variable (typically 180-mins)
Select @SampleVar = Sampling__Window
   From Variables
   Where Var__Id = @Var__Id
--Get the sampling interval of the dependant variable (typically 15-mins)
Select @SampleDepVar = Sampling__Interval
   From Variables
```

-continued

```
   Where Var__Id = @DepVar__Id
--Calculate the expected number of samples over the 3-hour interval (typically 12=180/15)
Set @SampleSize = Convert(float,@SampleVar)/Convert(float,@SampleDepVar)
--Calculate the upper limit for the number of invalid values allowed in the
--3-hour window (typically 6=50%*12)
Set @PctLimit = @SampleSize *(@PctGood/100.0)
--Store the values of the dependant variable (the variable to be averaged) over the
--3-hour window into a temporary table
Select Result
   Into #Tests
   From Tests
   Where (Var__Id = @DepVar__Id) And (Result__On > @Start__Time) And (Result__On <= @End__Time)
--Count the number of samples over the 3-hour window
Select @totalcount = count(*)
      From #tests
-- If there are less than the expected number samples (typically 12) over the window then quit
if @totalcount < @samplesize
      begin
            Set @OutputValue = Null
            Return
      end
--Count the number of samples taken where the unit has no PTE
Select @UnitDownCount = Count(*)
  From #Tests
  Where Result = 'Unit Down'
--Count the number of samples where the corresponding data %-Good variable
--indicates bad data (i.e., CMS event)
Select @BadDataCount = Count(*)
   From #Tests
   Where Result = 'Bad Val'
--Count the number of samples with no value
Select @NullCount = Count(*)
   From #Tests
   Where Result is Null
Select @OutputValue = NULL
--If the "Unit Down Count" >= the maximum allowable (typically 6) then
--quit - do not calculate the average
If Convert(float,@UnitDownCount) >= @PctLimit
     Return
--If the "Bad Data Count" >= the maximum allowable (typically 6) then
--quit - do not calculate the average
If Convert(float,@BadDataCount) >= @PctLimit
     Return
--If the "No Value Count" >= the maximum allowable (typically 6) then
--quit - do not calculate the average
If Convert(float,@NullCount) >= @PctLimit
     Return
--If the sum of the above counts >= the maximum allowable (typically 6) then
--quit - do not calculate the average
If (Convert(float,@UnitDownCount+@BadDataCount+@NullCount)) >= @PctLimit
     Return
--Calculate the 3-hour average using only valid values
If (@BadDataCount > 0) or (@UnitDownCount > 0) or (@NullCount > 0)
   Select @OutputValue = SUM(Convert(float,Result))/(@SampleSize –
  (Convert(float,@UnitDownCount+@BadDataCount+@NullCount)))
            from #Tests
            where (Result <> 'Bad Val' and Result <> 'Unit Down' and Result is NOT Null)
else
   Select @OutputValue = SUM(Convert(float,Result))/@SampleSize
            from #Tests
            where (Result <> 'Bad Val' and Result <> 'Unit Down'and Result is NOT Null)
--Drop the temporary table
Drop Table #Tests
SpLocal__BleachRollingAvgStatus
/*
Procedure Name:       spLocal__BleachRollingAvgStatus
   Copyright (C) 2001, International Paper Company
```

SpLocal_BleachRollingAvgStatus

/*

Procedure Name: spLocal_B leach RollingAvgStatus

Copyright (C) 2001, International Paper Company

Revision History:

| Date | By | Description |
|---|---|---|
| Jun. 30, 2001 | SC (Entegreat, Inc.) | Initial release |
| Aug. 21, 2001 | SC (Entegreat, Inc.) | Comments added |

General Description:

This procedure generates a status message to compliment the 3-hour moving average calculation result.

Triggers:

1. Time (based on sample interval for variable)
2. Dependant variable value change
3. Input value change In order for the calculation to execute, non-optional calculation input values cannot be NULL.

Inputs and Depedencies:

1. Requires configuration of the depedant variable which is the value to be tested (e.g., "pH 15-Min Avg Used for 3 Hr Rolling Avg").
2. Inputs described in body of code.

Outputs:

Type: Status message (string)

| Value | Occures when . . . |
|---|---|
| "OK" | The 3-hour average was successfully calculated. The result was inside the specification limit and an EE event was not generated. |
| "EE" | The 3-hour average was successfully calculated. The result was outside the specification limit and an EE wvent was generated. |
| "Insuf Data" | The average was not calculated because there was less than the minimum required number of valid samples (typically 7) |
| "Unit Down" | The average was not calculated because the unit was down (i.e., no potential to emit) for half or more intervals over the 3-hour period. |
| "Bad Data" | Half or more of the %-Good values were less than 50%. |
| "Null In" | Half or more of the samples were NULL. |
| "No Dep Variable" | The dependant variable is not configured. |
| "No Spec Variable" | The input variable from which specification limits are retrieved is not configured. |
| "No Limit" | The Reject_Limit input constant is not configured ("LR", "LW", "UW" or "UR"). |
| "Bad Limit" | The retrieved specification limit is NULL. |
| "Bad PctGood" | The lower reject limit of the %-Good variable is NULL. |

Variables:

1. Described in body of code.

Tables Modified:

1. N/A

```
*/
CREATE PROCEDURE spLocal_BleachRollingAvgStatus
--Input and Output
@OutputValue varchar(25) OUTPUT,                --Status message (output)
@Var_Id int,
    --Variable Id of this variable
@Start_Time varchar(30),                        --Beginning of the time interval over
                                                which the 3-hr average
                                                --is calculated. Internally calculated by
                                                Proficy based on the
                                                --sample window specified in the
                                                variable sheet.
@End_Time varchar(30),                          --End of the time interval over which the
                                                3-hr average
                                                --is calculated. Internally calculated by
                                                Proficy based on the
                                                --sample window specified in the
                                                variable sheet.
@PctVar_Id int,
                                                --Variable Id of the corresponding %-
Good variable that
                                                --determines data validity.
@Reject_Limit varchar(2),                       --Specification limit applied in test
                                                --(valid values: "LR","LW","UW" or
                                                "UR")
@RejectVar_Id int                               --The variable Id of the variable with the
                                                appropriate
                                                --specifications.
AS
Declare
    @DepVar_Id int,                             --Dependent variable Id (the variable to
                                                be averaged).
    @UnitDownCount int,
                                                --Number of samples with a status of
"Unit Down".
    @BadDataCount int,                          --Number of samples with a status of
"Bad Val".
```

-continued

```
    @NullCount int,                          --Number of samples with NULL
values.
    @PU__Id int,                             --Unit Id of this variable
    @PctGood float,                          --Lower reject limit of the %-Good
variable.
    @PctLimit float,                         --Calculated upper limit on the number
of invalid samples
                                             --allowed in the 3-hr window.
    @Average float,                          --3-hour rolling average value
    @RejectVal float,                        --Specification limit value used to test
for EE events
    @SampleVar int,                          --Sampling window for this variable
(typ 180 mins).
    @SampleDep Var int,                      --Sampling interval of the dependant
variable (typ 15 mins).
    @SampleSize int,                         --Calculated expected number of
samples over the interval
                                             --to be averaged (typ 12=180/15).
@totalcount int                              --Total number of samples found over
the sample window
                                             --(typ 12 samples over 3-hours).
Set @OutputValue = 'OK'
                                             --Get dependant variable Id
Select @DepVar__Id = Var__Id
    From Calculation__Instance__Dependencies
    Where Result__Var__Id = @Var__Id
                                             --Validate dependant variable Id
If (@Dep Var__Id is Null)
begin
    Select @OutputValue = 'No Dep Variable'
    Return
end
                                             --Validate variable to which
                                             specification limits have been assigned
If (@RejectVar__Id is Null)
begin
    Select @OutputValue = 'No Spec Variable'
    Return
end
                                             --Get the unit Id for this variable
Select @PU__Id = PU__Id
    From Variables
    Where Var__Id = @Var__Id
                                             --Validate specification limit used for
                                             comparison ("LR","LW","UW", or
                                             "UR")
if @Reject__Limit = NULL or @Reject__Limit = ''
begin
    Set @OutputValue = 'No Limit'
    Return
end
Set @RejectVal = NULL
                                             --Get designated specification limit
                                        value
if @Reject__Limit = 'LR'
        Select @RejectVal = L__Reject
            from var__specs
            where var id = @RejectVar__Id
if @Reject__Limit = 'LW'
        Select @RejectVal = L__Warning
            from var__specs
            where var__id = @RejectVar__Id
if @Reject__Limit = 'UW'
        Select @RejectVal = U__Warning
            from var__specs
            where var__id = @RejectVar__Id
if @Reject__Limit = 'UR'
        Select @RejectVal = U__Reject
            from var__specs
            where var__id = @RejectVar__Id
                                             --Validate specification limit value
if @RejectVal = NULL
begin
    Select @OutputValue = 'Bad Limit'
    Return
end
                                             --Get the sampling window for this
                                             variable (typically 180-mins)
Select @SampleVar = Sampling__Window
```

-continued

```
    From Variables
    Where Var__Id = @Var__Id
                                        --Get the sampling interval of the
                                        dependant variable (typically 15-mins)
Select @SampleDep Var = Sampling__Interval
    From Variables
    Where Var__Id = @-DepVar__Id
                                        --Get the lower reject limit of the %-
                                        Good variable (typically 50%)
select @PctGood = Convert(float,L__Reject)
    From var__specs
    Where var__id = @PctVar__Id
                                        --Validate the value of the lower reject
                                        limit of the %-Good variable
if @PctGood = NULL or @PctGood = ''
begin
    Select @OutputValue = 'Bad PctGood'
    Return
end
                                        --Calculate the expected number of
                                        samples over the 3-hour interval
                                        (typically 12=180/15)
Set @SampleSize = @SampleVar/@SampleDep Var
                                        --Calculate the upper limit for the
                                        number of invalid values allowed in
                                        order for the 3-hour
                                        --average to be calculated (typically
                                        6=50%*12)
Set @PctLimit = Convert(float,@SampleSize)*(@PctGood/ 100.0)
                                        --Store the sample values of the
                                        dependant variable over the 3-hour
                                        window into a temporary table
Select Result
    Into #Tests
    From Tests
    Where (Var__Id = @DepVar__Id) And (Result__On > @Start__Time) And (Result__On <= @End__Time)
                                        --Count the number of samples over the
                                        3-hour window
Select @totalcount = count(*)
        From #tests
                                        --If there are less than the expected
                                        number of samples (typically 12) in the
                                        3-hour window
                                        --then send message and quit
if @totalcount < @samplesize
        Begin
    Set @OutputValue = 'Insuf Data'
        Return
        end
                                        --Count the number of samples taken
                                        where the unit has no PTE
Select @UnitDownCount = Count(*)
    From #Tests
    Where Result = 'Unit Down'
                                        --Count the number of samples where
                                        the corresponding data %-Good variable
                                        indicates bad data (i.e., CMS event)
Select @BadDataCount = Count(*)
    From #Tests
    Where Result = 'Bad Val'
                                        --Count the number of samples with no
                                        value
Select @NullCount = Count(*)
    From #Tests
    Where Result is Null
                                        --Calculate the 3-hour average using
                                        only valid samples
If (@BadDataCount > 0) or (@UnitDownCount > 0) or (@NullCount > 0)
    Select @Average = SUM(Convert(float, Result))/(@SampleSize -
(Convert(float,@UnitDownCount+@BadDataCount+@NullCount)))
        from #Tests
        where (Result <> 'Bad Val' and Result <> 'Unit Down' and Result is NOT Null)
else
    Select @Average = SUM(Convert(float,Result))/@SampleSize
        from #Tests
        where (Result <> 'Bad Val' and Result <> 'Unit Down'and Result is NOT Null)
                                        --If the "Unit Down Count" >= the
                                        maximum allowable (typically 6) then
                                        send message and quit.
```

-continued

```
If Convert(float,@UnitDownCount) >= @PctLimit
    Begin
        Set @OutputValue = 'Unit Down'
        Return
    End
--If the "BadDataCount" >= the maximum allowable (typically 6) then send message and quit.
If Convert(float,@BadDataCount) >= @PctLimit
    Begin
        Set @OutputValue = 'Bad Val'
        Return
    End
                                        --If the "NULL Count" >= the
                                        maximum allowable (typically
                                        6) then send message and quit.
If Convert(float,@NullCount) >= @PctLimit
    Begin
        Set @OutputValue = 'Null In'
        Return
    End
                                        --If the sum of the above counts >= the
                                        maximum allowable (typically 6) then
                                        send message and quit.
If (Convert(float,@UnitDownCount)+Convert(float,@BadDataCount)+Convert(float,@NullCount)) >=
@PctLimit
    Begin
        Set @OutputValue = 'Insuf Data'
        Return
    End
                                        --If there is sufficient data then test for
                                        an EE event
If @Reject_Limit = 'LR' or @Reject_Limit='LW'
begin
        if @Average < @RejectVal
        Set @OutputValue = 'EE'
        Return
end
If @Reject_Limit = 'UW' or @Reject_Limit='UR'
begin
        if @Average > @RejectVal
        Set @OutputValue = 'EE'
        Return
end
Set @OutputValue = 'OK'
Drop Table #Tests
```

SpLocal_ManualUpdate

/*

Procedure Name: spLocal_ManualUpdate

Copyright (C) 2001, International Paper Company

Revision History:

| Date | By | Description |
|---|---|---|
| Jun. 30, 2001 | SC (Entegreat, Inc.) | Initial release |
| Aug. 21, 2001 | SC (Entegreat, Inc.) | Comments added |

General Description:

This procedure performs a signal selection between a manually entered value and another variable. If the dependant variable value (the manually entered value) is NULL, the output is the value of the input variable (the PI value). Otherwise, the output is set to the value of the dependant variable.

Triggers:

1. Time (based on sample interval for variable)
2. Dependant variable value change (the manually entered value)
3. Input value change (the PI variable)

In order for the calculation to execute, non-optional calculation input values cannot be NULL.

Inputs and Dependencies:

1. Requires configuration of the dependant variable which is the manually entered value.
2. Inputs described in body of code.

Outputs:

1. The manually entered value if it's value is not NULL, otherwise the input variable value.

Variables:

1. Described in body of code.

Tables Modified:

1. N/A

```
*/
CREATE PROCEDURE spLocal_ManualUpdate
@Result varchar(25) OUTPUT,         --The value of the selected variable
@Var_Id int,                        --Variable Id of this variable
@Timestamp datetime,                --Timestamp of this variable
@PIVar_Val varchar(25)              --Value of the PI variable
AS
Declare
@ManualVar_Id int                   --Variable Id of the dependant
```

-continued

```
                                        variable (the manually entered
                                        value)
--Find the variable Id for the manually entered value (the dependant
variable)
Select @ManualVar_Id = Var_Id
   From Calculation_Instance_Dependencies
   Where Result_Var_Id = @Var_Id
                                        --Validate the variable Id for the
                                        manually entered variable
If (@ManualVar_Id is NULL)
   Begin
    Set @Result = 'Null Manual Var'
    Return
   End
                                        --Get the current value of the
                                        manually entered variable
Select @Result = Result from Tests
   where Var_Id = @ManualVar_Id and Result_On = @TimeStamp
                                        --If the value of the manually
                                        entered variable is NULL, then
                                        output the value of the input
                                        variable (PI variable)
If (@Result is NULL) or (@Result = '')
   Begin
    Set @Result=@PIVar_Val
   End
```

SpLocal_MillDay

/*

Procedure Name: spLocal_MillDay

Copyright (C) 2001, International Paper Company

Process Management Application Group

Revision History:

| Date | By | Description |
|---|---|---|
| Jun. 30, 2001 | SC (Entegreat, Inc.) | Initial release |
| Aug. 21, 2001 | SC (Entegreat, Inc.) | Comments added |

General Description:

This procedure calculates a date string for display that coincides with the mill day. The time at which the mill day begins is hard-coded within this procedure (see comments below).

Triggers:

1. Time (based on sample interval for variable)

Inputs and Dependencies:

1. Inputs described in body of code.

Outputs:

1. Date string for the mill day.

Variables:

1. Described in body of code.

Tables Modified:

1. N/A

-continued

```
*/
CREATE PROCEDURE spLocal_MillDay
@Outputvalue varchar(255) OUTPUT,        --MillDay
@TimeStamp datetime                      --Timestamp for this
                                         variable
AS
Declare
@Day varchar(25),                        --Day
part of mill day
@PreviousDay datetime,                   --Timestamp
                                         for previous day
@Month varchar(25),                      --Month part of mill day
@Year varchar(25),                       --Year part of mill day
@MillDay varchar(25),                    --Mill day string
@Hour varchar(25),                       --Hour part of timestamp
@Minute varchar(25),                     --Minute part of
                                         timestamp
@time float
                                         --Time part of timestamp
                                         --Initialize variables
Select @PreviousDay = ''
Select @Day = ''
Select @Month = ''
Select @Year = ''
                                         --Strip hour and minute
                                         from timestamp
Select @Hour=DatePart(hh,@Timestamp)
Select @Minute=DatePart(mi,@Timestamp)
Select @time=100*@Hour+@Minute
                                         --Calculate mill day with
                                         the new day beginning at
                                         on minute past the mill day
                                         rollover
                                         --The rollover time is
                                         hard-coded within the "If"
                                         statement below.
If ((@time>=0) and (@time<701))
Begin
Select @PreviousDay = DateAdd(dd,-1,@Timestamp)
Select @Day = DatePart(dd,@PreviousDay)
Select @Month = DatePart(mm,@PreviousDay)
Select @Year = DatePart(yyyy,@PreviousDay)
Select @MillDay = convert(varchar(25),@Month) + '/' + convert
(varchar(25),@Day) + '/' +
convert(varchar(25),@Year)
End
Else
Begin
Select @Day = DatePart(dd,@Timestamp)
Select @Month = DatePart(mm,@Timestamp)
Select @Year = DatePart(yyyy,@Timestamp)
Select @MillDay = convert(varchar(25),@Month) + '/' + convert
(varchar(25),@Day) + '/' +
convert(varchar(25),@Year)
End
Select @Outputvalue = @MillDay
```

What is claimed:

1. A method for the combined monitoring and reporting of actual and potential emissions of multiple phases of matter from a production facility having at least one operating units which utilizes and/or generates such multiple phases of matter comprising the steps of:

identifying at least one potential source of an emission event of gaseous matter, liquid matter or a combination of gaseous and liquid matter generated within the operating unit and desired to be monitored and reported;

at the potential source, providing means for detecting the emission event occurring at said source and generating an emission event signal which is representative of a detected emission event;

generating an operation signal representative of an operational phase of the operating unit which is associated with the potential source;

comparing the emission event signal and the operation signal to determine the status of the operation of the operating unit at the time of said emission event; and reporting as an actual emission event only those emission events which positively correlate with an associated ongoing production phase of the operating unit at the time of the reported emission event.

2. The method of claim 1 which further comprises transmitting the emission event signal and the operation signal to at least one central location and comparing the emission event signal and the operation signal at the central location.

3. The method of claim 1 further comprising the step of comparing:

a total emission of gaseous matter over a given time period to the total regulatory allowable emission of gaseous matter over said given time period, a total emission of liquid matter over a given time period to the total regulatory allowable emission of liquid matter over said given time period, or a total emission of liquid and gaseous matters over a given time period to the total regulatory allowable emission of liquid and gaseous matter over said given time period.

4. The method of claim 1 wherein said emission event signal comprises:

an occurrence of the emission event, a time of occurrence of the emission event, a duration of the emission event, a location of the emission event, a total mass of emitted matter, a total volume of emitted matter, or a combination of two or more thereof.

5. The method of claim 1 wherein said operation signal comprises:

a gaseous flow for the operating unit, a liquid flow for the operating unit, a combination of liquid and gaseous flow for the operating unit, temperatures of the operating unit, production throughput of said operating unit, raw matters inflow into the at least operating unit or a combination of two or more thereof.

6. The method of claim 1 which comprises comparing the emission event signal and the operation signal to determine:

a total mass of emitted matter for the operating unit on a time basis, a total mass of emitted matter for the operating unit on a volume basis, a total mass of emitted matter on a unit of process production basis, or a combination of two or more thereof.

7. The method of claim 1 which comprises reporting as an actual emission event those emission events which positively correlate with an associated on-going operating unit at the time of the reported emission event and those emission events that are associated with an emission event signal.

8. The method of claim 1 which comprises reporting:

a percent or quantity of emitted gaseous matter relative to the total regulatory allowable percent or quantity of emitted gaseous matter, a percent or quantity of emitted liquid matter relative to the total regulatory allowable percent or quantity of emitted liquid matter or a percent of emitted liquid and gaseous matters relative to the total regulatory allowable percent or quantity of emitted of liquid and gaseous matter.

9. The method of claim 7 which further comprises reporting with each actual emission event an occurrence of an emission event, a time of occurrence of the emission event, a duration of the emission event, a location of the emission event, a total mass of emitted matter per unit time for the operating unit, a total mass of emitted matter for the operating unit, a response to the emission event or a combination of two or more thereof.

10. The method of claim 7 which comprises identifying at least one potential source of an emission event of gaseous matter, liquid matter or a combination of gaseous and liquid matter generated within the operating unit and desired to be monitored and reported which are subject to state, federal or state and federal environmental monitoring.

11. A method for the combined monitoring and reporting of actual and potential emissions of multiple phases of matter from a production facility having at least one operating units which utilizes and/or generates such multiple phases of matter comprising the steps of:

identifying all or substantially potential sources of emission events of gaseous matter, liquid matter or a combination of gaseous and liquid matter generated within the operating units which are desired to be monitored and reported;

at each potential source, providing means for detecting the emission event occurring at each source and generating one or more emission event signal which are representative of the detected emission events, generating one or more operation signals representative of an operational phase of the operating units which are associated with the potential sources, transmitting the emission event signals and the operation signals to at least one central location and comparing the emission event signals and the operation signal at the central location to determine the status of the operation of the operating units at the time of said emission events; and reporting as an actual emissions event those emission events which positively correlate with an associated on-going operating unit at the time of the reported emission event and those emission events that are associated with an emission event signal.

12. The method of claim 11 which further comprises transmitting the emission event signal and the operation signal to at least one central location and comparing the emission event signal and the operation signal at the central location.

13. The method of claim 12 which further comprises reporting as an actual emissions event those emission events which positively correlate with an associated on-going operating unit at the time of the reported emission event and those emission events that are associated with an emission event signal.

14. The method of claim 13 which further comprises;

aggregating mass emissions from each emission location into a total mass emissions and reporting the total mass emissions, reporting as an aggregation simultaneous emissions by comparing simultaneous emissions events and reporting no more than one minute of emissions during any one minute period, or a combination thereof.

15. The method of claim 11 further comprising the step of comparing:

a total emission of gaseous matter over a given time period to the total regulatory allowable emission of gaseous matter over said given time period, a total emission of liquid matter over a given time period to the total regulatory allowable emission of liquid matter over said given time period or a total emission of liquid and gaseous matters over a given time period to the total regulatory allowable emission of liquid and gaseous matter over said given time period.

16. The method of claim 11 wherein said emission event signal comprises:

an occurrence of the emission event, a time of occurrence of the emission event,
a duration of the emission event,
a location of the emission event, a total mass of emitted matter,
a total volume of emitted matter, or
a combination of two or more thereof.

17. The method of claim 11 wherein said operation signal comprises:
a gaseous flow for the operating unit,
a liquid flow for the operating unit,
a combination of liquid and gaseous flow for the operating unit, temperatures of the operating unit,
production throughput of said operating unit,
raw matters inflow into the at least operating unit or
a combination of two or more thereof.

18. The method of claim 11 which comprises comparing the emission event signal and the operation signal to determine:
a total mass of emitted matter for the operating unit on a time basis,
a total mass of emitted matter for the operating unit on a volume basis,
a total mass of emitted matter on a unit of process production basis, or
a combination of two or more thereof.

19. The method of claim 11 which comprises reporting as an actual emission event those emission events which positively correlate with an associated on-going operating unit at the time of the reported emission event and those emission events that are associated with an emission event signal.

20. The method of claim 11 which comprises reporting:
a percent or quantity of emitted gaseous matter relative to the total regulatory allowable percent or quantity of emitted gaseous matter,
a percent or quantity of emitted liquid matter relative to the total regulatory allowable percent or quantity of emitted liquid matter or
a percent of emitted liquid and gaseous matters relative to the total regulatory allowable percent or quantity of emitted of liquid and gaseous matter.

21. The method of claim 19 which further comprises reporting with each actual emission event an occurrence of an emission event, a time of occurrence of the emission event, a duration of the emission event, a location of the emission event, a total mass of emitted matter per unit time for the operating unit, a total mass of emitted matter for the operating unit, a response to the emission event or a combination of two or more thereof.

22. The method of claim 11 which comprises identifying at least one potential source of an emission event of gaseous matter, liquid matter or a combination of gaseous and liquid matter generated within the operating unit and desired to be monitored and reported which are subject to state, federal or state and federal environmental monitoring.

* * * * *